US010919683B2

(12) United States Patent
Bessho et al.

(10) Patent No.: US 10,919,683 B2
(45) Date of Patent: Feb. 16, 2021

(54) THERMAL ENERGY STORAGE PACK, THERMAL EXCHANGE UNIT, AND MANUFACTURING METHOD OF THERMAL ENERGY STORAGE PACK

(71) Applicant: SHARP KABUSHIKI KAISHA, Sakai (JP)

(72) Inventors: Hisanori Bessho, Sakai (JP); Daiji Sawada, Sakai (JP); Yuka Utsumi, Sakai (JP); Takashi Yamashita, Sakai (JP); Hwisim Hwang, Sakai (JP); Masao Urayama, Sakai (JP); Yuichi Kamimura, Sakai (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 448 days.

(21) Appl. No.: 15/577,682

(22) PCT Filed: May 26, 2016

(86) PCT No.: PCT/JP2016/065526
§ 371 (c)(1),
(2) Date: Nov. 28, 2017

(87) PCT Pub. No.: WO2016/190378
PCT Pub. Date: Dec. 1, 2016

(65) Prior Publication Data

US 2018/0162627 A1 Jun. 14, 2018

(30) Foreign Application Priority Data

May 28, 2015 (JP) ..... JP2015-109143
Oct. 27, 2015 (JP) ..... JP2015-211316
Feb. 5, 2016 (JP) ..... JP2016-020573

(51) Int. Cl.
*B65D 81/38* (2006.01)
*A47G 23/02* (2006.01)
(Continued)

(52) U.S. Cl.
CPC ..... *B65D 81/3813* (2013.01); *A47G 23/02* (2013.01); *B65D 81/3883* (2013.01);
(Continued)

(58) Field of Classification Search
CPC ..... B65D 81/3813; B65D 81/3883; B65D 81/3886; F25D 3/08; F25D 2303/0846;
(Continued)

(56) References Cited

U.S. PATENT DOCUMENTS

2013/0221013 A1* 8/2013 Kolowich ..... A47G 19/127 220/592.17
2016/0290703 A1* 10/2016 Allen ..... A45C 11/20

FOREIGN PATENT DOCUMENTS

JP 2009-168303 A 7/2009
JP 2010-047313 A 3/2010
WO 2015/045029 A1 4/2015

* cited by examiner

*Primary Examiner* — Rick K Chang
(74) *Attorney, Agent, or Firm* — ScienBiziP, P.C.

(57) ABSTRACT

An object to be cooled is quickly brought to a suitable temperature. An object to be cooled is quickly brought to a suitable temperature. A thermal energy storage pack 1 according to the present invention is a thermal energy storage pack that performs temperature management of food and/or beverage, and includes a first deep-drawn container filled with a first thermal energy storage material that exhibits phase change at a predetermined temperature, a second deep-drawn container that is overlaid by the first accommodation portion and that is filled with a second thermal energy storage material that maintains a liquid phase state at the phase change temperature of the first thermal
(Continued)

energy storage material, and a cover material that closes off the first deep-drawn container. The second deep-drawn container comes into contact with a wine bottle.

19 Claims, 41 Drawing Sheets

(51) Int. Cl.
*F25D 3/08* (2006.01)
*F28D 20/02* (2006.01)

(52) U.S. Cl.
CPC ..... *B65D 81/3886* (2013.01); *F25D 3/08* (2013.01); *F25D 2303/085* (2013.01); *F25D 2303/0843* (2013.01); *F25D 2303/0846* (2013.01); *F25D 2303/08222* (2013.01); *F28D 20/02* (2013.01)

(58) Field of Classification Search
CPC ... F25D 2303/0843; F25D 2303/08222; F25D 2303/085; A47G 23/02; F28D 20/02
See application file for complete search history.

| STRENGTH OF SEAL [kgf/15 mm] | CONVENTIONAL EXAMPLE | PRESENT INVENTION |
|---|---|---|
| Ave. | 0.9 | 4.3 |
| Min. | 0.8 | 3.5 |
| Max. | 1.1 | 5.1 |

FIG 14

| ITEM | | FIRST COMPARATIVE EXAMPLE | SECOND COMPARATIVE EXAMPLE | THIRD COMPARATIVE EXAMPLE | FIRST EXAMPLE | SECOND EXAMPLE | THIRD EXAMPLE |
|---|---|---|---|---|---|---|---|
| ANTIFREEZE | COMPOSITION | NaCl_23%+CMC_5% | — | NaCl_23%+CMC_5% | NaCl_23%+CMC_5% | NaCl_23%+CMC_5% | NaCl_23%+CMC_5% |
| | AMOUNT USED | 300 g | — | 150 g | 150 g | 150 g | 150 g |
| THERMAL ENERGY STORAGE MATERIAL | COMPOSITION | — | KCl_21%+CMC_5% | KCl_21%+CMC_5% | KCl_21%+CMC_5% | $NH_4Cl$_18%+CMC_5% | TBAB_40%+CMC_5% |
| | AMOUNT USED | — | 300 g | 150 g | 150 g | 150 g | 150 g |
| FORM OF MOUNTING | | VERTICAL PILLOW PACKING | ← | VERTICAL PILLOW PACKING (PACK-IN-PACK) | PTP PACKING (DEEP-DRAWN CONTAINER) | ← | ← |

FIG.23

| ITEM | | FIRST COMPARATIVE EXAMPLE | SECOND COMPARATIVE EXAMPLE | THIRD COMPARATIVE EXAMPLE | FIRST EXAMPLE | SECOND EXAMPLE | THIRD EXAMPLE |
|---|---|---|---|---|---|---|---|
| ANTIFREEZE | COMPOSITION | NaCl_23%+CMC_5% | – | NaCl_23%+CMC_5% | NaCl_23%+CMC_5% | NaCl_23%+CMC_5% | NaCl_23%+CMC_5% |
| | AMOUNT USED | 300 g | – | 150 g | 150 g | 150 g | 150 g |
| THERMAL ENERGY STORAGE MATERIAL | COMPOSITION | – | KCl_21%+CMC_5% | KCl_21%+CMC_5% | KCl_21%+CMC_5% | NH4Cl_18%+CMC_5% | TBAB_40%+CMC_5% |
| | AMOUNT USED | – | 300 g | 150 g | 150 g | 150 g | 150 g |
| DEGREE OF RAPID COOLING (–) | | 0.7 | 0.5 | 0.7 | 0.8 | 0.9 | 0.6 |
| ATTAINED TEMPERATURE (°C) | | 12.1 | 9.9 | 10.1 | 4.1 | 3.5 | 15.1 |
| ATTAINING TIME (MINUTES) | RED WINE | 10 | 13 | 9 | 8 | 8 | 12 |
| | WHITE WINE | – | 40 | 27 | 20 | 19 | – |
| | SPARKLING WINE | – | – | – | 45 | 35 | – |
| FORM OF MOUNTING | | VERTICAL PILLOW PACKING | ← | VERTICAL PILLOW PACKING (PACK-IN-PACK) | PTP PACKING (DEEP-DRAWN CONTAINER) | ← | ← |
| | | | | | | | |

TEMPERATURE MEASUREMENT POINTS

FIG. 41

| ITEM | | | FOURTH COMPARATIVE EXAMPLE | FIFTH COMPARATIVE EXAMPLE | SIXTH COMPARATIVE EXAMPLE | FOURTH EXAMPLE | FIFTH EXAMPLE | SIXTH EXAMPLE | SEVENTH EXAMPLE |
|---|---|---|---|---|---|---|---|---|---|
| UPPER TIER | ANTIFREEZE | COMPOSITION | AQUEOUS SOLUTION OF NaCl_23 wt% | ← | ← | AQUEOUS SOLUTION OF NaCl_23 wt% | ← | ← | ← |
| | | AMOUNT USED | 20 g×6 | ← | 10 g×6 | 60 g×6 | ← | ← | ← |
| | LATENT HEAT MATERIAL | COMPOSITION | AQUEOUS SOLUTION OF KCl_20 wt% | ← | ← | AQUEOUS SOLUTION OF KCl_20 wt% | ← | ← | ← |
| | | AMOUNT USED | 25 g×6 | ← | 15 g×6 | 25 g×6 | ← | 15 g×5 | ← |
| MIDDLE TIER | ANTIFREEZE | COMPOSITION | – | – | AQUEOUS SOLUTION OF NaCl_23 wt% | – | – | – | – |
| | | AMOUNT USED | – | – | 10 g×6 | – | – | – | – |
| | LATENT HEAT MATERIAL | COMPOSITION | | | AQUEOUS SOLUTION OF KCl_20 wt% | | | | |
| | | AMOUNT USED | – | – | 10 g×6 | – | – | – | – |
| LOWER TIER | ANTIFREEZE | COMPOSITION | AQUEOUS SOLUTION OF NaCl_23 wt% | ← | ← | AQUEOUS SOLUTION OF NaCl_23 wt% | ← | ← | ← |
| | | AMOUNT USED | 20 g×6 | ← | ← | 20 g×6 | ← | ← | ← |
| | LATENT HEAT MATERIAL | COMPOSITION | AQUEOUS SOLUTION OF KCl_20 wt% | ← | ← | AQUEOUS SOLUTION OF KCl_20 wt% | ← | ← | ← |
| | | AMOUNT USED | 25 g×6 | ← | ← | 25 g×6 | ← | 15 g×5 | ← |
| BOTTLE TYPE | | | BURGUNDY | BORDEAUX | BORDEAUX | BURGUNDY | BORDEAUX | BURGUNDY | BORDEAUX |
| FORM OF MOUNTING | | | | | | | | | |

FIG. 49

| ITEM | | | FOURTH COMPARATIVE EXAMPLE | FIFTH COMPARATIVE EXAMPLE | SIXTH COMPARATIVE EXAMPLE | FOURTH EXAMPLE | FIFTH EXAMPLE | SIXTH EXAMPLE | SEVENTH EXAMPLE |
|---|---|---|---|---|---|---|---|---|---|
| UPPER TIER | ANTIFREEZE | COMPOSITION | AQUEOUS SOLUTION OF NaCl_23 wt% | ← | ← | AQUEOUS SOLUTION OF NaCl_23 wt% | ← | ← | ← |
| | | AMOUNT USED | 20 g×6 | ← | 10 g×6 | 50 g×6 | ← | ← | ← |
| | LATENT HEAT MATERIAL | COMPOSITION | AQUEOUS SOLUTION OF KCl_20 wt% | ← | ← | AQUEOUS SOLUTION OF KCl_23 wt% | ← | ← | ← |
| | | AMOUNT USED | 25 g×6 | ← | 15 g×6 | 25 g×6 | ← | 15 g×5 | ← |
| MIDDLE TIER | ANTIFREEZE | COMPOSITION | – | – | AQUEOUS SOLUTION OF NaCl_23 wt% | – | – | – | – |
| | | AMOUNT USED | – | – | 10 g×6 | – | – | – | – |
| | LATENT HEAT MATERIAL | COMPOSITION | – | – | AQUEOUS SOLUTION OF KC_20 wt% | – | – | – | – |
| | | AMOUNT USED | – | – | 10 g×6 | – | – | – | – |
| LOWER TIER | ANTIFREEZE | COMPOSITION | AQUEOUS SOLUTION OF NaCl_23 wt% | ← | ← | AQUEOUS SOLUTION OF NaCl_23 wt% | ← | ← | ← |
| | | AMOUNT USED | 20 g×6 | ← | ← | 20 g×6 | ← | ← | ← |
| | LATENT HEAT MATERIAL | COMPOSITION | AQUEOUS SOLUTION OF KCl_20 wt% | ← | ← | AQUEOUS SOLUTION OF KCl_20 wt% | ← | ← | ← |
| | | AMOUNT USED | 25 g×6 | ← | ← | 25 g×6 | ← | 15 g×5 | ← |
| BOTTLE TYPE | | | BURGUNDY | BORDEAUX | BORDEAUX | BURGUNDY | BORDEAUX | BURGUNDY | BORDEAUX |
| FORM OF MOUNTING | | | 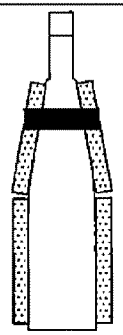 | 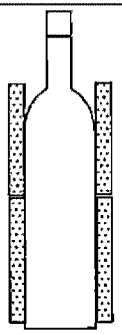 | 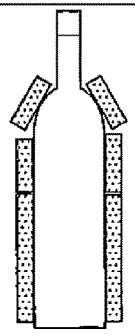 | 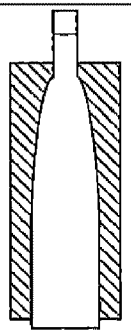 | 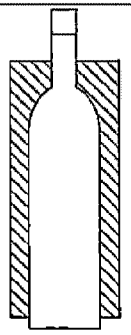 | 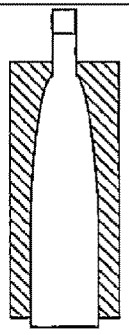 | 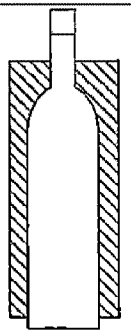 |

| TYPE OF PLASTIC | | THERMAL CONDUCTIVITY [W/m·K] |
|---|---|---|
| POLYETHYLENE (LOW-DENSITY) | LDPE | 0.33 |
| POLYETHYLENE (HIGH-DENSITY) | HDPE | 0.46 TO 0.52 |
| POLYPROPYLENE | PP | 0.12 |
| POLYSTYRENE | PS | 0.10 TO 0.14 |
| POLYCARBONATE | PP | 0.19 |
| POLYETHYLENE TEREPHTHALATE | PET | 0.14 |
| POLYAMIDE 6 (NYLON 6) | PA6 | 0.35 TO 0.43 |

| SETTING PARAMETER | | MEASUREMENT POINT | TEMPERATURE OF OBJECT TO BE COOLED [°C] | | |
|---|---|---|---|---|---|
| A | B | | AFTER 1 MINUTE | AFTER 5 MINUTES | AFTER 10 MINUTES |
| (1) | (1) | I | 0 | −13.5 | −18.0 |
| | | II | 0 | −9.8 | −17.6 |
| | | III | 0 | −14.1 | −18.0 |
| (1) | (2) | I | 0 | −3.1 | −6.7 |
| | | II | 0 | 0 | 0 |
| | | III | 0 | −3.5 | −8.3 |
| (2) | (1) | I | 0 | 0 | −2.2 |
| | | II | 0 | 0 | 0 |
| | | III | 0 | 0 | −3.7 |
| (2) | (2) | I | 0 | 0 | 0 |
| | | II | 0 | 0 | 0 |
| | | III | 0 | 0 | 0 |

THERMAL ENERGY STORAGE PACK, THERMAL EXCHANGE UNIT, AND MANUFACTURING METHOD OF THERMAL ENERGY STORAGE PACK

TECHNICAL FIELD

The present invention relates to a thermal energy storage pack that performs temperature management of food and/or beverage, a thermal exchange unit, and a manufacturing method of the thermal energy storage pack.

BACKGROUND ART

Heretofore, there have been ideal preservation temperatures for objects to be cooled, particularly regarding each of alcoholic beverages such as wine, beer, Japanese sake, and so forth, beverages such as soft drinks, water, and so forth, foodstuff, and further pharmaceutical goods. There has been demand for a cooling container capable of attaining the desired preservation temperature of the object to be cooled more quickly, and capable of maintaining the desired temperature for a long time. For example, wine and so forth has a serving temperature that should be met, and a wine cooler filled with ice water is used to cool the wine bottle.

However, with the above-described wine cooler, there is the need to remove water droplets and the like adhering to the wine bottle, each time the wine bottle is removed from the wine cooler. To do away with this troublesome burden, PTL 1 proposes a wine cooler having fixing means enabling a refrigerant to be detachably attached to an inner wall of a cooling container. FIG. 31A is a diagram illustrating an overview of the wine cooler, and FIG. 31B is a cross-sectional view of the wine cooler. A stepped portion (rib) is provided within the cooling container, and a refrigerant is provided to the stepped portion. This configuration enables a wine bottle to be inserted with water droplets less readily adhering to the wine bottle, with a simpler configuration than conventional wine coolers.

CITATION LIST

Patent Literature

PTL 1: Japanese Unexamined Patent Application Publication No. 2010-047313

SUMMARY OF INVENTION

Technical Problem

However, the wine cooler disclosed in PTL 1 has insufficient close contact between the refrigerant and the object to be cooled in a state where the refrigerant is completely frozen, so the object to be cooled cannot be quickly made to attain the desired temperature (first problem). Also, in a case where the refrigerant is unfrozen or semi-frozen, the amount of thermal energy stored by the refrigerant is insufficient, so the object to be cooled cannot be made to attain the desired temperature (second problem). FIG. 32 is a diagram illustrating these problems. The object to be cooled can be made to reach the ideal temperature by completely freezing the refrigerant, but it takes time to reach the ideal temperature since close contact is insufficient. On the other hand, in a case where the refrigerant is not completely frozen, the ideal temperature cannot be attained.

Thus, improvement is necessary regarding the degree of close contact and the degree of rapid cooling. Now, there are multiple types of shapes of wine bottles, and there is a concept of increasing close contact by dividing the refrigerant into a plurality, to ensure degree of close contact and degree of rapid cooling regardless of the shape of the wine bottle. FIG. 33A and FIG. 33B are diagrams illustrating dividing the refrigerant into three parts and connecting the refrigerants by joint mechanisms. FIG. 33A illustrates a Bordeaux type bottle. The Bordeaux type bottle has a shape where the diameter of the body as to the diameter of the neck rapidly increases at the portion where the neck and body of the bottle are joined. Even with this sort of bottle, the refrigerant divided into three comes into contact following the outer face of the bottle, so increased cooling effects can be expected. Also, FIG. 33B indicates a Burgundy type bottle. The Burgundy type bottle has a shape where the diameter of the bottle gradually increases from the neck to the body of the bottle. Even with this sort of bottle, the refrigerant divided into three comes into contact following the outer face of the bottle, so increased cooling effects can be expected.

However, increasing the number of divisions of the refrigerant increases the number of types of molds to manufacture cases for the refrigerants, and also increases manufacturing steps, thereby increasing costs. Also, increasing the number of divisions of the refrigerant increases the number of joint mechanisms (connecting portions) so the area of contact of the refrigerant as to the food and/or beverage decreases, and the performance of the thermal energy pack decreases. Accordingly, the number of divisions of the refrigerant desirably is minimal.

The present invention has been made in light of the above-described situation, and accordingly it is an object thereof to provide a thermal energy storage pack that can quickly bring an object to be cooled to an ideal temperature, a thermal exchange unit, and a manufacturing method of the thermal energy storage pack.

Solution to Problem

In order to achieve the above object, the present invention adopts the following means. That is to say, the thermal energy storage pack according to the present invention is a thermal energy storage pack that performs temperature management of food and/or beverage, and includes a first accommodation portion filled with a first thermal energy storage material that exhibits phase change at a predetermined temperature, a second accommodation portion that is overlaid by the first accommodation portion and that is filled with a second thermal energy storage material that maintains a liquid phase state at the phase change temperature of the first thermal energy storage material, and a cover material that closes off the first accommodation portion. The second accommodation portion comes into contact with the food and/or beverage.

Advantageous Effects of Invention

According to the present invention, the second thermal energy storage material maintains a liquid phase state at the phase change temperature of the first thermal energy storage material, and the second accommodation portion comes into contact with the food and/or beverage and serves as a heat sink, so the second accommodation portion can come into close contact with the food and/or beverage. Accordingly, the second thermal energy storage material can transmit stored sensible heat to the food and/or beverage in a sure manner, so the food and/or beverage can be made to quickly attain a desired temperature. Further, sensible heat and latent heat that the first thermal energy storage material has stored can be transmitted to the food and/or beverage via the second thermal energy storage material, thereby assisting in making the food and/or beverage quickly reach the desired temperature, and further transmitting latent heat stored by the first thermal energy storage material to the food and/or beverage in a sure manner, thereby enabling maintaining the food and/or beverage at the desired temperature for a long time.

BRIEF DESCRIPTION OF DRAWINGS

FIG. 14 is a table illustrating the configuration of thermal energy storage materials according to first through third comparative examples and first through third examples.

FIG. 23 is a table summarizing experiment results.

FIG. 41 is a diagram illustrating the configuration of antifreezes and latent heat materials according to fourth through sixth comparative examples and fourth through seventh examples, in comparative experiments according to the second embodiment.

FIG. 49 is a table summarizing experiment results.

DESCRIPTION OF EMBODIMENTS

The present inventors took note of the point that close contact between a refrigerant and an object to be cooled is insufficient in a state where the refrigerant is completely frozen, so the object to be cooled cannot be quickly cooled, and the point that the amount of thermal energy stored by the refrigerant is insufficient in a case where the refrigerant is unfrozen or semi-frozen, so the object to be cooled cannot be made to attain a desired temperature. The present inventors reached the present invention by finding that the object to be cooled cannot be made to quickly attain a desired temperature, by making a double structure of the refrigerant, filling a first layer with a thermal energy storage material that has sufficient heat quantity, and filling a second layer with a thermal energy storage material that has flexibility, thereby increasing close contact with the object to be cooled.

That is to say, the thermal energy storage pack according to the present invention is a thermal energy storage pack that performs temperature management of food and/or beverage, and includes a first accommodation portion filled with a first thermal energy storage material that exhibits phase change at a predetermined temperature, a second accommodation portion that is overlaid by the first accommodation portion and that is filled with a second thermal energy storage material that maintains a liquid phase state at the phase change temperature of the first thermal energy storage material, and a cover material that closes off the first accommodation portion. The second accommodation portion comes into contact with the food and/or beverage.

Accordingly, the present inventors have enabled the second accommodation portion to come into close contact with the food and/or beverage. Embodiments of the present invention will be described below in detail with reference to the drawings.

First Embodiment

[Configuration of Thermal Energy Storage Pack]

Figure 1:
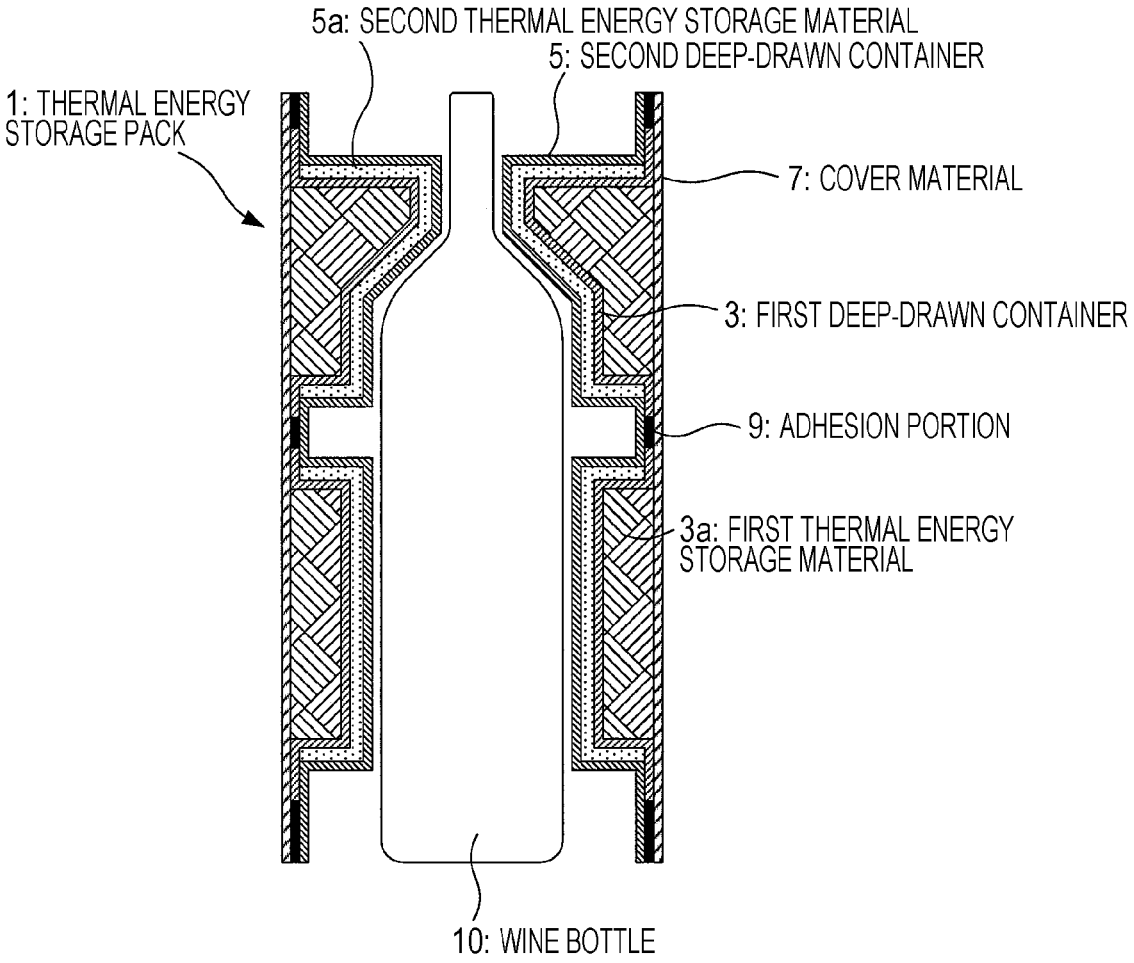
FIG. 1 is a cross-sectional view illustrating a state of a thermal energy storage pack according to an embodiment of the present invention in use.

FIG. 1 is a cross-sectional view illustrating a state of a thermal energy storage pack according to an embodiment of the present invention in use. This thermal energy storage pack 1 has a double structure, made up of a first deep-drawn container 3 serving as a first accommodation portion, and a second deep-drawn container 5 serving as a second accommodation portion. The first deep-drawn container 3 is filled with a first thermal energy storage material 3*a* and the second deep-drawn container 5 is filled with a second thermal energy storage material 5*a* serving as an antifreeze in FIG. 1. The second thermal energy storage material 5*a* maintains the liquid phase state at the phase change temperature of the first thermal energy storage material 3*a*. The second thermal energy storage material 5*a* comes into close contact with a wine bottle 10 serving as a beverage, and a cover material 7 closes off the first deep-drawn container 3. The first deep-drawn container 3, second deep-drawn container 5, and cover material 7 are welded at an adhesion portion 9.

Thus, the second thermal energy storage material 5*a* maintains a liquid phase state at the phase change temperature of the first thermal energy storage material 3*a*, and the second deep-drawn container 5 comes into contact with the wine bottle 10, so the second deep-drawn container 5 can come into close contact with the wine bottle 10. Accordingly, the sensible heat stored by the second thermal energy storage material 5*a* can be transmitted to the wine bottle 10 in a sure manner, and the wine bottle 10 can be made to quickly attain the desired temperature. Further, the sensible heat stored by the first thermal energy storage material 3*a* and latent heat can be transmitted to the wine bottle 10 in a sure manner via the second thermal energy storage material 5*a*, thereby assisting in quickly bringing the wine bottle 10 to the desired temperature. Further, the latent heat stored by the first thermal energy storage material 3*a* can be transmitted to the wine bottle 10 in a sure manner. Accordingly, the wine bottle 10 can be maintained at the desired temperature for a long time.

Figure 2A:
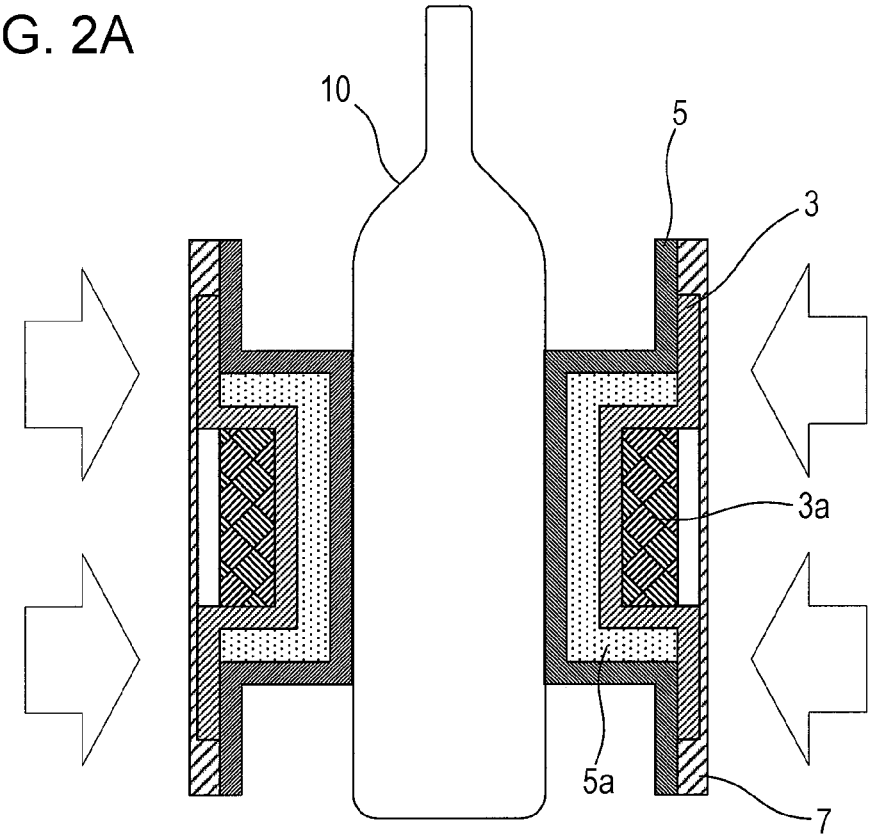
FIG. 2A is a cross-sectional view illustrating a state of a thermal energy storage pack according to the present embodiment in use.
Figure 2B:
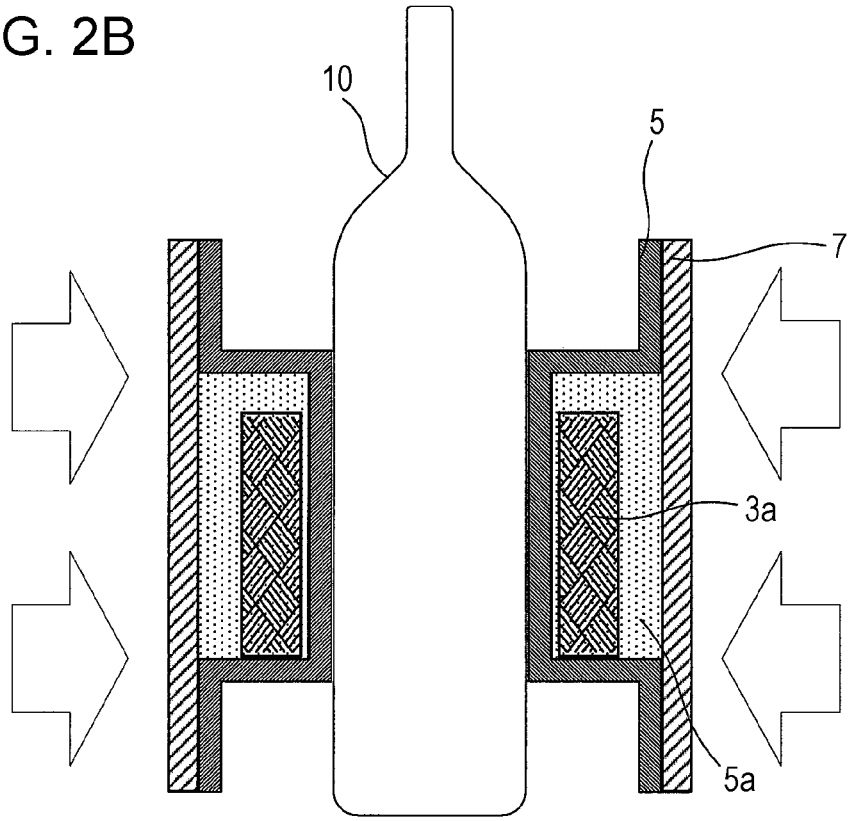
FIG. 2B is a cross-sectional view illustrating a state of a conventional thermal energy storage pack in use.

FIG. 2A is a cross-sectional view illustrating a state of the thermal energy storage pack according to the present embodiment in use, and FIG. 2B is a cross-sectional view illustrating a state of a conventional thermal energy storage pack in use. In a case where the first thermal energy storage material 3*a* is included in the second thermal energy storage material 5*a*, there are cases where the position of the first thermal energy storage material 3*a* is lower in the vertical direction when in use, due to gravity, as illustrated in FIG. 2B. In this case, there is a marked region on the upper portion of the side of the bottle where the first thermal energy storage material 3*a* is not present, with heat escaping from the region where the first thermal energy storage material 3*a* does not exist, and there is a possibility that the wine bottle may not be able to quickly attain the desired temperature.

In comparison with this, the thermal energy storage pack 1 according to the present embodiment has the first deep-drawn container 3 filled with the first thermal energy storage material 3*a* and the second deep-drawn container 5 filled with the second thermal energy storage material 5*a* fixed by flange portions as illustrated in FIG. 2A, so the positional relation between the thermal energy storage materials can be maintained regardless of the effects of gravity. As a result, the sensible heat stored by the second thermal energy storage material 5*a* can be transmitted to the wine bottle 10 in a sure manner, and the wine bottle 10 can be made to quickly attain the desired temperature. Further, the sensible heat and latent heat stored by the first thermal energy storage material 3*a* can be transmitted to the wine bottle 10 in a sure manner, via the second thermal energy storage material 5*a*, thereby assisting in quickly bringing the wine bottle 10 to the desired temperature. Further, the latent heat stored by the first thermal energy storage material 3*a* can be transmitted to the wine bottle 10 in a sure manner. Accordingly, the wine bottle 10 can be maintained at the desired temperature for a long time.

The first deep-drawn container 3 is formed of a first plastic film. The second deep-drawn container 5 is formed of a second plastic film. The second plastic film is more flexible than the first plastic film.

Thus, the degree of close contact with the wine bottle 10 can be increased by selecting a film having flexibility for the second plastic film. On the other hand, selecting a film having hardness for the first plastic film enables deformation or the like that occurs in the process of the first thermal energy storage material 3*a* storing latent heat, i.e., in the process of changing from liquid state to solid state, to be prevented, and enables the shape to be maintained even in a liquid state.

Specifically, the first plastic film preferably has a Young's modulus of 3,000 MPa or higher, while the second plastic film preferably has a Young's modulus of 3,000 MPa or lower at least, and more preferably 600 MPa or lower. The Young's modulus is often used as an index indicating the hardness of plastic film, and particularly the stiffness. Examples of plastic films that are not stiff and have flexibility, with a Young's modulus of 3,000 MPa or lower, include polyethylene, polypropylene, nylon, and so forth, but the present invention is not restricted to these. On the other hand, examples of plastic films that are stiff and hard, with a Young's modulus of 3,000 MPa or higher, include polyethylene terephthalate and so forth, but the present invention is not restricted to these.

The present inventors measured the tensile strength (based on JIS K 7161) of film configured of PET 150 um/PE 15 um as plastic film preferable for the first deep-drawn container and film configured of NY 100 um/PE 15 um as plastic film preferable for the second deep-drawn container, and the Young's modulus was measured. First, the film "PET #50 um//PE #15 um" selected for the first deep-drawn container was cut to width: 15 mm and length: 100 mm. The tensile stress of this film was measured using a "digital force gauge 'ZTA-1000N' manufactured by Imada Co., Ltd.", and found that the film exhibited 1 mm elastic deformation under approximately 70 N. From these results, the Young's modulus is ({load value×length of film}/{cross-sectional area of film×amount of stretching of film})=approximately 3,000 $N/mm^2$.

On the other hand, the film "NY #50 um//PE #15 um" selected for the second deep-drawn container was cut to width: 15 mm and length: 100 mm. The tensile stress of this film was measured using a "digital force gauge 'ZTA-1000N' manufactured by Imada Co., Ltd.", and found that the film exhibited 1 mm elastic deformation under approximately 20 N. From these results, the Young's modulus is ({load value×length of film}/{cross-sectional area of film× amount of stretching of film})=approximately 600 $N/mm^2$.

Figure 3A:
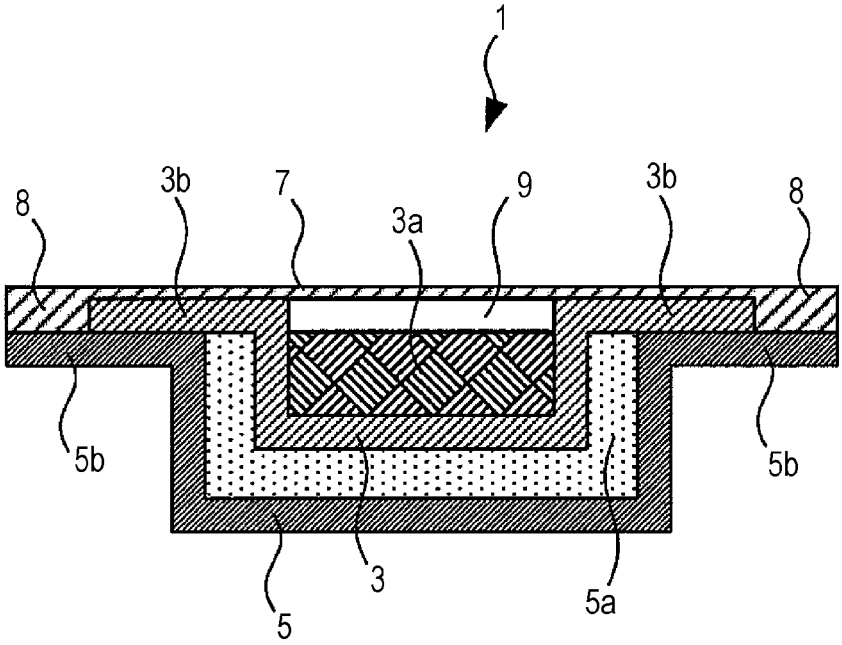
FIG. 3A is a cross-sectional view of a thermal energy storage pack according to the present embodiment in use.

FIG. 3A is a cross-sectional view of the thermal energy storage pack according to the present embodiment. In the thermal energy storage pack 1, with regard to the first deep-drawn container 3 and second deep-drawn container 5, a flange portion 3*b* of the first deep-drawn container 3 and a flange portion 5*b* of the second deep-drawn container 5 are joined, as illustrated in FIG. 3A. Along with this, the flange portion 3*b* of the first deep-drawn container 3 and the cover material 7 are joined. Further, a gap layer 9 is present between the cover material 7 and the first thermal energy storage material 3*a*.

Joining the flange portion 3*b* of the first deep-drawn container 3 and the flange portion 5*b* of the second deep-drawn container 5 in this way fixes the positional relationship between the first deep-drawn container 3 and second deep-drawn container 5, further improving performance, and also improving repeatability performance. The second deep-drawn container 5 here may have a bottom that has a shape with differing depths. For example, in a case of a heat sink having a curved shape in the vertical direction as with a wine bottle, a shape where the depth in the height direction of the second deep-drawn container 5 progressively becomes deeper enables improvement in the degree of close contact with the food and/or beverage serving as a heat sink. Examples of joining means include ultrasonic welding, vibration welding, induction welding, high-frequency welding, semiconductor laser welding, thermal welding, spin welding, and so forth, but the present invention is not restricted to these.

[Joining Plastic Films]

It can be seen in FIG. 3A that in the thermal energy storage pack 1 according to the present embodiment, through holes 8 are provided at optional parts of the flange portion 3*b* of the first deep-drawn container 3, with the flange portion 5*b* of the second deep-drawn container 5 directly joining to the cover material 7 at the through holes 8. The following joining method is used to join each of the parts of such a thermal energy storage pack 1.

Figure 3B:
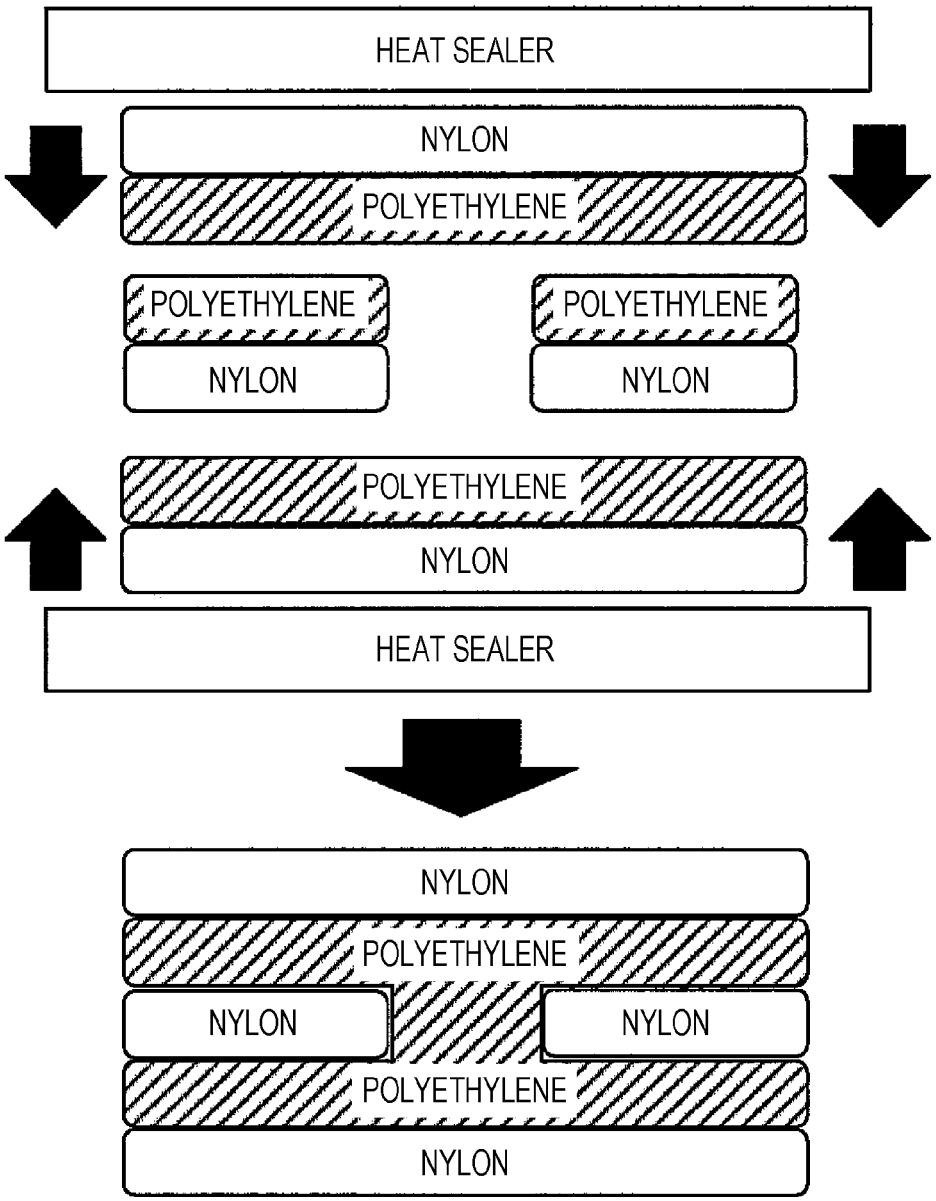
FIG. 3B is a diagram illustrating a concept of a film bonding method according to the present embodiment.
Figure 3C:
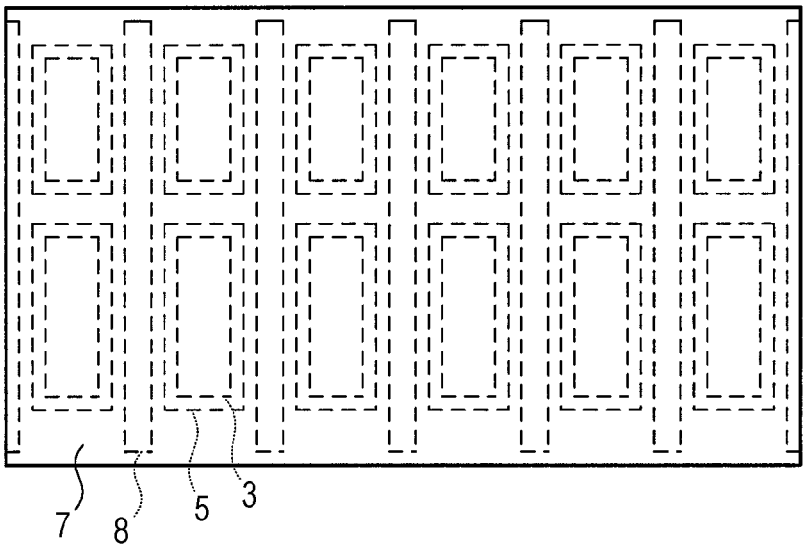
FIG. 3C is a plan view illustrating the state of bonding of films.
Figure 3D:
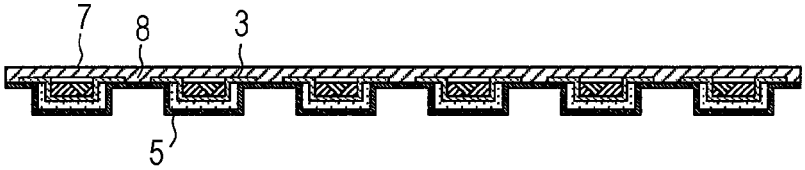
FIG. 3D is a cross-sectional view illustrating the state of bonding of films.
Figures 3E, 3F:
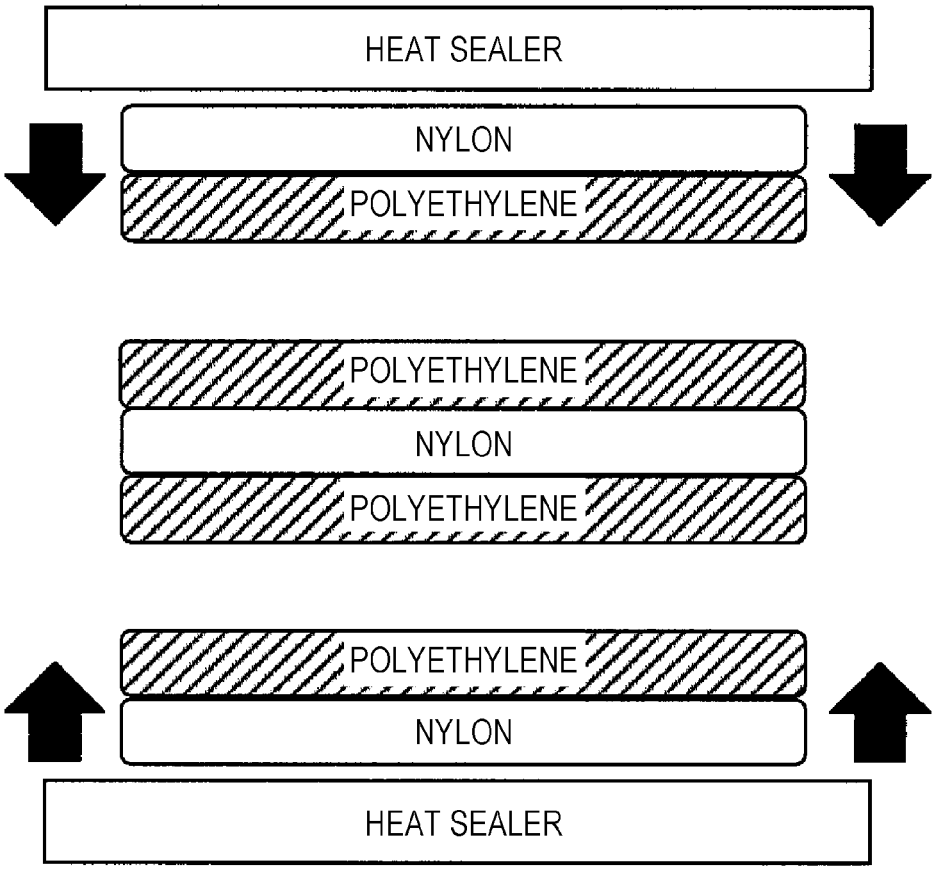
FIG. 3E is a diagram illustrating a concept of a conventional film bonding method.
FIG. 3F is a table comparing the strength of heat seals between the bonding method according to the present embodiment and a conventional bonding method, measured based on "JIS Z 0238".

FIG. 3B is a diagram illustrating a concept of a film bonding method according to the present embodiment, and FIG. 3C is a plan view illustrating the state of bonding of films. FIG. 3D is a cross-sectional view illustrating the state of bonding of films. FIG. 3E is a diagram illustrating a concept of a conventional film bonding method. FIG. 3F is a table comparing the strength of heat seals between the bonding method according to the present embodiment and a conventional bonding method, measured based on "JIS Z 0238".

In the joining method according to the present embodiment, nylon, polyethylene, nylon, polyethylene, polyethylene, and nylon, are layered from the lower side as illustrated in FIG. 3B, and then welded by a heat sealer. The polyethylene layers are fused with each other at this time, due to the presence of the through holes 8. This increases the weld strength. Vacuum forming and welding of deep-drawn containers is performed such that multiple thermal energy storage packs are continuously formed in the present embodiment, as illustrated in FIG. 3C and FIG. 3D (manufacturing method will be described later). On the other hand, the conventional fusing method employs a so-called three-layer structure, as illustrated in FIG. 3E. It is known that this sort of three-layer structure is costly and the weld strength is low. It can be seen from FIG. 3F that the joining method according to the present embodiment has an average value for sear strength that is close to five times that of the conventional art.

Thus, due to the configuration where the flange portion 5*b* of the second deep-drawn container 5 and the cover material 7 are directly joined, the package strength can be improved, and external leakage of thermal energy storage material with which the inside is filled can be prevented. Further, a configuration may be made where the length of the flange portion 3*b* of the first deep-drawn container 3 is shorter than the length of the flange portion 5*b* of the second deep-drawn container 5 and the cover material 7. Accordingly, the flange portion 5*b* of the second deep-drawn container 5 and the cover material 7 can be directly joined.

[Thermal Energy Storage Material]

Figure 4A:
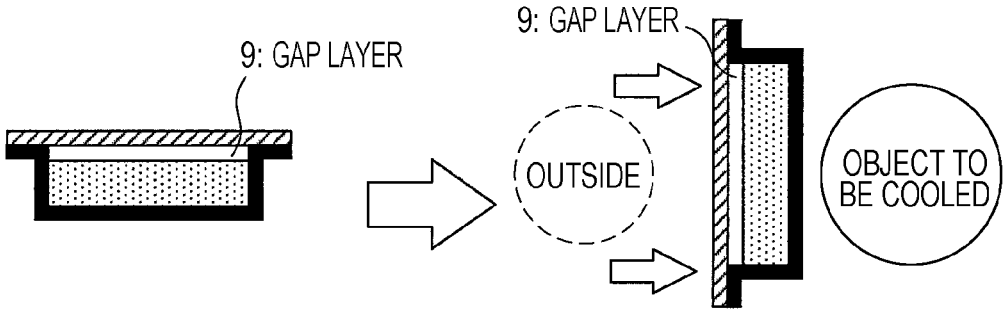
FIG. 4A is a diagram illustrating a concept of a first thermal energy storage material, used in the thermal energy storage pack according to the present embodiment.
Figure 4B:
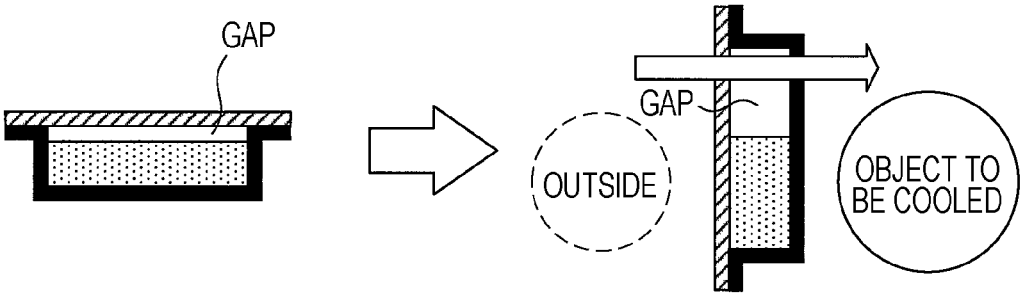
FIG. 4B is a diagram conceptually illustrating a case where there is no viscosity in the thermal energy storage material.

FIG. 4A is a diagram illustrating a concept of a first thermal energy storage material, used in the thermal energy storage pack according to the present embodiment, and FIG. 4B is a diagram conceptually illustrating a case where there is no viscosity in the thermal energy storage material. The first thermal energy storage material 3*a* and second thermal energy storage material 5*a* in the thermal energy storage pack according to the present embodiment have sufficient viscosity to maintain a shape under own weight.

Thus, the shapes can be maintained without being affected by gravity, by imparting viscosity to the first thermal energy storage material 3*a* and second thermal energy storage material 5*a*. In a case of managing temperature of the object to be cooled in a state where the thermal energy storage pack is erected, as illustrated in FIG. 4B for example, the thermal energy storage material will be affected by gravity and be displaced downwards in the vertical direction as the thermal energy storage material changes from the solid phase to the liquid phase if the thermal energy storage material has no viscosity. As a result, temperature management of the upper portion of the object to be cooled cannot be sufficiently performed. Also, as a result of the thermal energy storage material deforming downwards in the vertical direction, a gap occurs in the vertical information of the thermal energy storage material, inflow and outflow of heat occurs at the gap, and cooling effects are reduced.

In order to avoid this, the first thermal energy storage material and the second thermal energy storage material are imparted with viscosity in the present embodiment. Examples of viscous agents used include thickening polysaccharides, gelling agents, and so forth. Specific examples include locust bean gum, guar gum, guar gum dielectrics (cationic guar gum, hydroxypropyl guar gum, guar gum hydrolyzates), carrageenan, pectin, xanthane gum, gellan gum, diutan gum, starch, dextrin, cellulose dielectrics (CMC, HEC, HPMC), emulsifiers, and so forth. However, the present invention is not restricted to these for viscous agents. Accordingly, temperature management can be sufficiently performed of the object to be cooled, even in a case of performing temperature management of the object to be cooled with the thermal energy storage pack erected as illustrated in FIG. 4A.

The viscosity of the first thermal energy storage material 3*a* and second thermal energy storage material 5*a* is 1000 cP or higher in the thermal energy storage pack according to the present embodiment.

Thus, the shape can be maintained without being affected by gravity by imparting viscosity of 1000 cP or higher to the first thermal energy storage material 3*a* and second thermal energy storage material 5*a*. For example, in a case where a beverage such as wine or the like is to be brought to a desired temperature, the attaining time is said to be around 10 to 30 minutes. The amount of thermal energy storage material to be mounted on such as beverage is around half the weight of the beverage at the most, realistically. Accordingly, the present inventors evaluated the relationship between shape maintaining properties of the thermal energy storage material and the viscosity of the thermal energy storage material in a case of mounting (wrapping) 500 g of thermal energy storage material onto a 750-mL wine-filled bottle (total weight: approximately 1 kg). Specifically, the relation between force F in a case of applying force F in the thickness direction of the thermal energy storage material, and velocity V of passing through the thermal energy storage material, can be expressed as $F=((\rho \times S)/L \times V$, for a thermal energy storage material where area is S, thickness is L, and viscosity is ρ. This expression was used to find the relation between viscosity ρ and velocity V, and further a viscosity ρ where the time until the thermal energy storage material completely collapses in the vertical direction is 10 minutes or longer is calculated from the velocity V, which was confirmed to be around 1000 cP. That is to say, the heat sink can be brought to the desired temperate quickly and without unevenness, by imparting the thermal energy storage material with viscosity of 1000 cP or higher. Further, in a case where the thermal energy storage material has no viscosity and is a complete liquid, the liquid may splash and spill out of the container when filling the deep-drawn containers in the manufacturing step. Also, in a case of filling with the thermal energy storage material while advancing the entire container, there is the concern of the filled liquid overflowing due to vibrations while advancing, resulting in limitations in the amount filled. These troubles can be solved by imparting the thermal energy storage material with viscosity.

In the thermal energy storage pack according to the present embodiment, the first thermal energy storage material 3*a* is made up of water, a hydrocarbon compound that forms a clathrate hydrate with part of the water at temperatures of 0° C. or higher, and an inorganic compound that hardens the phase change temperature of another part of water to 0° C. or lower.

According to this configuration, the amount of thermal energy that can be stored can be increased. As a result, the food and/or beverage that is the heat sink can be quickly brought to the desired temperature, and can be kept at the desired temperature for a long time. Furthermore, the material used preferably is safe and dependable, since temperature management of food and/or beverage is to be performed. An incombustible and highly safe configuration can be constructed by configuring the thermal energy storage material using a hydrocarbon compound that forms a clathrate hydrate with water, and an inorganic compound.

Now, thermal energy storage is a technology of temporarily storing heat, and extracting that heat as necessary. Although thermal energy storage methods include sensible heat thermal energy storage, latent heat thermal energy storage, chemical thermal energy storage, and so forth, latent thermal energy storage alone is used in the present embodiment. In latent heat thermal energy storage, heat energy of the phase change of a substance is stored using latent heat of the substance. Latent heat thermal energy storage has high thermal energy storage density, and output temperature is constant. Latent heat thermal energy storage materials such as ice (water), paraffin (a collective term referring to saturated hydrocarbons having the general formula $C_nH_{2n+2}$), aqueous solutions of mineral salt, hydrates of mineral salt, clathrate hydrates, and so forth, are used for the thermal energy storage material that employs latent heat thermal energy storage. Aqueous solutions of mineral salt used in the thermal energy storage material include an aqueous solution where potassium chloride (KCl) and ammonium chloride ($NH_4Cl$) are dissolved in water, an aqueous solution where sodium chloride (NaCl) and ammonium chloride ($NH_4Cl$) are dissolved in water, and so forth, but the thermal energy storage material according to the present invention is not restricted to theses aqueous solutions. Examples of hydrates of mineral salt used in the thermal energy storage material include sodium sulfate decahydrate ($Na_2SO_4.10H_2O$), sodium acetate trihydrate, sodium thiosulfate pentahydrate, binary composition of di-Sodium hydrogen phosphate dodecahydrate and di-Sodium hydrogen phosphate hexahydrate (melting temperature of 5° C.), binary composition of lithium, nitrate trihydrate and magnesium chloride hexahydrate of which lithium nitrate trihydrate is the primary component (melting temperature of 8 to 12° C.), ternary composition of lithium nitrate trihydrate, magnesium chloride hexahydrate, and magnesium bromide hexahydrate (melting temperature of 5.8 to 9.7° C.), and so forth, but the thermal energy storage material according to the present invention is not restricted to these hydrates of mineral salt.

The second thermal energy storage material 5*a* can be configured of an aqueous solution of sodium chloride and CMC (carboxymethylcellulose), for example.

[Gap Layer]

The thermal energy storage pack according to the present embodiment has a gap layer 9 between the first thermal energy storage material 3*a* with which the first deep-drawn container 3 is filled, and the cover material 7, as illustrated in FIGS. 3A and 4A.

Thus, the gap layer 9 can serve as an insulating material by forming the gap layer 9 between the first thermal energy storage material 3*a* with which the first deep-drawn container 3 is filled, and the cover material 7, thereby extending the keeping time of the first thermal energy storage material 3*a*. In a case of filling a deep-drawn container with a liquid (the thermal energy storage material in this case), it is said that the filling percentage of liquid as to the volume of the deep-drawn container is around 70 to 80% at the most, due to the manufacturing process. For example, a thermal energy storage pack where a deep-drawn container has been filled to around 70 to 80% is placed flat with the container bottom face facing downwards, and phase change (i.e., change from liquid phase to solid phase) is caused. When this thermal energy storage pack is brought into contact with food and/or beverage that is a heat sink, the heat is transmitted in the order of the heat sink, bottom face of the deep-drawn container, thermal energy storage material, gap layer, cover material, and external air. Thus, the gap layer exhibits insulating effects of the thermal energy storage material from the external air, and the keeping time of the thermal energy storage material can consequently be extended. Further, the thermal energy storage material has viscosity capable of maintaining shape, and accordingly can maintain the positional relation described above even after phase change (i.e., from solid phase to liquid phase), so the keeping time can be made even longer.

[Insulating Material]

In the thermal energy storage pack according to the present embodiment, the first deep-drawn container 3 may have an insulating material at the side opposite to the second deep-drawn container 5.

Thus, the first deep-drawn container 3 can have further higher cool-maintaining performance and warm-maintaining performance by having the insulating material at the side opposite to the second deep-drawn container 5. Natural materials, plastic materials, mineral materials such as glass fiber and so forth, are used for the insulating material. Examples of natural materials include cellulose fiber, lightweight softwood fiberboard, and so forth. Plastic materials include polystyrene foam, rigid polyurethane foam, highly-foamed polyethylene, phenol foam, and so forth. Mineral materials include glass wool, rock wool, foamed glass, and so forth, but the present invention is not restricted to these.

[Heat Exchange Unit]

Figure 5A:
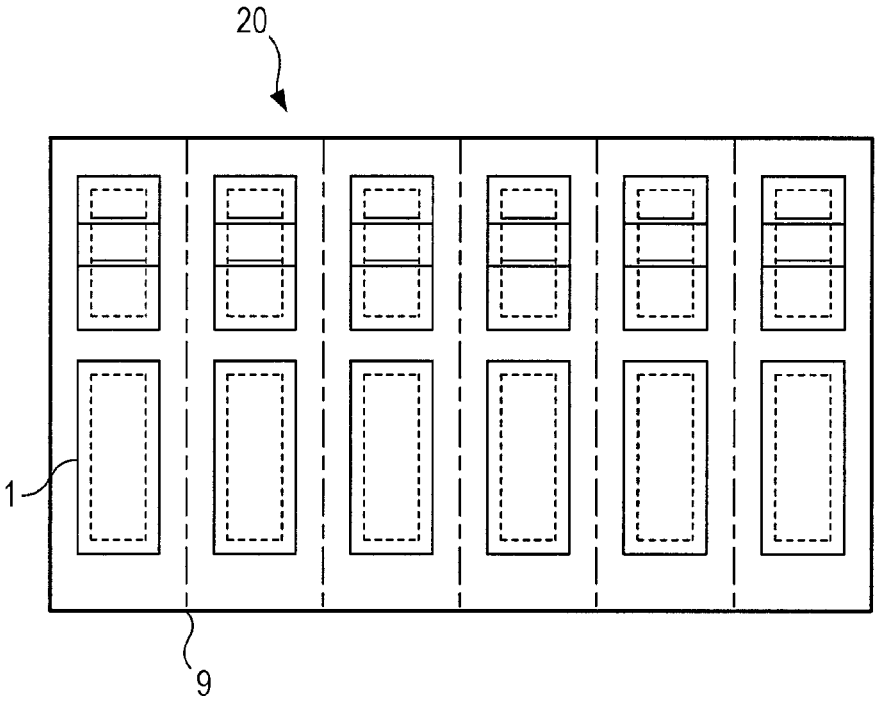
FIG. 5A is a plan view of a thermal exchange unit.
Figure 5B:
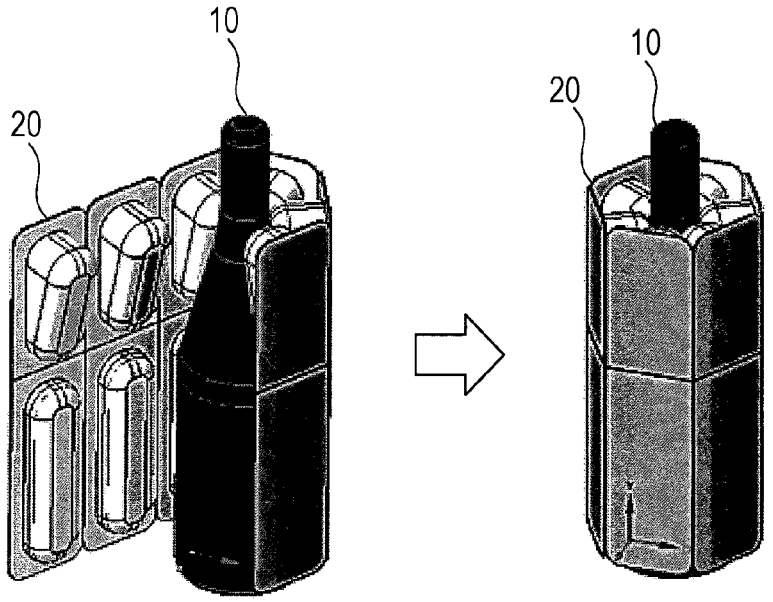
FIG. 5B is a conceptual diagram illustrating a usage example of the thermal exchange unit.

A heat exchange unit can be configured by continuously providing the above-described thermal energy storage packs. FIG. 5A is a plan view of a heat exchange unit, and FIG. 5B is a conceptual diagram illustrating a usage example of the thermal exchange unit. That is to say, a heat exchange unit 20 according to the present embodiment has multiple of any one of the above-described thermal energy storage pack 1 connected, and has a joint mechanism 9 between adjacent thermal energy storage packs.

Thus, multiple thermal energy storage packs 1 are connected via the joint mechanisms 9, so the shape of the food and/or beverage serving as the heat sink can be followed, and consequently the degree of close contact can be improved. For example, in a case where the heat sink is a beverage bottle such as wine or the like, the thermal energy storage pack can be brought into close contact with the curved face by having a thermal exchange unit in which multiple thermal energy storage packs are connected in the circumferential direction of the beverage bottle. There are cases where wine bottles, beer bottles, and the like, have a curved shape with a cross-sectional area that gradually becomes smaller in the height direction. In such cases, the thermal energy storage packs can be made to come into close contact following the curved shape, by connecting multiple thermal energy storage packs in the height direction of the wine bottle or beer bottle. Further, filling with different types of thermal energy storage material in the height direction enables rapid cooling performance and cool-maintaining performance to be improved.

[Manufacturing Method of Thermal Energy Storage Pack]

The manufacturing method of the thermal energy storage pack according to the present embodiment is a manufacturing method of a thermal energy storage pack that performs temperature management of food and/or beverage, the method including at least: a step of molding a first deep-drawn container (first accommodation portion) having a recessed shape, using a first mold; a step of molding a second deep-drawn container (second accommodation portion) having a recessed shape that is at least larger than the recessed shape of the first deep-drawn container, using a second mold; a step of filling the first deep-drawn container with a first thermal energy storage material that exhibits phase change at a predetermined temperature; a step of filling the second deep-drawn container with a second thermal energy storage material that maintains a liquid phase state at the phase change temperature of the first thermal energy storage material; and a step of overlaying the first deep-drawn container filled with the first thermal energy storage material upon the second deep-drawn container filled with the second thermal energy storage material, and joining a cover material, a flange portion of the first deep-drawn container, and a flange portion of the second deep-drawn container.

A manufacturing method may be made that includes at least: a step of molding a first deep-drawn container (first accommodation portion) having a recessed shape, using a first mold; a step of molding a second deep-drawn container (second accommodation portion) having a recessed shape that is at least larger than the recessed shape of the deep-drawn container, using a second mold; a step of filling the second deep-drawn container with a second thermal energy storage material that maintains a liquid phase state at a phase change temperature of a first thermal energy storage material; a step of overlaying the first deep-drawn container upon the second deep-drawn container filled with the second thermal energy storage material; a step of filling the first deep-drawn container with the first thermal energy storage material that exhibits phase change at a predetermined temperature; and a step of joining a cover material, a flange portion of the first deep-drawn container, and a flange portion of the second deep-drawn container.

The film material making up the cover material, first deep-drawn container, and second deep-drawn container is a configuration of one or multiple PVC (flexible), PVC (rigid), PE, CPP (cast), OPP (oriented), PET, NY, and so forth, being used.

An NY//PE or NY//PP configuration is common for the cover material. An NY//PE configuration that is more flexible than PP and has excellent weldability is preferable, since the object with which filling is performed is a liquid in the present embodiment, and leakage is a concern. Note that a film formed of a CPP configuration may be selected in a case where gas barrier properties are required.

Figure 6A:
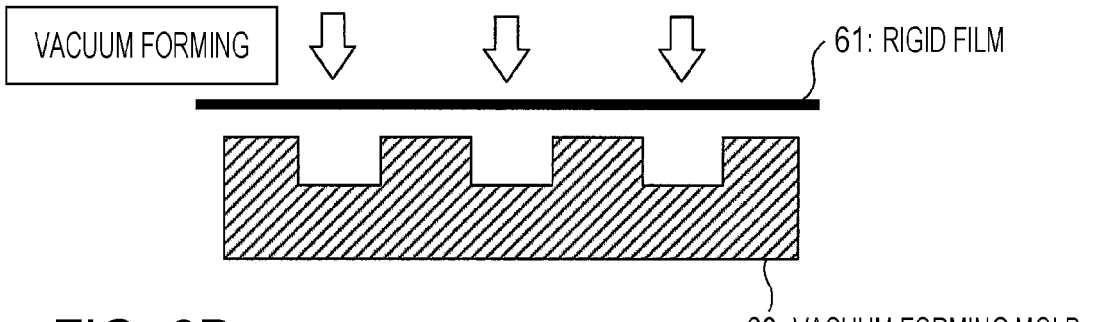
FIG. 6A is a diagram illustrating a way of manufacturing a first deep-drawn container 3.
Figure 6B:
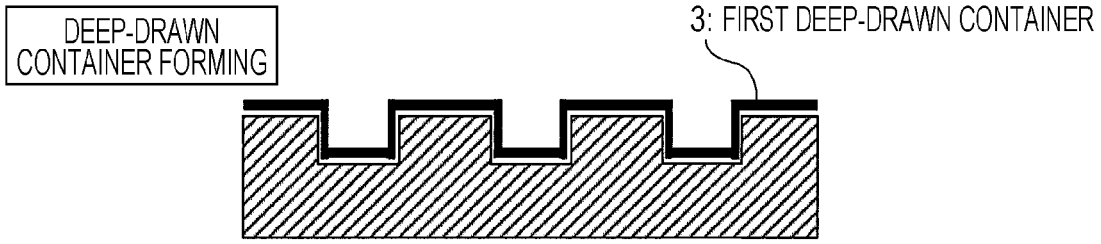
FIG. 6B is a diagram illustrating a way of manufacturing a first deep-drawn container 3.

FIG. 6A and FIG. 6B are diagrams illustrating a way of manufacturing the first deep-drawn container 3. A rigid film 61 is placed on a vacuum forming mold 60 serving as a first mold, and vacuum forming is performed using a vacuum forming machine. The rigid film material used to form the first deep-drawn container 3 preferably is a film made up of a PP configuration, from the perspective of formability. The ability to keep its shape is important for the first deep-drawn container 3 in the present embodiment, so a film made up of a PVC (rigid) or PP configuration is preferable.

Now the first deep-drawn, container exists between the cover material and second deep-drawn container, and accordingly is commonly configured of a three-layer film such as PE//NY//PP, for example. However, the strength of a heat seal of a three-layer film is weal, as described above, so a two-film configuration is intentionally used with the present embodiment, and a configuration is used where through holes are formed at optional parts of the film.

This step forms the first deep-drawn container 3 (first accommodation portion) having recesses, as illustrated in FIG. 6B.

Figure 7A:
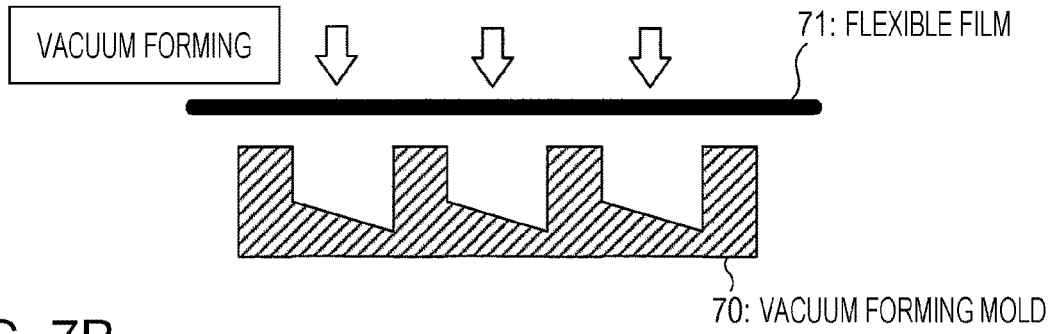
FIG. 7A is a diagram illustrating a way of manufacturing a second deep-drawn container 5.
Figure 7B:
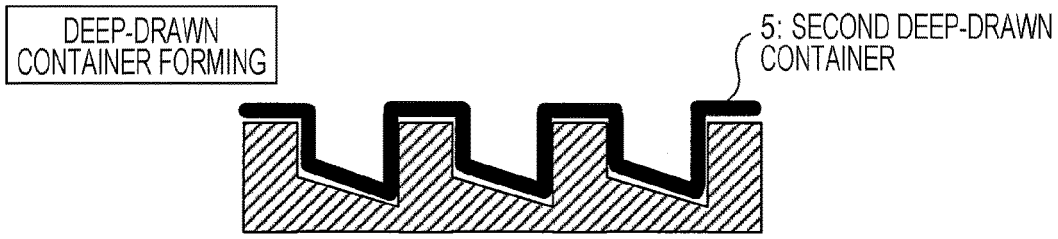
FIG. 7B is a diagram illustrating a way of manufacturing a second deep-drawn container 5.

FIG. 7A and FIG. 7B are diagrams illustrating a way of manufacturing the second deep-drawn container 5. A flexible film 71 is placed on a vacuum forming mold 70 serving as a second mold as illustrated in FIG. 7A, and vacuum forming is performed using a vacuum forming machine. The second deep-drawn container 5 preferably is a film made up of a PVC (flexible) or PE configuration, since the degree of close contact to the object to be cooled is important in the present embodiment. Further, in a case where the object to which welding is to be performed is a film made up of a PE configuration, a film made up of a PE configuration in the same way is preferably selected.

Figure 8:
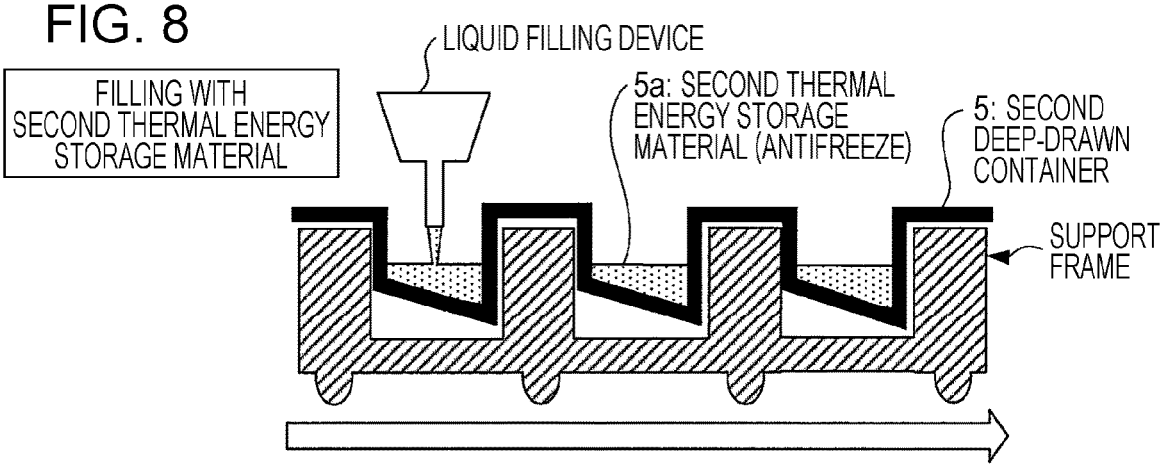
FIG. 8 is a conceptual diagram illustrating a step of filling with a second thermal energy storage material.

FIG. 8 is a conceptual diagram illustrating a step of filling with the second thermal energy storage material. In this step, the second deep-drawn container 5 formed as described above is filled with a predetermined amount of second thermal energy storage material 5*a* serving as an antifreeze, using a liquid filling machine. Note that a pump-type filling machine is preferably used for the liquid filling machine. The second thermal energy storage material preferably has minimal viscosity to where there is no influence of splashing, sloshing out, or the like of material in the filling processing, and also minimal viscosity to maintain a shape under its own weight. For example, having viscosity around 1000 to 10,000 cP is preferable.

Figure 9:
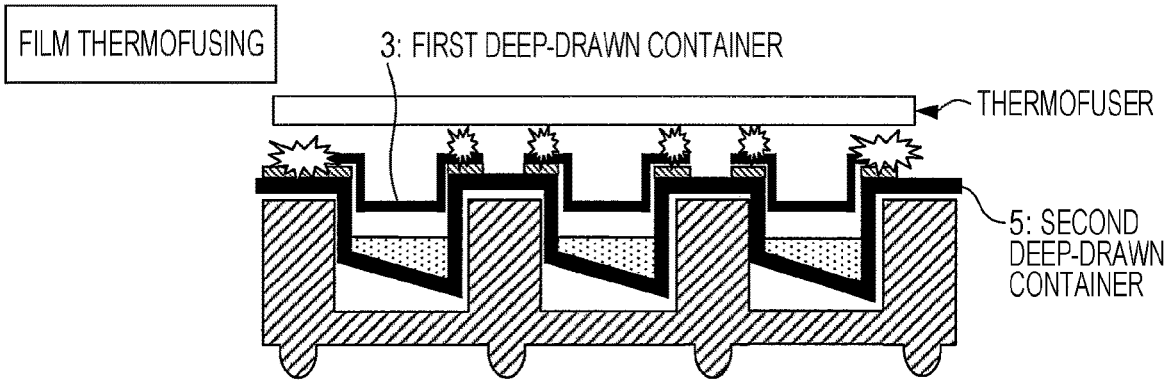
FIG. 9 is a conceptual diagram illustrating a step of thermofusing film.

FIG. 9 is a conceptual diagram illustrating a step of thermofusing film. In this step, the first deep-drawn container 3 formed as described above is positioned above the second deep-drawn container 5 filled with the second thermal energy storage material 5*a* serving as antifreeze, and thermofusing is performed of the film material forming the first deep-drawn container 3 and the film material forming the second deep-drawn container 5. A heat sealer is preferably used for this thermofusing. Alternatively, an ultrasonic welder may be used.

Figure 10:
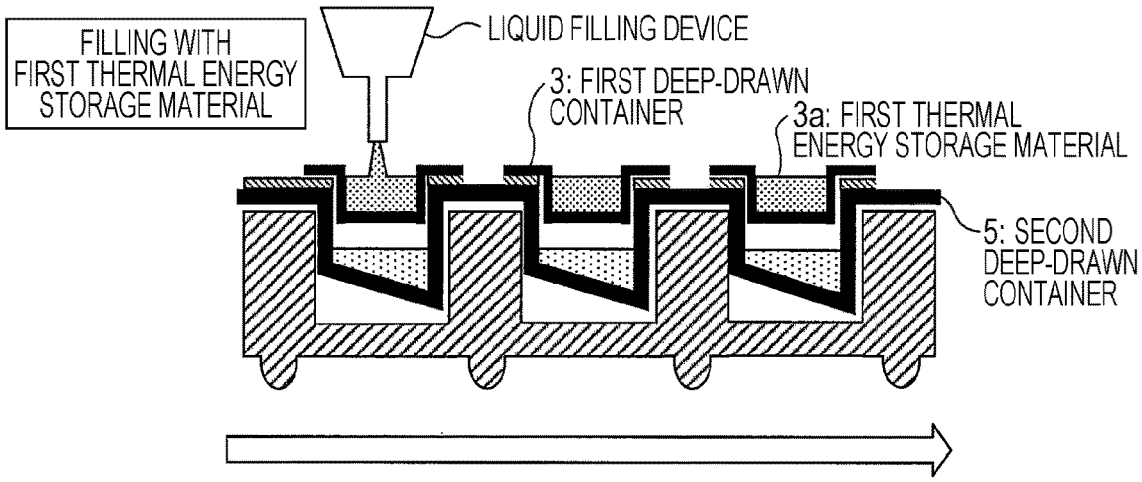
FIG. 10 is a conceptual diagram illustrating a step of filling with a first thermal energy storage material.

FIG. 10 is a conceptual diagram illustrating a step of filling with the first thermal energy storage material. In this step, the first deep-drawn container 3 formed as described above is filled with a predetermined amount of first thermal energy storage material 3*a*, using a liquid filling machine. Note that a pump-type filling machine is preferably used for the liquid filling machine. The first thermal energy storage material 3*a* preferably has sufficient viscosity to maintain a shape under its own weight. For example, having viscosity around 1000 to 10,000 cP is preferable. The filling percentage of the thermal energy storage material as to the volume of the container is 70 to 90%, and a state where a gap layer is formed as to the top face of the container is preferable.

Figure 11:
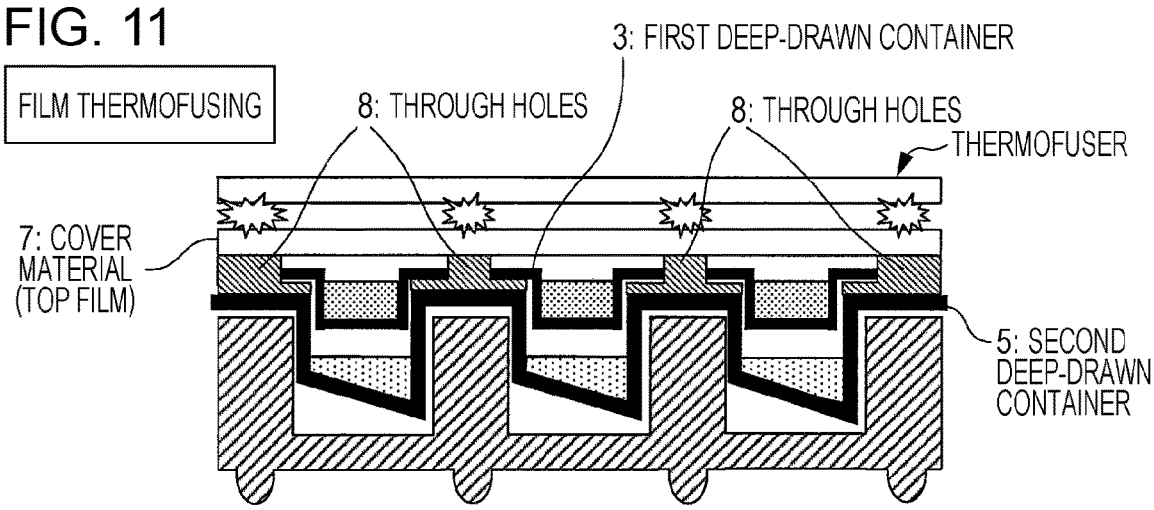
FIG. 11 is a conceptual diagram illustrating a step of thermofusing film.

FIG. 11 is a conceptual diagram illustrating a step of thermofusing film. In this step, the cover material 7 is positioned above the second deep-drawn container 5, and thermal welding is performed of the film material forming the second deep-drawn container 5 and the cover material 7. A heat sealer is preferably used for this thermofusing. Alternatively, an ultrasonic welder may be used. A flexible plastic film is preferably used for the cover material 7.

Now, through holes 8 are preferably provided to parts of the top face of the film making up the second deep-drawn container 5, with the first deep-drawn container 3 and cover material 7 being welded through the through holes 8 at the time of welding in this step.

Joining the first deep-drawn container 3 and the second deep-drawn container 5 in this way fixes the positional relationship between the first deep-drawn container 3 and second deep-drawn container 5, further improving performance, and also improving repeatability performance. The second deep-drawn container 5 here may have a bottom that has a shape with differing depths, as illustrated in FIG. 7A through FIG. 11. For example, in a case of a heat sink having a curved shape in the vertical direction as with a wine bottle, a shape where the depth in the height direction of the second deep-drawn container 5 progressively becomes deeper enables improvement in the degree of close contact with the food and/or beverage serving as a heat sink. Examples of joining means include ultrasonic welding, vibration welding, induction welding, high-frequency welding, semiconductor laser welding, thermal welding, spin welding, and so forth, but the present invention is not restricted to these.

Employing a manufacturing method such as above enables a thermal energy storage pack to be manufactured where the second thermal energy storage material 5*a* maintains a liquid phase state at the phase change temperature of the first thermal energy storage material 3*a*, and the second deep-drawn container 5 comes into contact with the food and/or beverage serving as a heat sink.

[Comparative Experiments]

Figure 12:
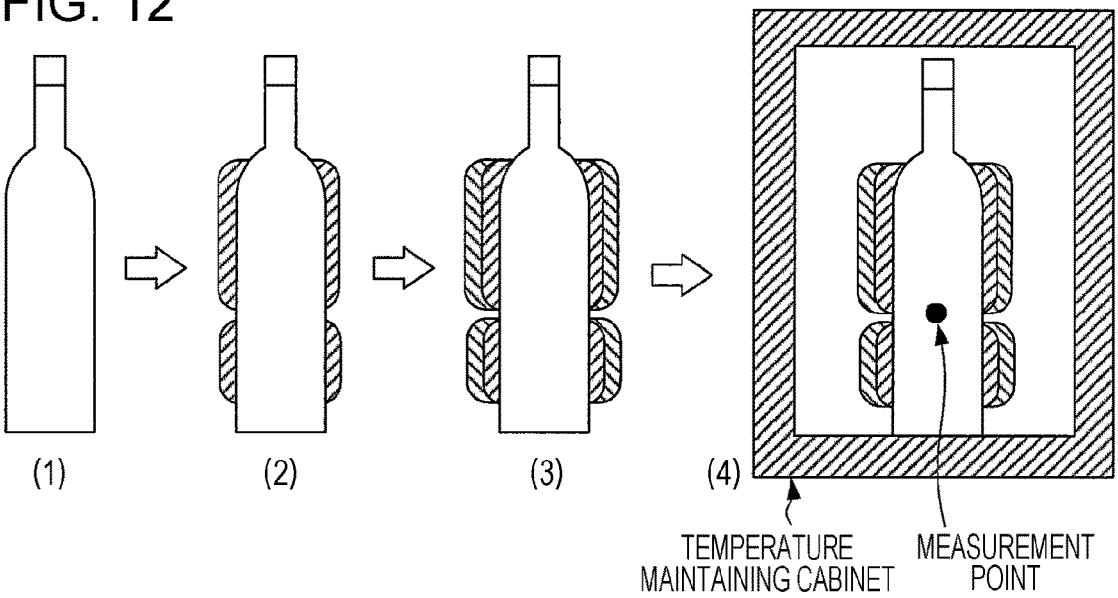
FIG. 12 is a diagram illustrating experiment procedures.

Next, comparative experiments carried out to verify the effects of the thermal energy storage pack according to the present embodiment will be described. FIG. 12 is a diagram illustrating experiment procedures.

(Procedure 1)

A wine bottle, where the liquid temperature is maintained at room temperature (around 25° C.), is prepared.

(Procedure 2)

Cooled thermal energy storage material, or antifreeze, or both, is/are wrapped around the wine bottle.

(Procedure 3)

A foamed insulating material is wrapped around the thermal energy storage material.

(Procedure 4)

The wine bottle is placed in a temperature-maintaining chamber in a 25° C. environment, and change in the liquid temperature of the wine at the middle portion of the bottle is measured.

Figure 13:
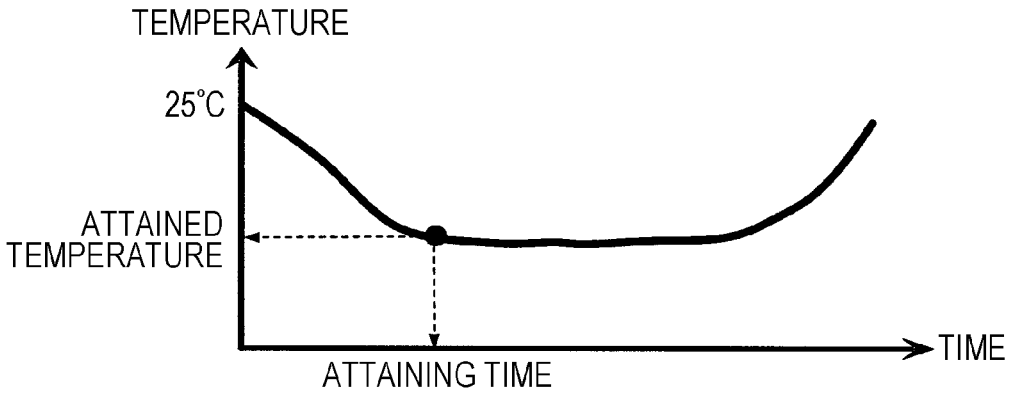
FIG. 13 is a diagram illustrating a method of evaluating experiment results.

FIG. 13 is a diagram illustrating a method of evaluating experiment results, the following technique being used.

(Evaluation Method)

The "attained temperature" and "attaining time" after starting cooling is measured. The rapid-cooling speed is defined as below in order to evaluate the cooling speed. The rapid-cooling performance in each of the following examples is evaluated using this index.

$$\text{Rapid-cooling degree}=(T\ \text{initial}-T\ 10\ \text{min})/10\ \text{min}$$

FIG. 14 is a table illustrating the configuration of thermal energy storage materials according to first through third comparative examples and first through third examples. As shown in this table, thermal energy storage materials were prepared, and evaluated following the above experiment procedures. The forms of the thermal energy storage packs each differ, as illustrated in the first through third comparative examples and first through third examples.

Figure 15:
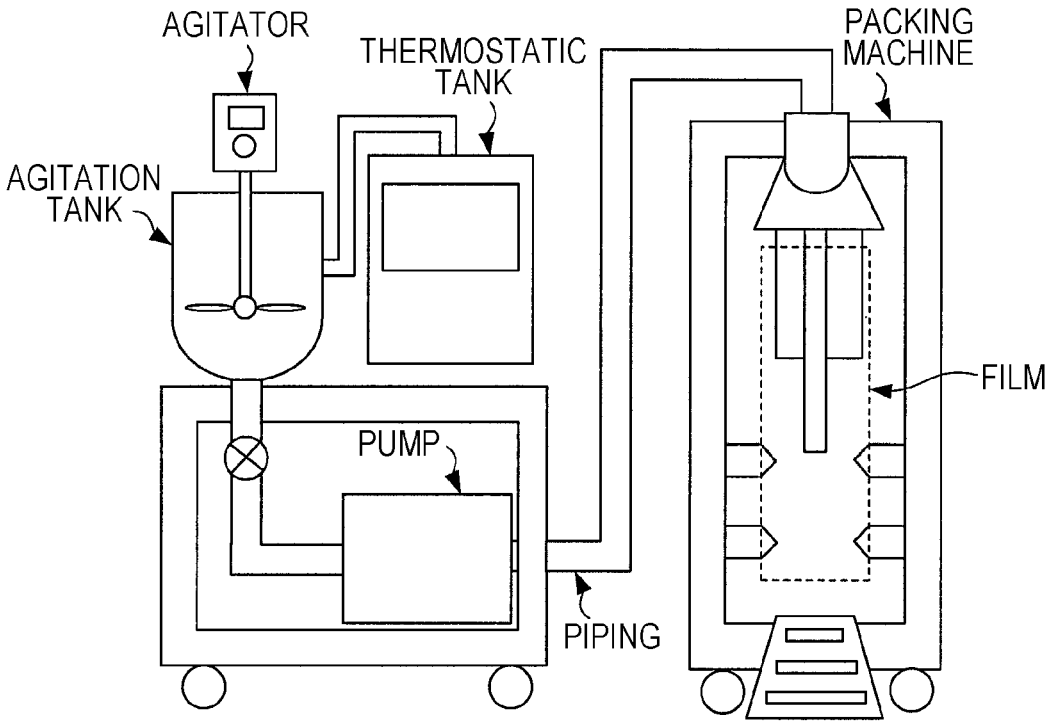
FIG. 15 is a diagram illustrating an overview of filling with thermal energy storage material and packing.

FIG. 15 is a diagram illustrating an overview of filling with thermal energy storage material and packing.

(1) Tap water and NaCl (sodium chloride) are placed in an agitation tank, and agitation is performed at 150 rpm/10 min to dissolve, thereby preparing an aqueous solution of NaCl_23 wt %.

(2) CMC is added to the aqueous solution, and agitation is performed at 300 rpm/15 min to dissolve, thereby preparing an aqueous solution of NaCl to which CMC_5 wt % has been added.

(3) A pump is activated to pack in film the aqueous solution prepared in (2) above by a vertical pillow type packing matching, thereby fabricating a package of 300 g in total.

FIRST COMPARATIVE EXAMPLE

Figure 16:
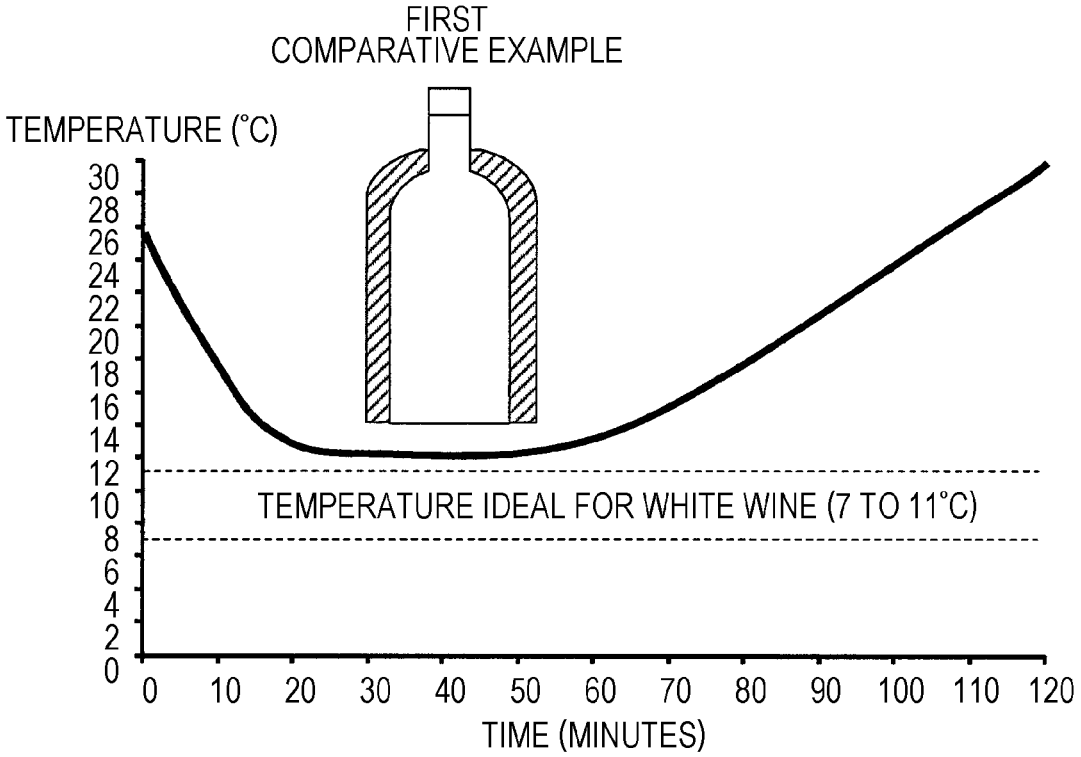
FIG. 16 is a diagram illustrating results of performing temperature measurement of liquid temperature of wine with regard to the first comparative example.

FIG. 16 is a diagram illustrating results of performing temperature measurement of liquid temperature of wine with regard to the first comparative example illustrated in FIG. 14, in accordance with the experiment procedures illustrated in FIG. 12. The degree of close contact with the bottle was good, so the inclination of cooling ($\Delta t/\Delta T$) was good, but the amount of thermal energy was not sufficient, so results obtained were that the attained temperature was insufficient.

SECOND COMPARATIVE EXAMPLE

Figure 17:
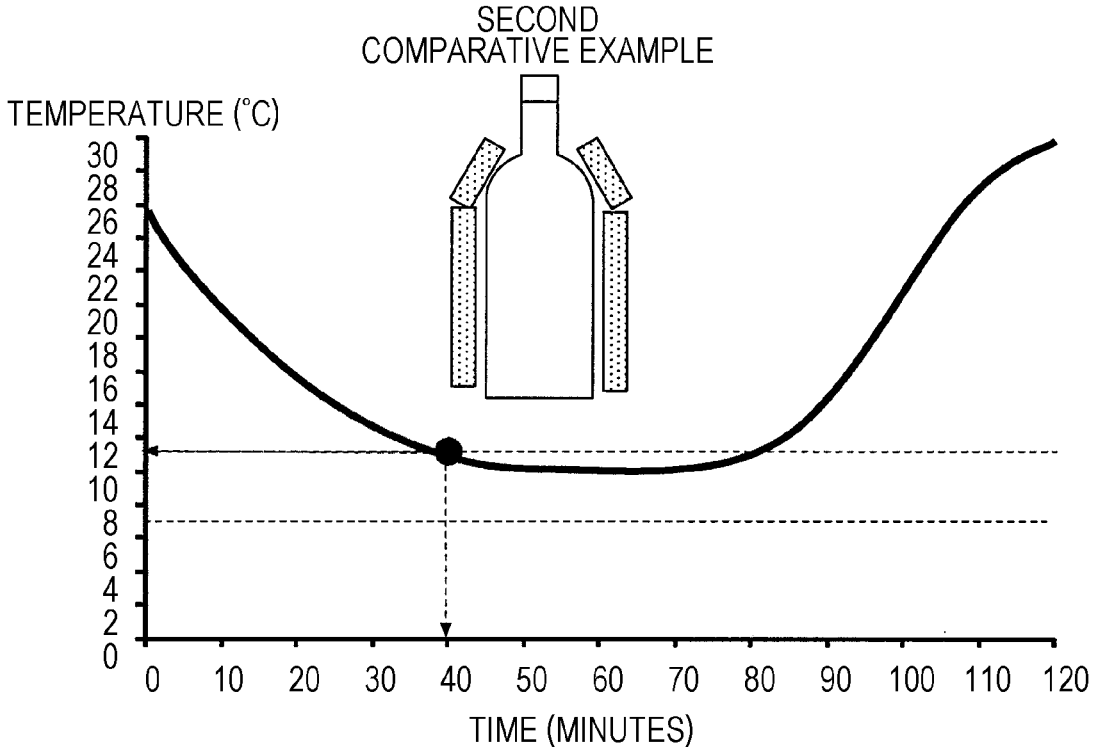
FIG. 17 is a diagram illustrating results of performing temperature measurement of liquid temperature of wine with regard to the second comparative example.

FIG. 17 is a diagram illustrating results of performing temperature measurement of liquid temperature of wine with regard to the second comparative example illustrated in FIG. 14, in accordance with the experiment procedures illustrated in FIG. 12. In the second comparative example, a thermal energy storage material of an aqueous solution of KCl (potassium chloride)_21 wt %+CMC_5 wt % was produced, agitated, and a thermal energy storage pack was fabricated by a packing machine. This has latent neat due to being a freezing agent, and results satisfying the achieved temperature more than the first comparative example were obtained. On the other hand, the degree of close contact was insufficient, so the obtained results of the inclination of cooling were poorer than those of the first comparative example.

THIRD COMPARATIVE EXAMPLE

Figure 18A:
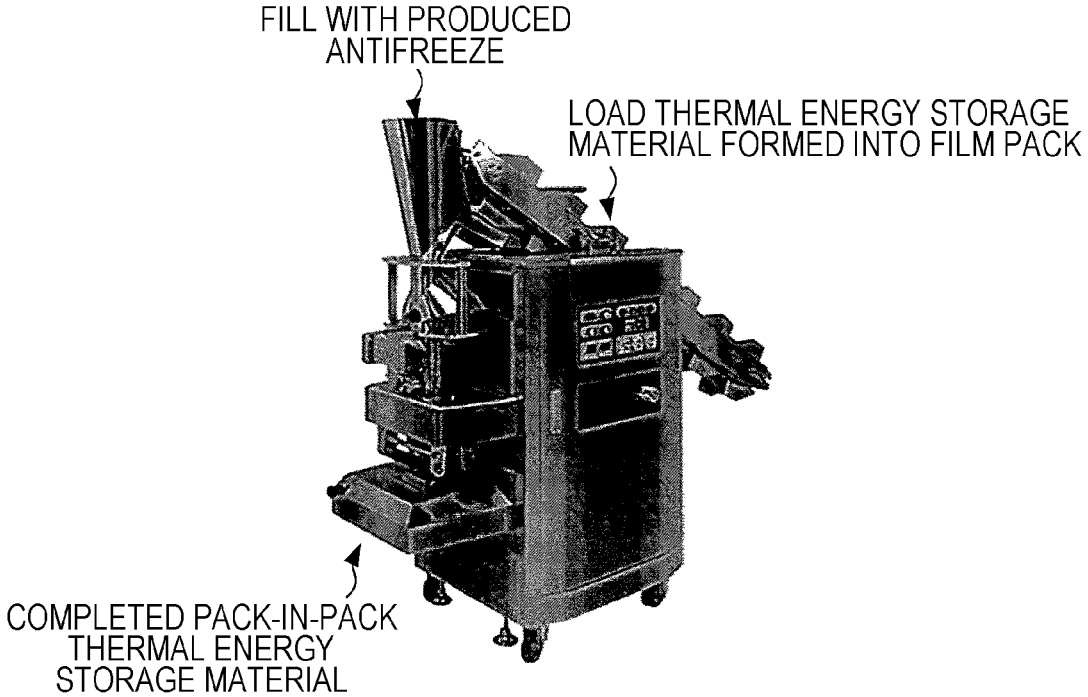
FIG. 18A is a diagram illustrating an overview of fabricating a thermal energy storage pack according to the third comparative example.
Figure 18B:
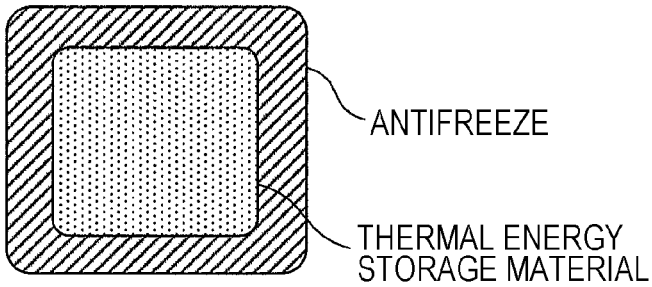
FIG. 18B is a plan view of the third comparative example.
Figure 18C:
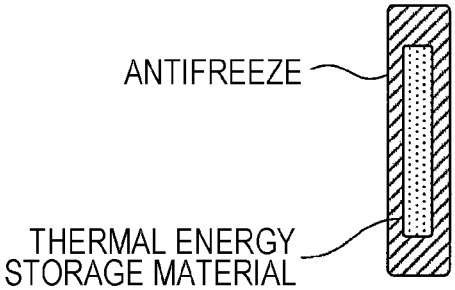
FIG. 18C is a side view of the third comparative example.

FIG. 18A is a diagram illustrating an overview of fabricating a thermal energy storage pack according to the third comparative example, FIG. 18B is a plan view of the third comparative example, and FIG. 18C is a side view of the third comparative example. That is to say, an antifreeze [aqueous solution of NaCl (sodium chloride)_23 wt %+CMC_5 wt %] was prepared by the same method as that of the first comparative example, and a thermal energy storage material [aqueous solution of KCl (potassium chloride)_21 wt %+CMC_5 wt %] was prepared by the same method as that of the second comparative example. A pack-in-pack thermal energy storage pack, where a film pack is filled with the antifreeze and film-packed thermal energy storage material was fabricated using the vertical pillow type packing matching illustrated in FIG. 18A.

Figure 19:
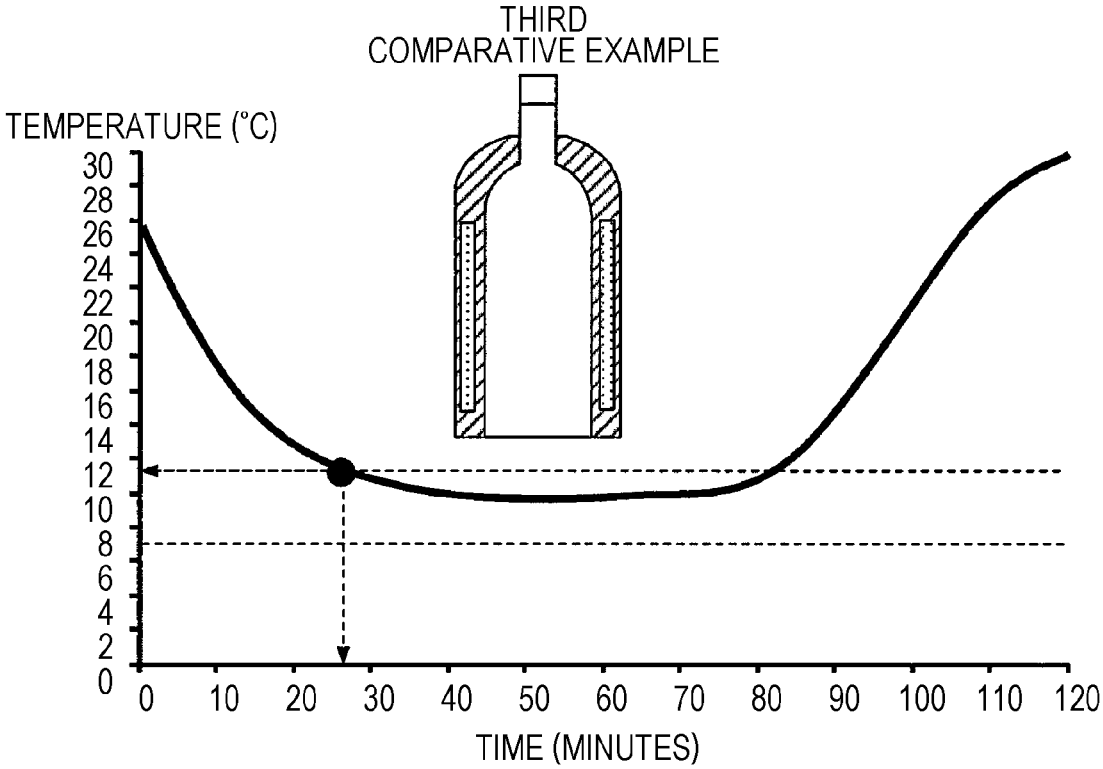
FIG. 19 is a diagram illustrating results of performing temperature measurement of liquid temperature of wine with regard to the third comparative example.

FIG. 19 is a diagram illustrating results of performing temperature measurement of liquid temperature of wine with regard to the third comparative example fabricated as described above, in accordance with the experiment procedures illustrated in FIG. 12. The third comparative example was able to obtain a sufficient attained temperature while maintaining a cooling speed equivalent to that of the first comparative example, due to the pack-in-pack configuration where the antifreeze and thermal energy storage pack are filled in. However, the ideal temperature range here is the ideal temperature range for white wine, and is insufficient for realizing specifications for sparkling wine of which the ideal temperature is even lower (2 to 6° C.).

FIRST EXAMPLE

Figure 20:
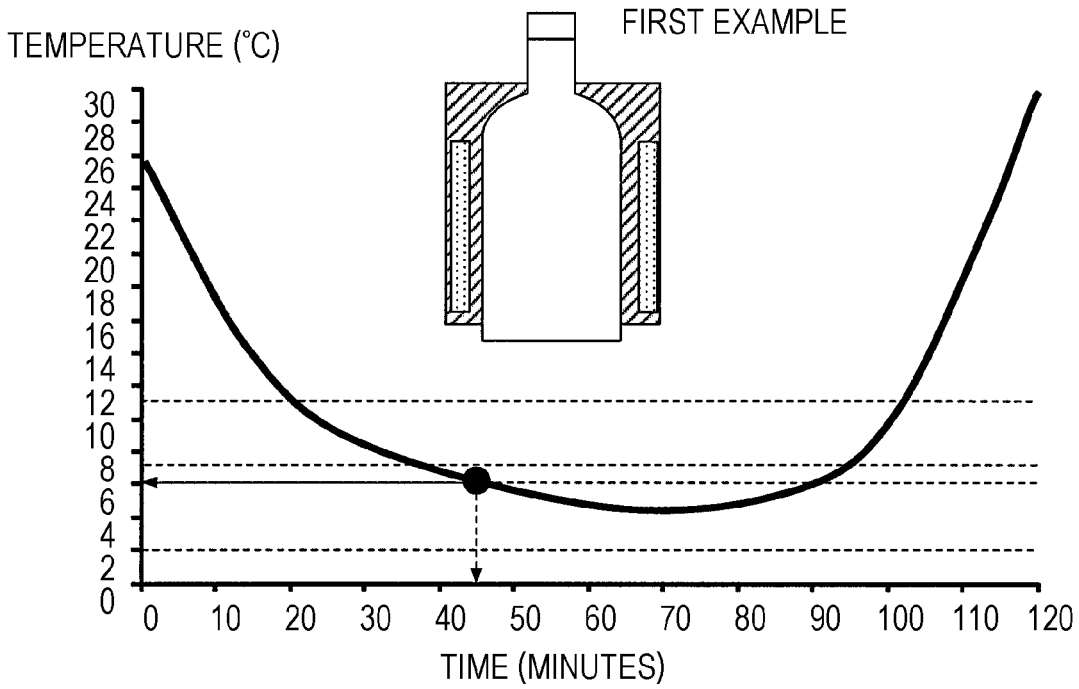
FIG. 20 is a diagram illustrating results of performing temperature measurement of liquid temperature of wine with regard to the first example.

FIG. 20 is a diagram illustrating results of performing temperature measurement of liquid temperature of wine with regard to the first example fabricated by the method described with reference to FIG. 6A through FIG. 11, in accordance with the experiment procedures illustrated in FIG. 12. In the first example, the first thermal energy storage material 3*a* was [aqueous solution of KCl (potassium chloride)_21 wt %+CMC_5 wt %], and the second thermal energy storage material 5*a* serving as an antifreeze was [aqueous solution of NaCl (sodium chloride)_23 wt %+CMC_5 wt %], as shown in FIG. 14. In the first example, a configuration was employed where the first deep-drawn container 3 formed of rigid film and filled with the first thermal energy storage material 3*a* was thermally welded within the second deep-drawn container 5 formed of flexible film and filled with the second thermal energy storage material 5*a* (antifreeze). Accordingly, a configuration was realized where the ideal temperature range for sparkling wine (2 to 6° C.) was quickly attained.

SECOND EXAMPLE

Figure 21:
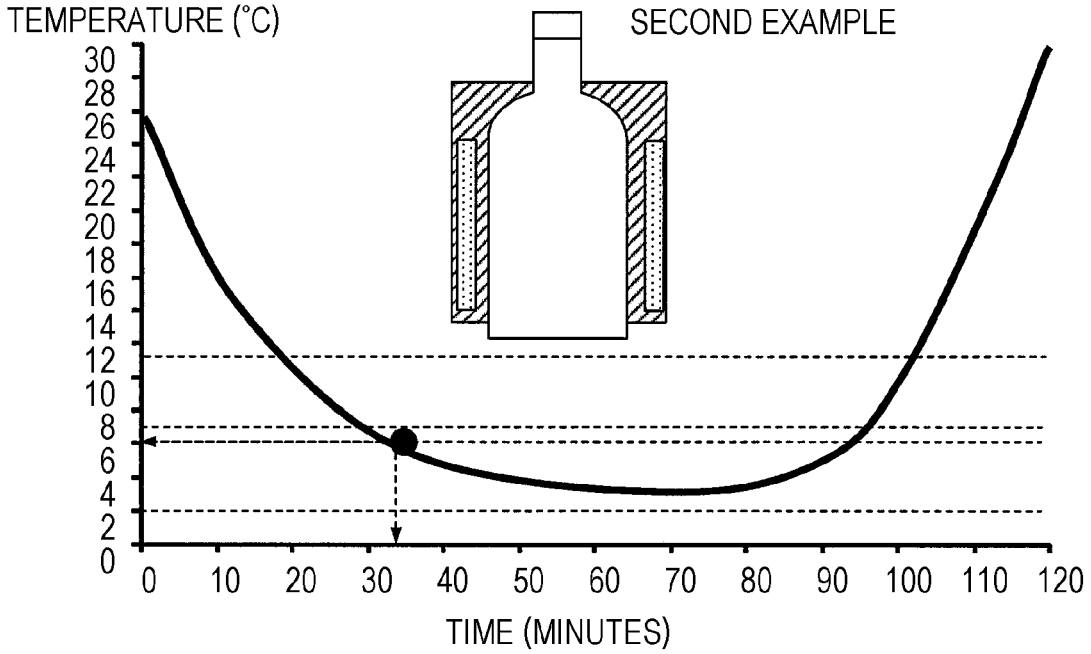
FIG. 21 is a diagram illustrating results of performing temperature measurement of liquid temperature of wine with regard to the second example.

FIG. 21 is a diagram illustrating results of performing temperature measurement of liquid temperature of wine with regard to the second example fabricated by the method described with reference to FIG. 6A through FIG. 11, in accordance with the experiment procedures illustrated in FIG. 12. In the second example, the first thermal energy storage material 3*a* was [aqueous solution of $NH_4Cl$ (ammonium chloride)_18 wt %+CMC_5 wt %], and the second thermal energy storage material 5*a* serving as an antifreeze was [aqueous solution of NaCl (sodium chloride)_23 wt %+CMC_5 wt %], as shown in FIG. 14. In the second example, a configuration was employed where the first deep-drawn container 3 formed of rigid film and filled with the first thermal energy storage material 3*a* was thermally welded within the second deep-drawn container 5 formed of flexible film and filled with the second thermal energy storage material 5*a* (antifreeze). Accordingly, a configuration was realized where the ideal temperature range for sparkling wine (2 to 6° C.) was quickly attained.

THIRD EXAMPLE

Figure 22:
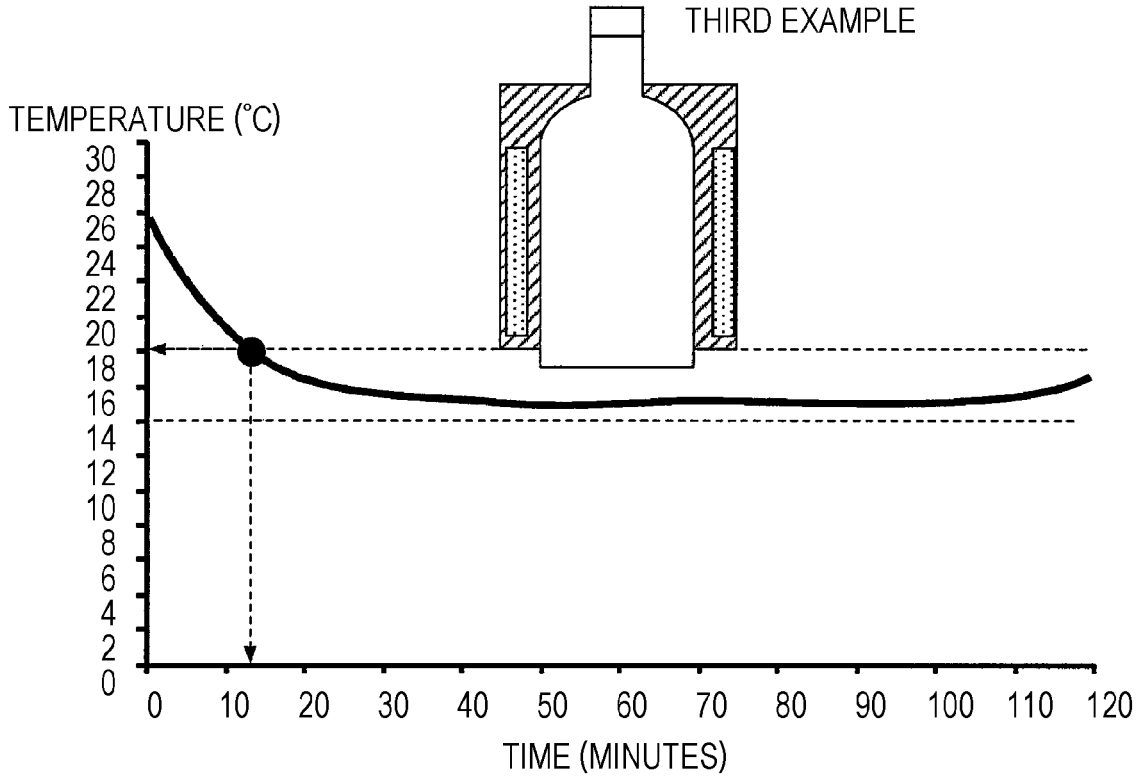
FIG. 22 is a diagram illustrating results of performing temperature measurement of liquid temperature of wine with regard to the third example.

FIG. 22 is a diagram illustrating results of performing temperature measurement of liquid temperature of wine with regard to the third example fabricated by the method described with reference to FIG. 6A through FIG. 11, in accordance with the experiment procedures illustrated in FIG. 12. In the third example, the first thermal energy storage material 3*a* was [aqueous solution of TBAT (tetrabutylammonium bromide)_40 wt %+CMC_5 wt %], and the second thermal energy storage material 5*a* serving as an antifreeze was [aqueous solution of NaCl (sodium, chloride) _23 wt %+CMC_5 wt %], as shown in FIG. 14. In the third example, a configuration was employed where the first deep-drawn container 3 formed of rigid film and filled with the first thermal energy storage material 3*a* was thermally welded within the second deep-drawn container 5 formed of flexible film and filled with the second thermal energy storage material 5*a* (antifreeze). Accordingly, a configuration was realized where the ideal temperature range for red wine (14 to 18° C.) was quickly attained, and moreover the ideal temperature was maintainable for two hours or more.

FIG. 23 is a table summarizing experiment results. The first comparative example was only effective regarding red wine, while the second comparative example and third comparative example were only effective regarding red wine and white wine, while none of the first through third comparative examples were effective regarding sparkling wine. Conversely, the first example and second example were found to be effective regarding all of red wine, white wine, and sparkling wine. Also, it was found that the third example exhibited sufficient rapid-cooling properties, and also that the ideal temperature could be maintained for two hours or more.

[First Modification]

Figure 24A:
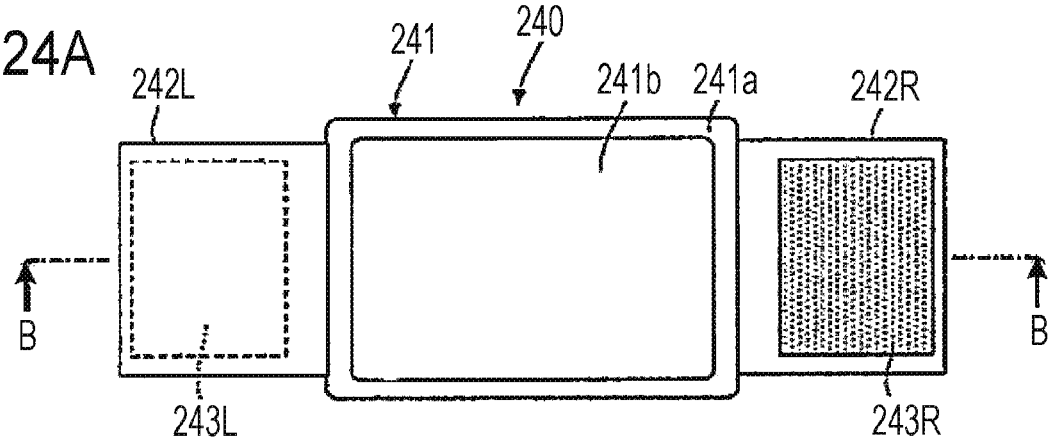
FIG. 24A is a plan view of an icing pack according to a first modification of the present embodiment.
Figure 24B:
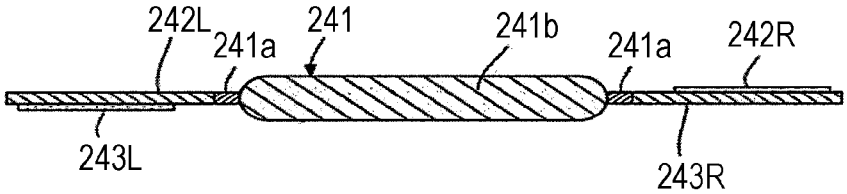
FIG. 24B is a cross-sectional view taken along B-B in FIG. 24A.

The thermal energy storage pack according to the present embodiment can also be applied to an icing pack. FIG. 24A is a plan view of an icing pack according to a first modification of the present embodiment, and FIG. 24B is a cross-sectional view taken along B-B in FIG. 24A. An icing pack 240 has a pack main unit 241, a peripheral portion 241*a*, and an accommodation portion 241*b*. The icing pack 240 also has band portions 242R and 242L, a hook portion 243R, and a loop portion 243L. According to this configuration, the object to be cooled can be made to quickly attain the desired temperature.

[Second Modification]

Figure 25A:
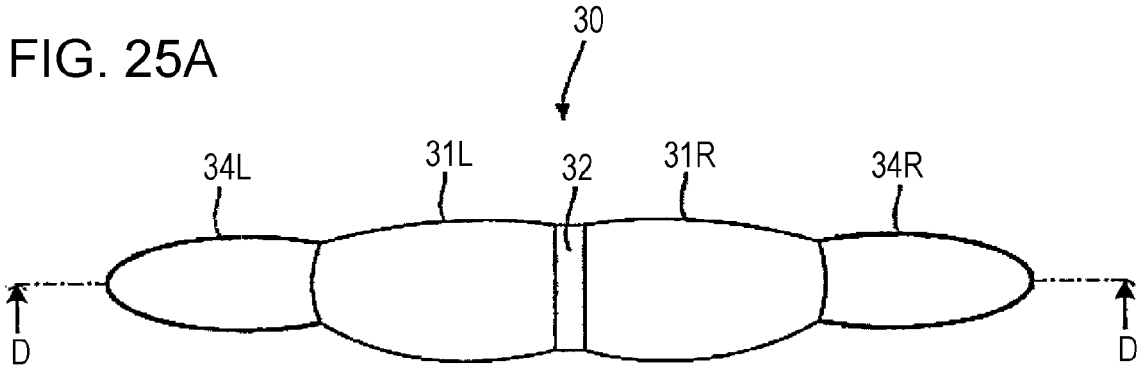
FIG. 25A is a plan view of a cooling ice mask according to a second modification of the present embodiment.
Figure 25B:
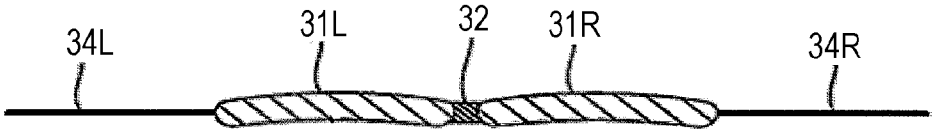
FIG. 25B is a cross-sectional view taken along D-D in FIG. 25A.

The thermal energy storage pack according to the present modification can be applied to a cooling ice mask. FIG. 25A is a plan view of a cooling ice mask according to a second modification of the present embodiment, and FIG. 25B is a cross-sectional view taken along D-D in FIG. 25A. A cooling ice mask 30 has a right eye cooling portion 31R, a left eye cooling portion 31L, a connecting portion 32, and rubber bands 34R and 34L. According to this configuration, the eyes can be quickly brought to the desired temperature.

[Third Modification]

Figure 26:
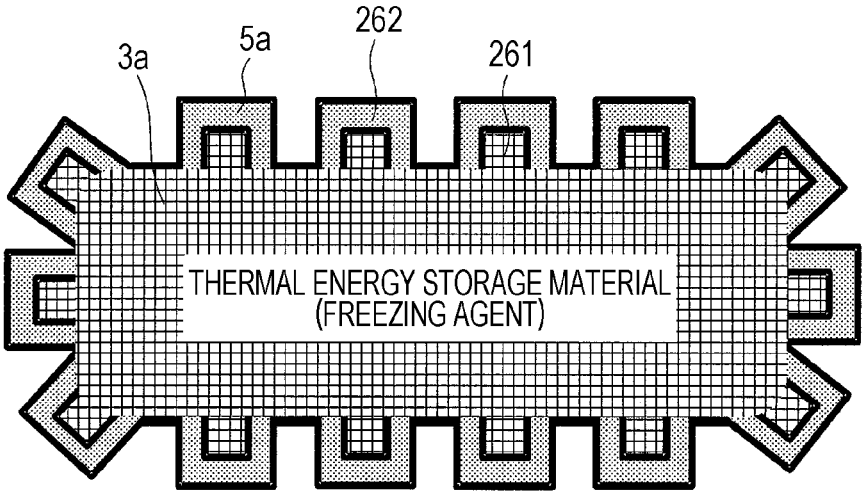
FIG. 26 is a diagram illustrating an overview of an ice pillow according to a third modification of the present embodiment.

The thermal energy storage pack according to the present modification can be applied to an ice pillow. FIG. 26 is a diagram illustrating an overview of an ice pillow according to a third modification of the present embodiment. The surface of the ice pillow has a fine corrugated configuration using a foamed cushioning material, as illustrated in FIG. 26. That is to say, an ice pillow 260 has a first accommodation portion 261 having the first thermal energy storage material 3*a* and a second accommodation portion 262 having the second thermal energy storage material 5*a*. Thus, the area of contact with the human body (head) can be increased, and a marked sensation of rapid cooling can be obtained.

[Fourth Modification]

Figure 27:
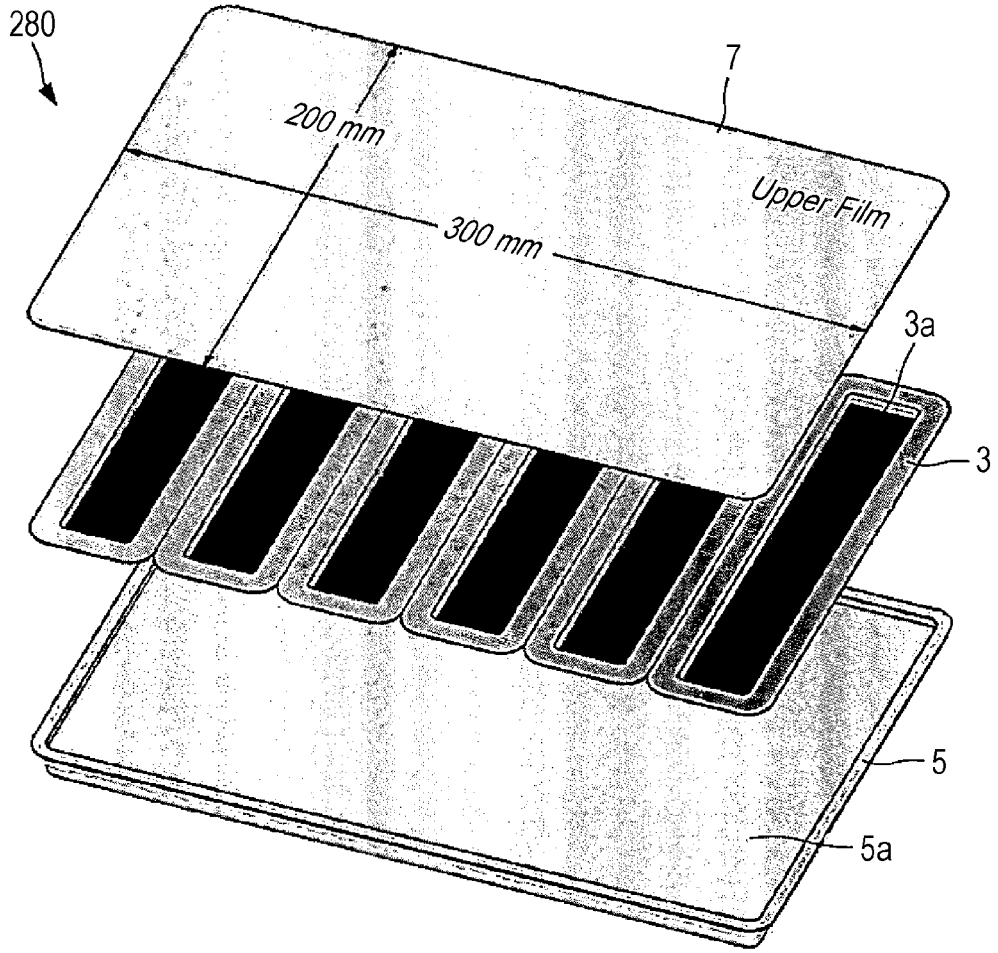
FIG. 27 is a diagram illustrating a disassembled view of a cold-storage mat according to a fourth modification.
Figure 28:
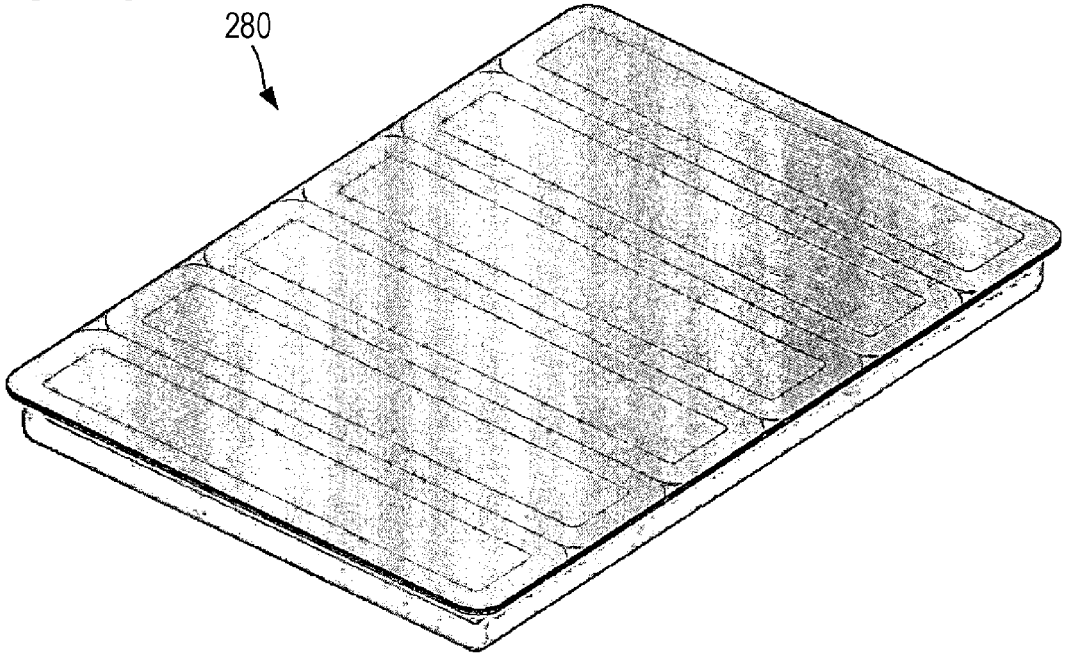
FIG. 28 is a diagram illustrating a cold-storage mat 280 that has been completed.

A cold-storage mat described below was fabricated in a fourth modification, by the method illustrated in FIG. 6A through FIG. 11. FIG. 27 is a diagram illustrating a disassembled view of the cold-storage mat according to the fourth modification, and FIG. 28 is a diagram illustrating the cold-storage mat 280 that has been completed. This cold-storage mat 280 has the cover material 7, first deep-drawn container 3, and second deep-drawn container 5, and the first deep-drawn container 3 is filled with the first thermal energy storage material 3*a*. Also, the second deep-drawn container 5 is filled with the second thermal energy storage material 5*a*. In the fourth modification, "coextruded multi-layer film 'F116_350 um', manufactured by Mitsubishi Plastics, Inc." is used for the first deep-drawn container 3, and "coextruded multi-layer film 'C131_200 um', manufactured by Mitsubishi Plastics, Inc." is used for the second deep-drawn container 5*a*. For the cover material, "commercially-available NY//LL 75 um" was used.

The first thermal energy storage material 3*a* was "aqueous solution of KCl (potassium chloride)_20 wt %", and the second thermal energy storage material 5*a* was "aqueous solution of NaCl (sodium chloride)_23 wt %+CMC_5 wt %". The amount of first thermal energy storage material 3*a* loaded was 40 g×6=240 g, and the amount of second thermal energy storage material 5*a* loaded was 350 g.

Figure 29:
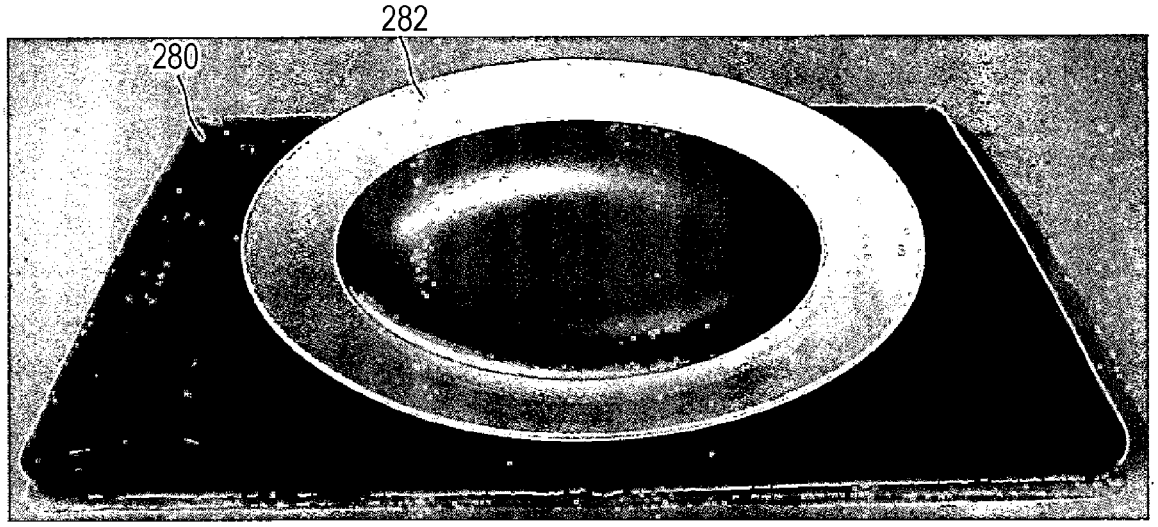
FIG. 29 is a diagram illustrating an overview of a measurement method according to a fourth modification.

Next, the measurement method in the fourth modification will be described. The cold-storage mat 280 is cooled in a freezer chamber (around −18° C.) and a commercially-available aluminum dish 282 is placed on the cold-storage mat 280. Next, water (500 g) is poured into the aluminum dish 282, as illustrated in FIG. 29. Water cooled in a refrigeration chamber (4 to 5° C.) is used here. The change in water temperature over time was then observed. A case where the cold-storage mat 280 was not used was also measured, as a comparative experiment.

Figure 30:
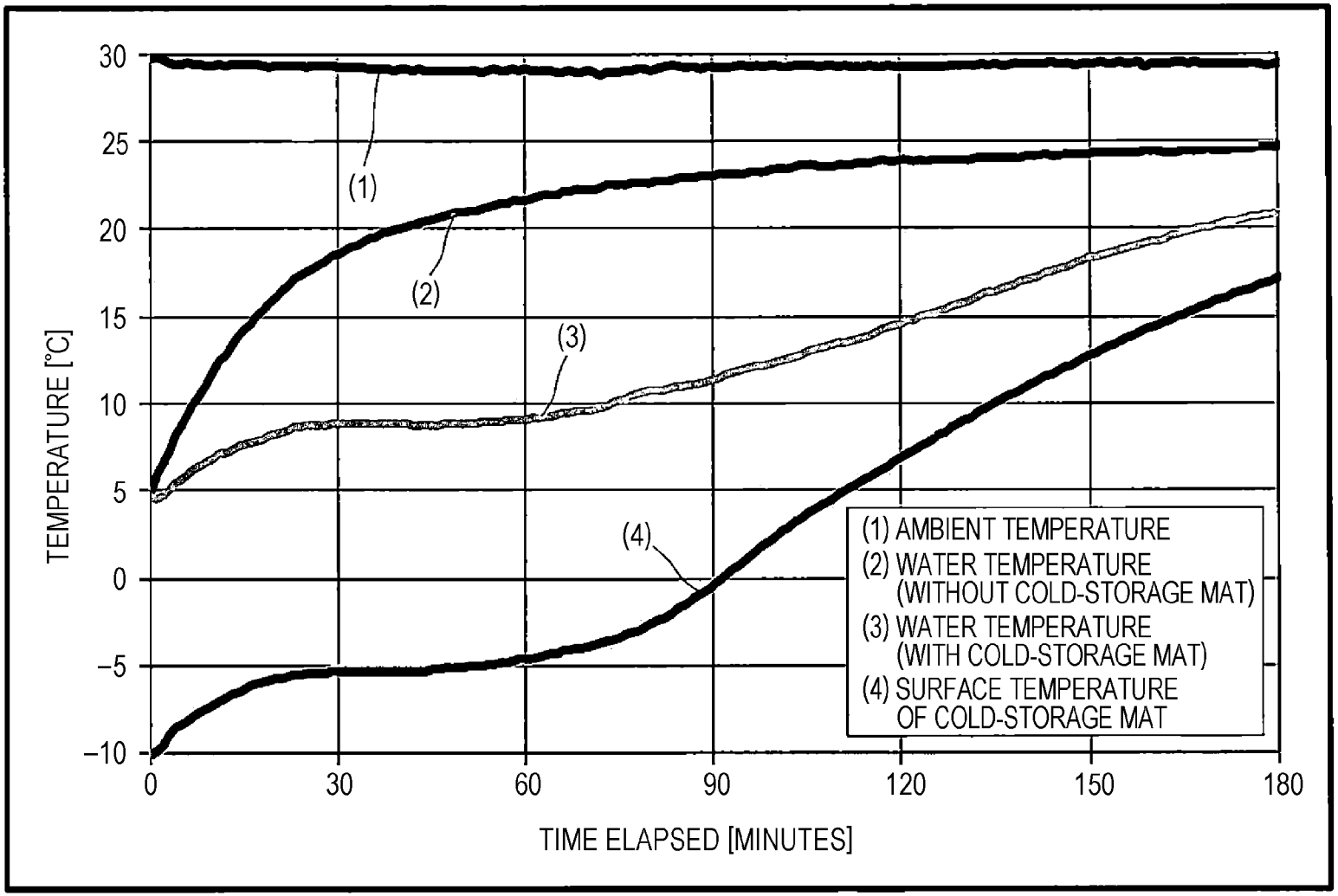
FIG. 30 is a graph illustrating measurement results according to the fourth modification.
Figure 31A:
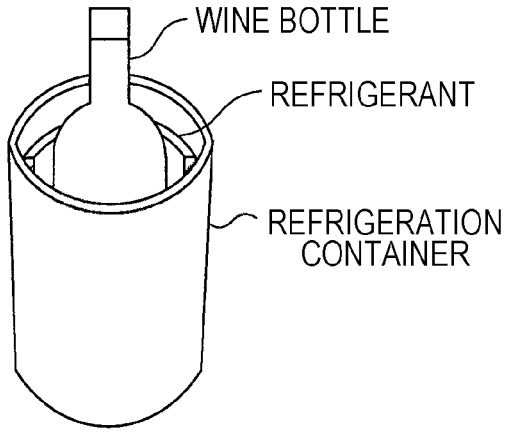
FIG. 31A is a diagram illustrating an overview of a wine cooler.
Figure 31B:
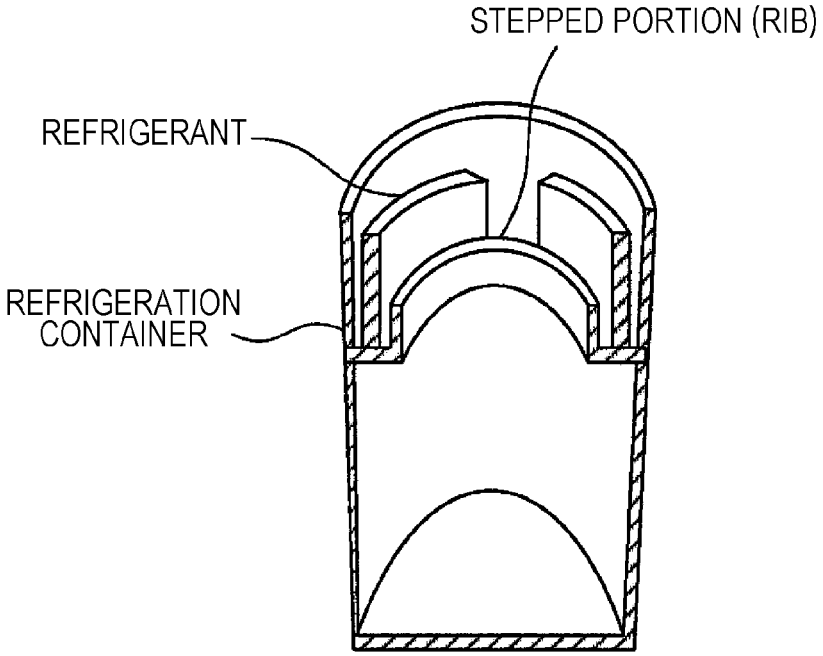
FIG. 31B is a cross-sectional view of the wine cooler.
Figure 32:
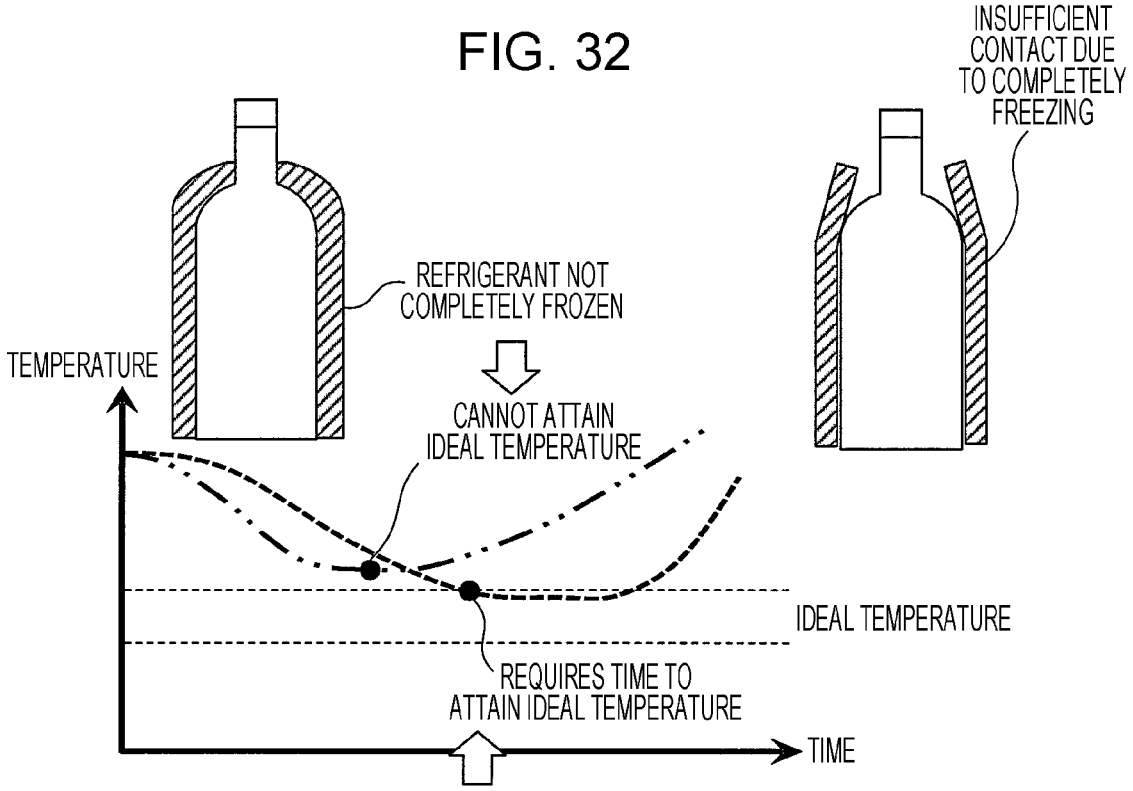
FIG. 32 is a diagram illustrating a problem of conventional art.
Figure 33A:
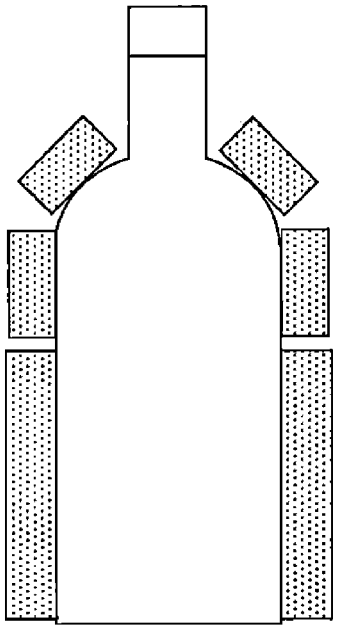
FIG. 33A is a diagram illustrating refrigerant divided into three.
Figure 33B:
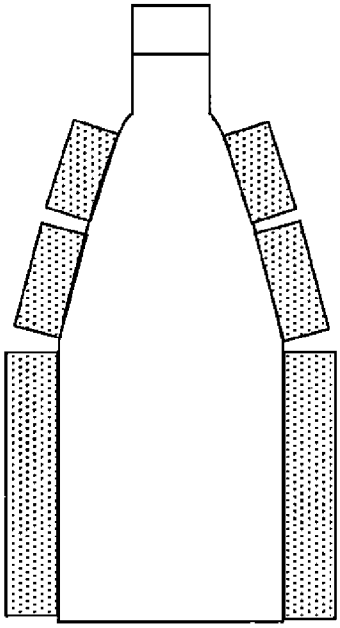
FIG. 33B is a diagram illustrating refrigerant divided into three.

FIG. 30 is a graph illustrating measurement results according to the fourth modification. In FIG. 30, the ambient temperature (1) is maintained at slightly below 30° C., and does not change. In a case of not using the cold-storage mat 280, the temperature change (2) of the water temperature in the aluminum dish 282 rapidly rose over around 30 minutes from the start of measurement, and reached approximately 22 degrees 60 minutes later. As opposed to this, in a case of using the cold-storage mat 280, the temperature change (3) of the water temperature in the aluminum dish 282 rose somewhat over around 30 minutes from the start of measurement and reached 8° C. to 9° C., but this temperature was maintained until around past 60 minutes, and thereafter rose. The surface temperature of the cold-storage mat 280 rose somewhat over around 30 minutes from the start of measurement and reached −5° C., but this temperature was maintained until around past 60 minutes, and thereafter rose. It is conceivable that in this case, the thermal energy storage material in the cold-storage mat 280 was exhibiting phase change until around past 60 minutes.

From these results, it has been found that by using the cold-storage mat 280, an object to be cooled (water in the fourth modification) placed on the cold-storage mat 280 can be maintained at a constant temperature for approximately 60 minutes.

Note that the thermal energy storage pack according to the present embodiment is suitable for usage scenes where beverages that have serving temperatures such as wine or Japanese sake are kept cool, or usage scenes where appetizers, fruit, or the like, are placed on a cold-storage mat such as in the fourth embodiment. Further, besides these scenes, usage can be preferably made in a thawing machine that can thaw frozen foodstuff such as frozen meat, frozen fish, and so forth, rapidly and with high quality, and machines to remove some heat from hot foods, that can quickly remove heat from, freshly made dishes such as curry, stew, or the like, or baby formula or the like.

Second Embodiment

The second deep-drawn container in the second embodiment is imparted with "shape following capabilities" in order to improve the degree of close contact between the cooling material and the food and/or beverage, without increasing the number of divisions of the cooling material. In order to impart "shape following capabilities" to the second deep-drawn container, the second deep-drawn container is formed of a flexible material, and also the volume of the second deep-drawn container is increased, and also the amount of antifreeze that the second deep-drawn container is filled with is increased. Accordingly, the second deep-drawn container is deformed so as to freely follow the shape of the food and/or beverage, and the antifreeze that the second deep-drawn container is filled with can come into close contact with the bottle without gaps.

[Inner Tray]

Figure 34A:
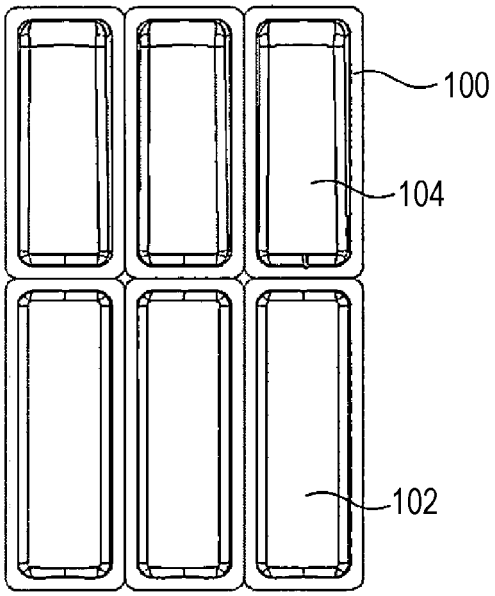
FIG. 34A is a plan view of an inner tray according to a second embodiment.
Figure 34B:
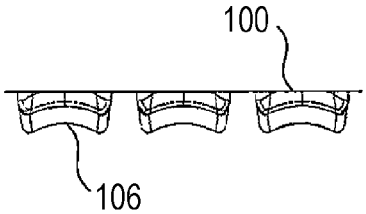
FIG. 34B is a frontal view of the inner tray according to the second embodiment.
Figure 34C:
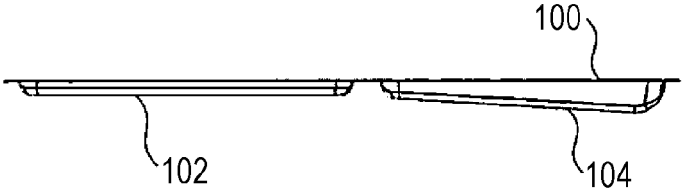
FIG. 34C is a side view of the inner tray according to the second embodiment.
Figure 34D:
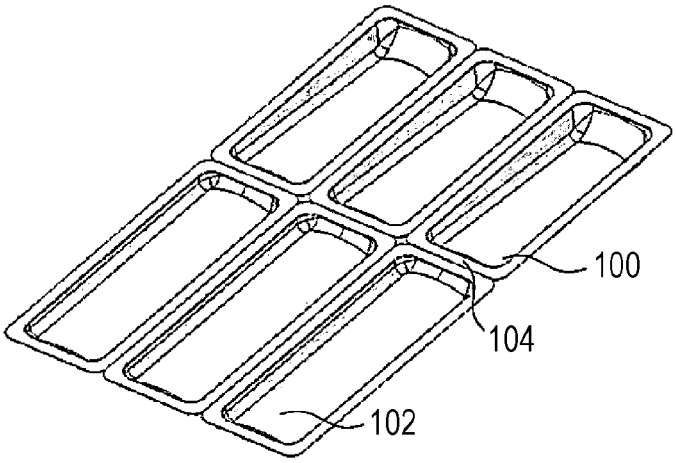
FIG. 34D is a perspective view of the inner tray according to the second embodiment.

FIG. 34A through FIG. 34D are diagrams illustrating an inner tray according to the second embodiment, where FIG. 34A is a plan view of the inner tray, FIG. 34B is a frontal view of the inner tray, FIG. 34C is a side view of the inner tray, and FIG. 34D is a perspective view of the inner tray. The inner tray 100 corresponds to the first deep-drawn container. The inner tray 100 is configured of a first inner tray 102 that is relatively shallow and has a constant depth, and a second inner tray 104 that becomes deeper from one end toward the other. In the second embodiment, three first inner trays 102 are consecutively provided in the width direction, three second inner trays 104 are consecutively provided in the width direction, and the first inner trays 102 and second inner trays 104 are connected in the longitudinal direction. It can be seen from the side view in FIG. 34C that the first inner trays 102 have a constant depth, while the second inner trays 104 become deeper from the left toward the right as viewed in the plane of the drawing. A bottom portion 106 of the inner tray 100 may protrude toward the opening side, as illustrated in the frontal view in FIG. 34B. Accordingly, the bottom portion 106 of the inner tray 100 can follow the outer face of the bottle, and further increase the degree of close contact.

The procedures for fabricating the inner tray 100 are as follows. That is to say, a packing material is placed on a cavity mold, and the inner tray 100 serving as the first deep-drawn container is formed using a vacuum forming machine. A rigid plastic film is preferably used for the packing material, and specifically, the following specifications are preferable. That is to say, the configuration is "PE/PA/PE, PP/PA/PP", to total thickness is "300 to 500 um", and the hardness is "Young's modulus≥3000 MPa". An example of a packing material satisfying such specifications includes "coextruded multi-layer film 'F116_350 um', manufactured by Mitsubishi Plastics, Inc.", and so forth. Also, in a case where the performance demanded of the packing material, such as oxygen barrier, steam barrier, and so forth, is not very high, PE single-layer/300 to 500 um is preferably used. This enables the cost of the packing material to be suppressed, and formability of the container to be improved.

On the other hand, in a case of removing the thermal exchange unit according to the present invention, that has been cooled/frozen in a freezer chamber or the like, for use, the difference between the temperature of the thermal exchange unit immediately after removal (the temperature in the freezer chamber) and the ambient temperature outside is great, and condensation may occur on the surface of the thermal exchange unit. In such cases, a packing material of a non-woven fabric material, or a packing material where a surfactant has been coated on the surface is preferably used. This can suppress the occurrence of condensation. Examples include "LLDPE Special Grade 'TNF', manufactured by Mitsui Chemicals Tohcello, Inc.", and so forth.

[Outer Tray]

Figure 35A:
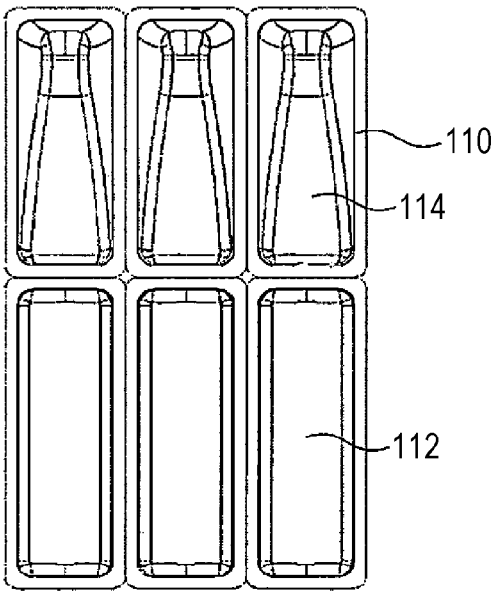
FIG. 35A is a plan view of an outer tray according to the second embodiment.
Figure 35B:
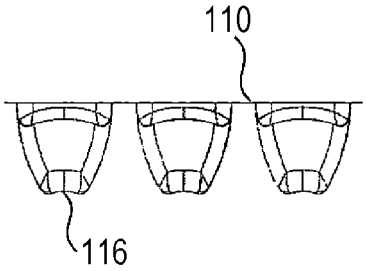
FIG. 35B is a frontal view of the outer tray according to the second embodiment.
Figure 35C:
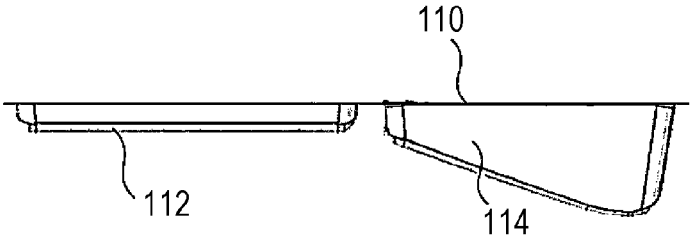
FIG. 35C is a side view of the outer tray according to the second embodiment.
Figure 35D:
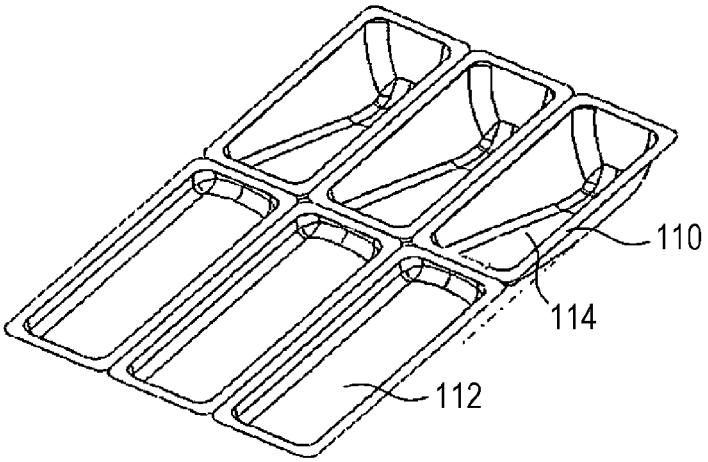
FIG. 35D is a perspective view of the outer tray according to the second embodiment.

FIG. 35A through FIG. 35D are diagrams illustrating an outer tray according to the second embodiment, where FIG. 35A is a plan view of the outer tray, FIG. 35B is a frontal view of the outer tray, FIG. 35C is a side view of the inner tray, and FIG. 35D is a perspective view of the inner tray. The outer tray 110 corresponds to the second deep-drawn container. The outer tray 110 is configured of a first outer tray 112 that is relatively shallow and has a constant depth, and a second outer tray 114 that becomes deeper from one end toward the other. Accordingly, the volume of the outer tray 110 is greater than the volume of the inner tray 100.

Thus, the volume of the outer tray 110 is greater than the volume of the inner tray 100, so a greater amount of antifreeze, serving as the second thermal energy storage material, can be used. Also, the outer tray 110 is flexible, and has a high degree of freedom regarding deformation. Accordingly, the outer tray 110 can be made to follow the outer shape of the food and/or beverage, and increase the degree of close contact as to the food and/or beverage. Note that the volume of the outer tray 110 preferably is two to ten times the volume of the inner tray 100.

In the second embodiment, three first outer trays 112 are consecutively provided in the width direction, three second outer trays 114 are consecutively provided in the width direction, and the first outer trays 112 and second outer trays 114 are connected in the longitudinal direction. It can be seen from the side view in FIG. 35C that the first outer trays 112 have a constant depth, while the second outer trays 114 become deeper from the left toward the right as viewed in the plane of the drawing. A bottom portion 116 of the outer tray 110 may protrude toward the opening side, as illustrated in the frontal view in FIG. 35B. Accordingly, the bottom portion 116 of the outer tray 110 can follow the outer face of the bottle, and further increase the degree of close contact.

The procedures for fabricating the outer tray 110 are as follows. That is to say, a packing material is placed on a cavity mold, and the outer tray 110 serving as the second deep-drawn container is formed using a vacuum forming machine. A flexible plastic film is preferably used for the packing material, and specifically, the following specifications are preferable. That is to say, the configuration is "PA/PE, PA/PP", the total thickness is "100 to 300 um", and the hardness is "Young's modulus is 3000 MPa or lower, and preferably 600 MPa or lower". An example of a packing material satisfying such specifications includes "coextruded multi-layer film 'C131_200 um', manufactured by Mitsubishi Plastics, Inc.", and so forth.

Also, in a case where the performance demanded of the packing material, such as oxygen barrier, steam barrier, and so forth, is not very high, PE single-layer/100 to 300 um is preferably used. This enables the cost of the packing material to be suppressed, and formability of the container to be improved. On the other hand, in a case of removing the thermal exchange unit according to the present invention, that has been cooled/frozen in a freezer chamber or the like, for use, the difference between the temperature of the thermal exchange unit immediately after removal (the temperature in the freezer chamber) and the ambient temperature outside is great, and condensation may occur on the surface of the thermal exchange unit. In such cases, a packing material of a non-woven fabric material, or a packing material where a surfactant has been coated on the surface is preferably used. This can suppress the occurrence of condensation. Examples include "LLDPE Special Grade 'TNF', manufactured by Mitsui Chemicals Tohcello, Inc.", and so forth.

Figure 39:
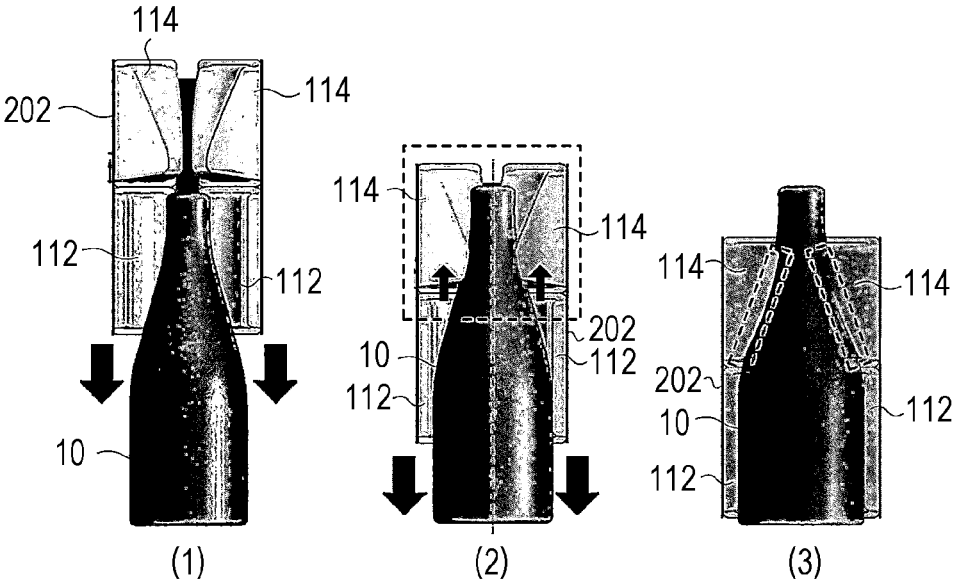
FIG. 39 is a diagram illustrating a state of usage of the thermal exchange unit according to the second embodiment, in stages.

Also, the thermal exchange unit according to the present invention employs a configuration for covering a wine bottle from above, as illustrated in FIG. 39. In the process of a user covering the wine bottle with the thermal exchange unit, the first outer trays 112 and second outer trays 114 are crushed while mounting, so "imparting slidability" is important in particular for the packing material making up the second outer trays 114 at the upper tier side that come into contact with the wine bottle.

Although inner tray packing material commonly is nylon, polyethylene, polypropylene, polystyrene, and so forth, as described above, the friction coefficients thereof are around 0.37 for nylon, 0.18 for polyethylene, 0.3 for polypropylene, and 0.5 for polystyrene. Mounting/detaching capabilities can be improved by packing materials where the surface of these packing materials nave been coated with something that has a small friction coefficient, such as Teflon (a registered trademark) that has a friction coefficient of 0.04 to 0.10 or fluororesin (PTFE, PFA, FEP), or by applying these packing materials as they are.

Thus, the Young's modulus of the inner tray 100 is 3000 MPa or higher, while the Young's modulus of the outer tray 110 is smaller than 3000 MPa, so the outer tray 110 can be flexibly deformed while maintaining the strength of the inner tray 100.

[Configuration of Thermal Energy Storage Pack]

Figure 36:
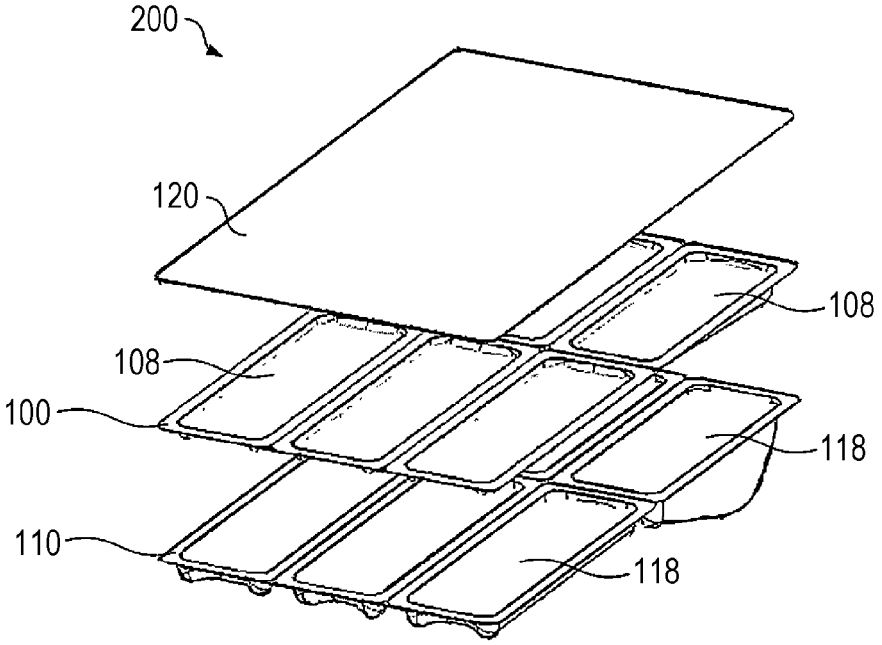
FIG. 36 is a diagram illustrating a schematic configuration of a thermal energy storage pack 200 according to the second embodiment.

FIG. 36 is a diagram illustrating a schematic configuration of a thermal energy storage pack 200 according to the second embodiment. A latent heat material 108 serving as the first thermal energy storage material is filled in the inner tray 100 that has been manufactured according to the above-described method, using a liquid quantitative filling machine. In a case of selecting the latent heat material 108, a latent heat thermal energy storage material that exhibits phase change at least at a temperature necessary for the beverage object or lower is preferable. Specifically, this may be an aqueous solution of potassium chloride, an aqueous solution of ammonium chloride, an aqueous solution of tetrabutylammonium bromide, or a paraffin-based thermal energy storage material or the like. The latent heat material 108 may be imparted with viscosity. It is desirable that the viscosity is 100 cP or higher, and preferably 200 cP or lower. This viscosity will be described later. Examples of viscous agents include locust bean gum, guar gum, carrageenan, gellan gum, absorbent polymers, acrylate polymers, and so forth.

Next, an antifreeze 118 serving as the second thermal energy storage material is filled in the outer tray 110 that has been manufactured according to the above-described method, using a liquid quantitative filling machine. In a case of selecting the antifreeze 118, a material that maintains the liquid phase state at least at the freezing temperature of the above latent heat material 108 is preferable. Specifically, this may be an aqueous solution of sodium chloride, an aqueous solution of calcium chloride, ethylene glycol, polypropylene glycol, silicon oil, or the like. The antifreeze 118 may be imparted with viscosity. It is desirable that the viscosity is 100 cP or higher, and preferably 200 cP or lower. This viscosity will be described later. Examples of viscous agents include locust bean gum, guar gum, carrageenan, gellan gum, absorbent polymers, acrylate polymers, and so forth.

Next, the three layer members of the "inner tray 100 filled with latent heat material 108 (referred to as 'latent heat layer')" fabricated as described above, the "outer tray 110 filled with antifreeze 118 (referred to as 'antifreeze layer')" fabricated as described above, and a cover material 120 having insulating functions or having an insulating material applied thereto, are thermally welded, using a blister sealing/packing machine.

Thus, the cover material itself is insulating, thereby preventing heat from passing in/out at the opposite side form the food and/or beverage, and enabling improved efficiency of temperature management of the food and/or beverage.

Now, in a case of selecting the cover material 120, a "PA/PE, PA/PP configuration" is common. A film formed of a CPP configuration, or EVOH configuration may be selected in a case where gas barrier properties are required. Also, in a case where the performance demanded of the packing material, such as oxygen barrier, steam barrier, and so forth, is not very high, a PE single-layer is preferably used. This enables the cost of the packing material to be suppressed.

On the other hand, in a case of removing the thermal exchange unit according to the present invention, that has been cooled/frozen in a freezer chamber or the like, for use, the difference between the temperature of the thermal exchange unit immediately after removal (the temperature in the freezer chamber) and the ambient temperature outside is great, and condensation may occur on the surface of the thermal exchange unit. In such cases, a packing material of a non-woven fabric material, or a packing material where a surfactant has been coated on the surface is preferably used. This can suppress the occurrence of condensation. Examples include "LLDPE Special Grade 'TNF', manufactured by Mitsui Chemicals Tohcello, Inc.", and so forth.

Examples of the blister sealing/packing machine include "'TB5060' and 'TB6090', manufactured by Taiseitechno, Inc." Examples of insulating material include rigid urethane foam, highly-foamed polyethylene, polyolefin foam (PEF), and so forth.

[Configuration of Thermal Exchange Unit]

Figure 37:
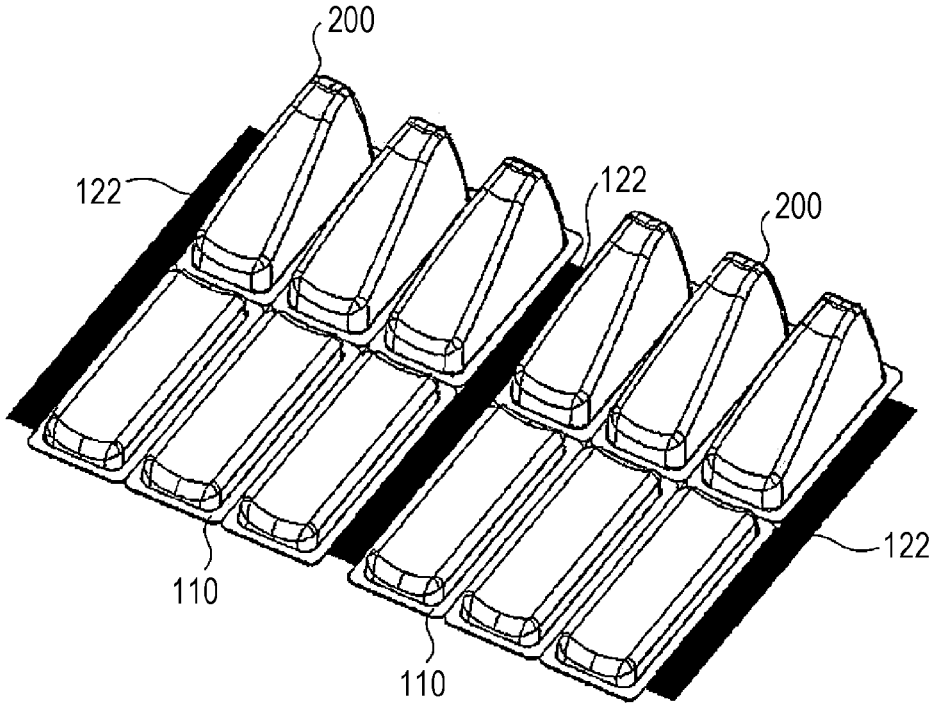
FIG. 37 is a diagram illustrating a thermal exchange unit.

FIG. 37 is a diagram illustrating a thermal exchange unit. An arrangement where two thermal energy storage packs 200 fabricated as described above have been connected via an elastic connecting rubber 122 to configure a thermal exchange unit 202 is illustrated here. FIG. 37 illustrates the thermal exchange unit 202 as viewed from the outer tray 110 side. Two thermal energy storage packs 200 are connected using the elastic connecting rubber 122, as illustrated in FIG. 37. In a case of selecting the elastic connecting rubber 122, examples include natural rubber, synthetic rubber, silicon rubber, urethane rubber, and so forth. The tightening force for the elastic connecting rubber 122 preferably is 15 N or more. Applying tightening force of the above-described weight or grater enables the degree of close contact between the beverage object such as a wine bottle or the like and the thermal energy storage pack 200 to be further improved, so improved rapid-cooling performance can be expected.

Note that a pressing portion that presses the thermal energy storage pack 200 in the center direction of concentric circles may further be provided. A ring-shaped rubber band, for example, corresponds to a pressing portion. Accordingly, the outer tray 110 can be brought into close contact with the food and/or beverage even more strongly. The pressing force of the pressing portion preferably is 25 N or more. 25 N or more enables the outer tray 110 to be strongly brought into close contact with the food and/or beverage.

[Form of Thermal Exchange Unit]

Figure 38A:
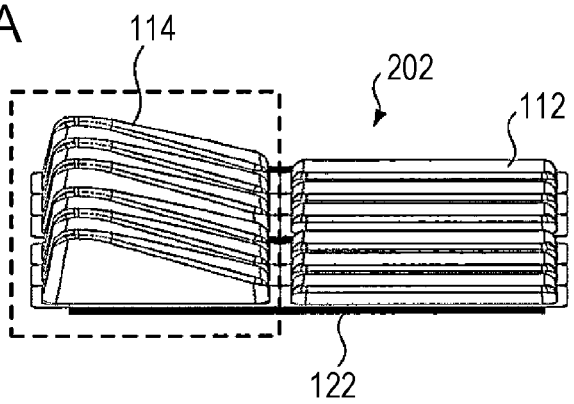
FIG. 38A is a diagram illustrating a form of the thermal exchange unit.
Figure 38B:
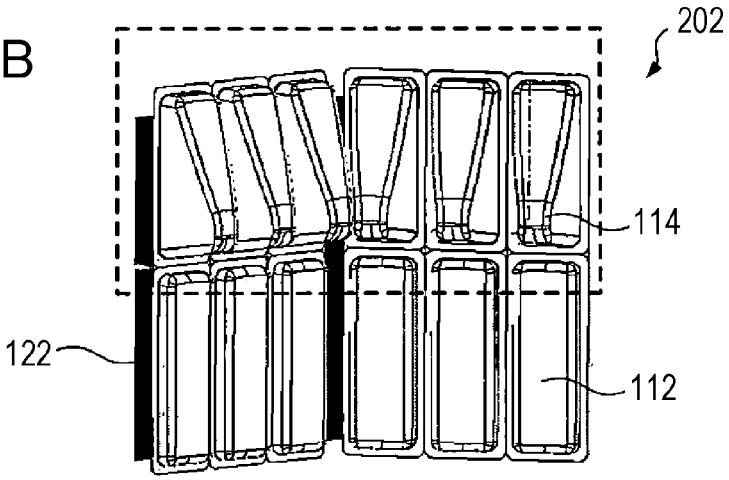
FIG. 38B is a diagram illustrating a form of the thermal exchange unit.
Figure 38C:
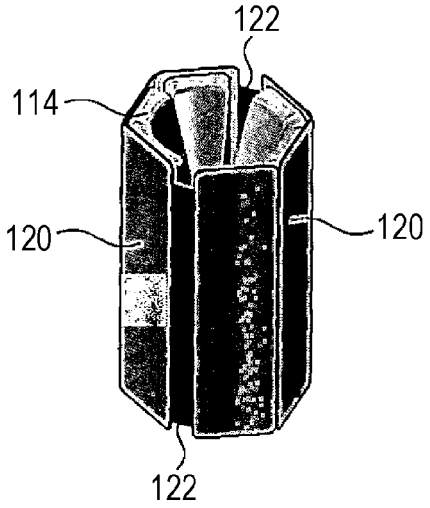
FIG. 38C is a diagram illustrating a form of the thermal exchange unit.

FIG. 38A through FIG. 38C are diagrams illustrating forms of the thermal exchange unit. FIG. 38A illustrates a state where the thermal exchange unit 202 is laid flat, FIG. 38B illustrates a state where the thermal exchange unit 202 is propped up, and FIG. 38C illustrates a state where the thermal exchange unit 202 is completed. In a state where the thermal exchange unit 202 is laid flat as illustrated in FIG. 38A, there is no change in the first outer trays 112, but the second outer trays 114 are in a state where the lift side is higher as viewed in the plane of the drawing. Next, in a state where the thermal exchange unit 202 is propped up as illustrated in FIG. 38B, the second outer trays 114 sag down under their own weight as indicated in the portion surrounded by dotted lines in the drawings, being formed of a flexible packing material filled with antifreeze. Even in the completed article illustrated in FIG. 38C, the second outer trays 114 sag down in the vertical direction when propped up.

Thus, the thermal energy storage packs 200 are connected so as to be arrayed on concentric circles by the thermal energy storage packs 200 being connected by the elastic connecting rubber 122, and thus can surround the food and/or beverage. The joint mechanisms have elasticity, so the joint mechanisms can stretch in accordance with the outer shape of the food and/or beverage, and the thermal energy storage packs 200 can be made to be in stronger close contact with the food and/or beverage. Consequently, temperature management of the food and/or beverage can be made more efficient.

Covering a beverage such as a wine bottle or the like from above by the completed article illustrated in FIG. 38C causes the first outer trays 112 and second outer trays 114 as antifreeze layers in a sagging state, as illustrated in FIG. 38B, to be pushed upwards due to contact with the food and/or beverage, and follow the shape of the food and/or beverage having a different shape, and thus come into close contact with no gaps. Containers making up beverages have a narrow neck at the upper side and a relatively broad body at the lower side, such represented by wine bottles, for example. Thus, even if a beverage container has different dimensions (diameters) depending on the position, the first outer trays 112 and second outer trays 114 are deformed to follow the outer shapes thereof, so the degree of close contact as to the beverage can be improved. That is to say, how to cool the upper side of the beverage is extremely important from the perspective of rapid cooling, and according the thermal exchange unit of the second embodiment, the first outer trays 112 and second outer trays 114 can follow the shape regardless of the shape of the beverage, and particularly at the upper portion, so the degree of close contact is increased, and multiple types of beverage objects can be handled.

FIG. 39 is a diagram illustrating a state of usage of the thermal exchange unit according to the second embodiment, in stages. FIG. 39 illustrates change in state from the left toward the right as viewed in the plane of the drawing. In FIG. 39, the thermal exchange unit is placed on a Burgundy-type wine bottle 10. As illustrated in FIG. 39, (1) the first outer trays 112 at the lower side are brought into contact with the wine bottle 10. (2) Next, the second outer trays 114 deform following the shape of the bottle. (3) The latent heat material layers at both the upper tier side and lower tier side come into close contact with the wine bottle 10 via the antifreeze layer, without gaps. Thus, a thermal exchange unit can be realized that can come into close contact with a wine bottle 10 that has different diameters depending on the position, without gaps.

Thus, the two portions of the upper tier portion and lower tier portion come into contact with the food and/or beverage, so gaps can be reduced more than a case of connecting a great number of relatively small thermal energy storage packs, and the degree of close contact between the outer tray 110 and food and/or beverage can be increased. Also, the outer tray 110 at the upper tier portion is relatively great, so even in a case where the food and/or beverage has a shape where the upper side in the vertical direction is narrow and the lower side in the vertical direction is broad, as with a bottle for example, the outer trays 110 come into contact with the food and/or beverage, and efficiency of temperature management can be increased.

Comparative Experiments of Second Embodiment

Next, comparative experiments carried out to verify the effects of the thermal exchange unit according to the second embodiment will be described.

(Procedure 1)

The thermal exchange unit is frozen in a freezer of a refrigerator, or a low-temperature thermostatic bath set to −18 to −20° C.

(Procedure 2)

The thermal exchange unit of which the latent heat material has been frozen is taken out of the thermostatic bath and mounted on the beverage object.

(Procedure 3)

Figure 40:
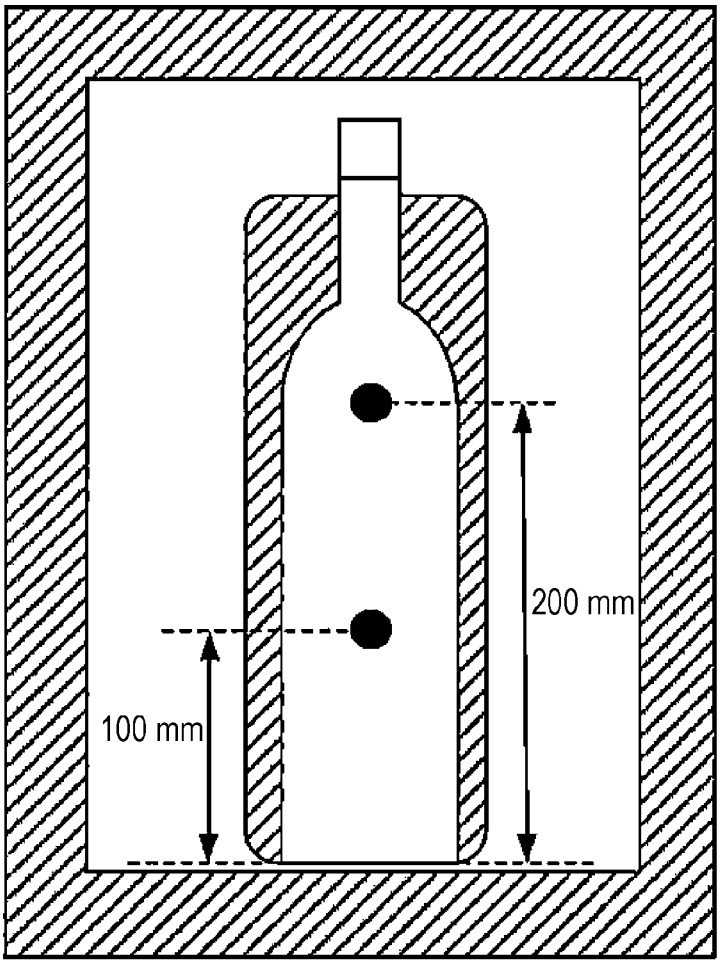
FIG. 40 is a diagram illustrating temperature measurement points.

The thermal exchange unit after Procedure 2 is placed in a temperature-maintaining thermostatic bath in a set to around 25 to 30° C., and change in the liquid temperature (two points) of the beverage (cooling properties) is measured. The measurement points are a position 100 mm from the bottom of the beverage, and 200 mm from the bottom, as illustrated in FIG. 40.

(Evaluation Method)

FIG. 13 is a diagram illustrating a method of evaluating experiment results, the following technique being used. That is to say, the "attained temperature/time" after starting cooling is measured. The rapid-cooling speed is defined as below in order to evaluate the cooling speed.

$$\text{Rapid-cooling degree}=(T\ \text{initial}-T\ 30\ \text{min})/30\ \text{min}$$

FIG. 41 is a table illustrating the configuration of antifreezes and latent heat materials according to fourth through sixth comparative examples and fourth through seventh examples, in comparative experiments according to the second embodiment. The fourth comparative example employs a technique of bringing the thermal exchange unit into contact with the wine bottle at the upper tier side of the wine bottle, using a drawstring configuration. The fifth comparative example simply has a thermal exchange unit wrapped around the wine bottle. The sixth comparative example employs a configuration where the coolant (antifreeze, latent heat material) is divided into three in the height direction, anticipating improvement over the fifth comparative example.

The antifreeze and latent heat material were prepared as shown in the table in FIG. 41, and evaluation was performed following the above-described experiment procedures. Note that the prototypes used for the comparative examples were fabricated as follows.

(1) Tap water and NaCl (sodium chloride) are placed in a first agitation tank, and agitation is performed to dissolve, thereby preparing an aqueous solution of NaCl_23 wt %. The agitation conditions here were 150 rpm/10 min.

(2) In the same way, tap water and KCl (potassium chloride) are placed in a second agitation tank, and agitation is performed to dissolve, thereby preparing an aqueous solution of KCl_20 wt %. The agitation conditions here were 150 rpm/10 min.

(3) Trays formed by vacuum forming were filled with predetermined amounts of the aqueous solution of NaCl_23 wt % prepared in (1) and the aqueous solution of KCl_20 wt % prepared in (2).

(4) The trays and cover material were sealed by a blister sealing matching, thereby fabricating the thermal exchange units.

FOURTH COMPARATIVE EXAMPLE

Figure 42:
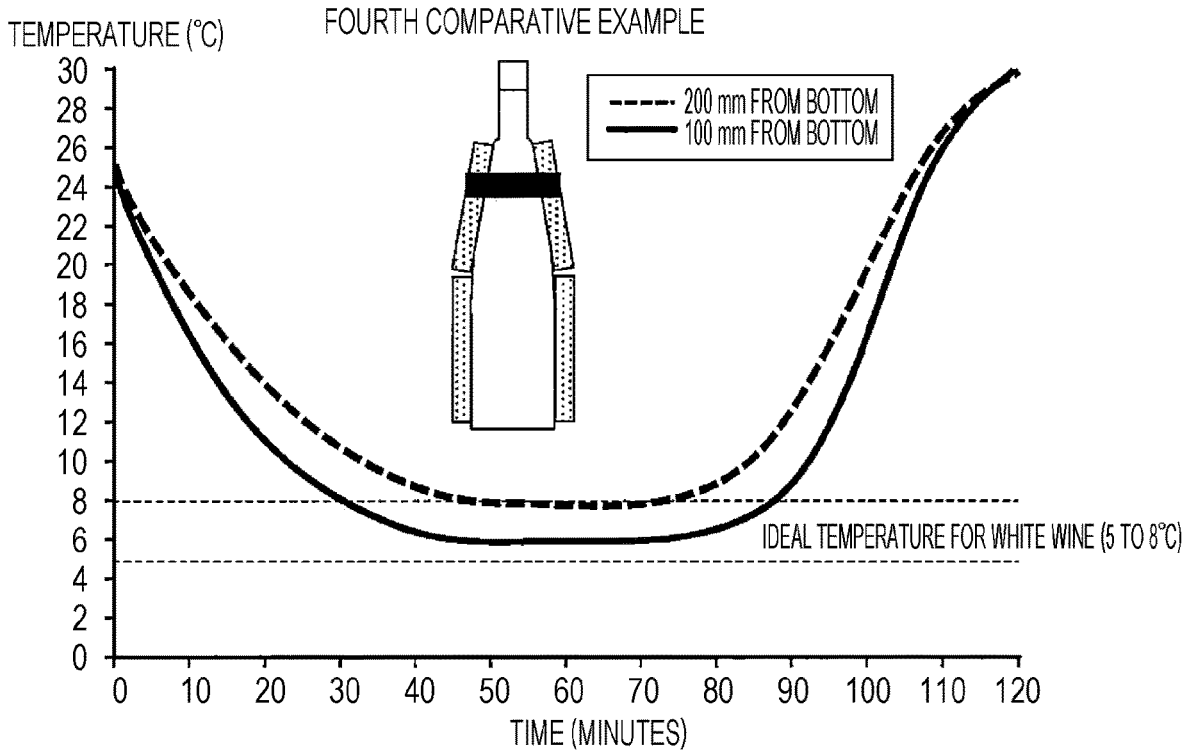
FIG. 42 is a diagram illustrating results of performing temperature measurement of liquid temperature of wine with regard to the fourth comparative example.

FIG. 42 is a diagram illustrating results of performing temperature measurement of liquid temperature of wine with regard to the fourth comparative example illustrated in FIG. 41. The fourth comparative example employs a technique of bringing the thermal exchange unit into contact with the wine bottle at the upper tier side of the wine bottle, using a drawstring configuration. The wine bottle is a Burgundy type. The degree of close contact at the upper tier side of the wine bottle was secured in the fourth comparative example, and consequently, the beverage was able to be brought to the serving temperature of white wine (5 to 8° C.). However, the amount of tightening by the drawstring differed each time, and it was configured that variance occurs in the measurement results as well.

FIFTH COMPARATIVE EXAMPLE

Figure 43:
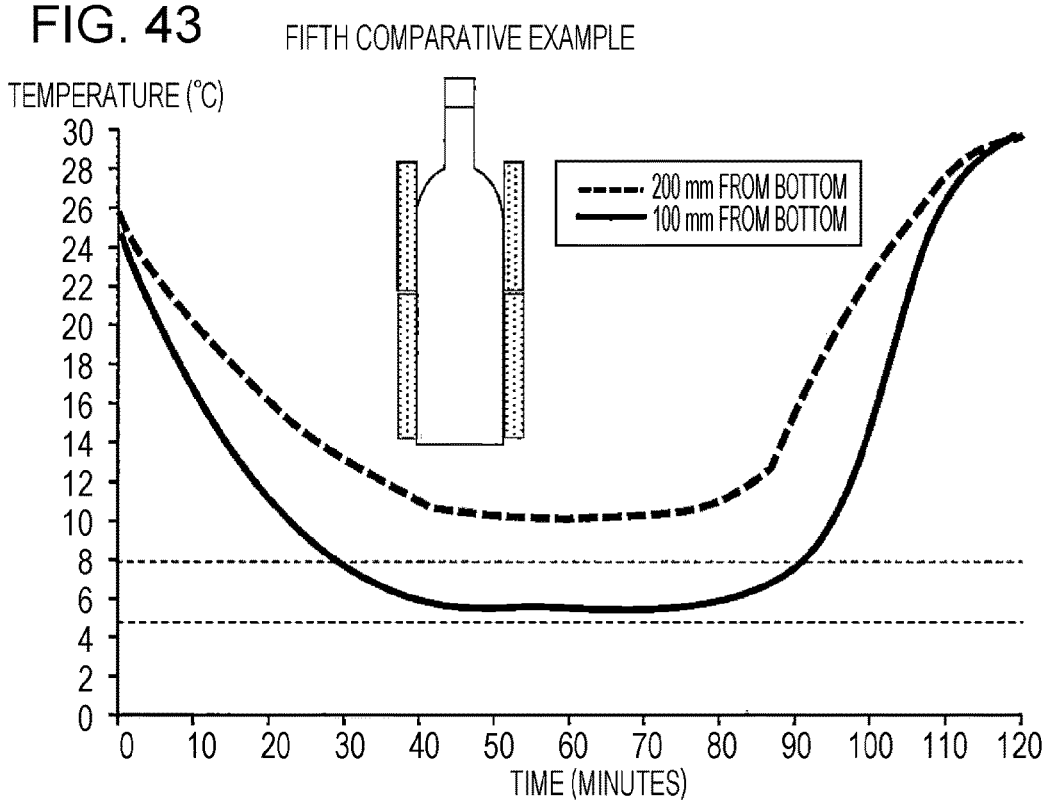
FIG. 43 is a diagram illustrating results of performing temperature measurement of liquid temperature of wine with regard to the fifth comparative example.

FIG. 43 is a diagram illustrating results of performing temperature measurement of liquid temperature of wine with regard to the fifth comparative example illustrated in FIG. 41. The wine bottle is a Bordeaux type. A thermal exchange unit the same as that of the prototype used in the fourth comparative example was mounted on the Bordeaux type wine bottle, and measurement was performed. The fifth comparative example has the thermal exchange unit simply wrapped around the wine bottle, and further, the shape of the wine bottle is different from that in the fourth comparative example, so the degree of close contact was particularly poor at the upper tier side, and the results obtained showed that the ideal temperature for white wine, which had been achieved in the fourth comparative example, would not be attained.

SIXTH COMPARATIVE EXAMPLE

Figure 44:
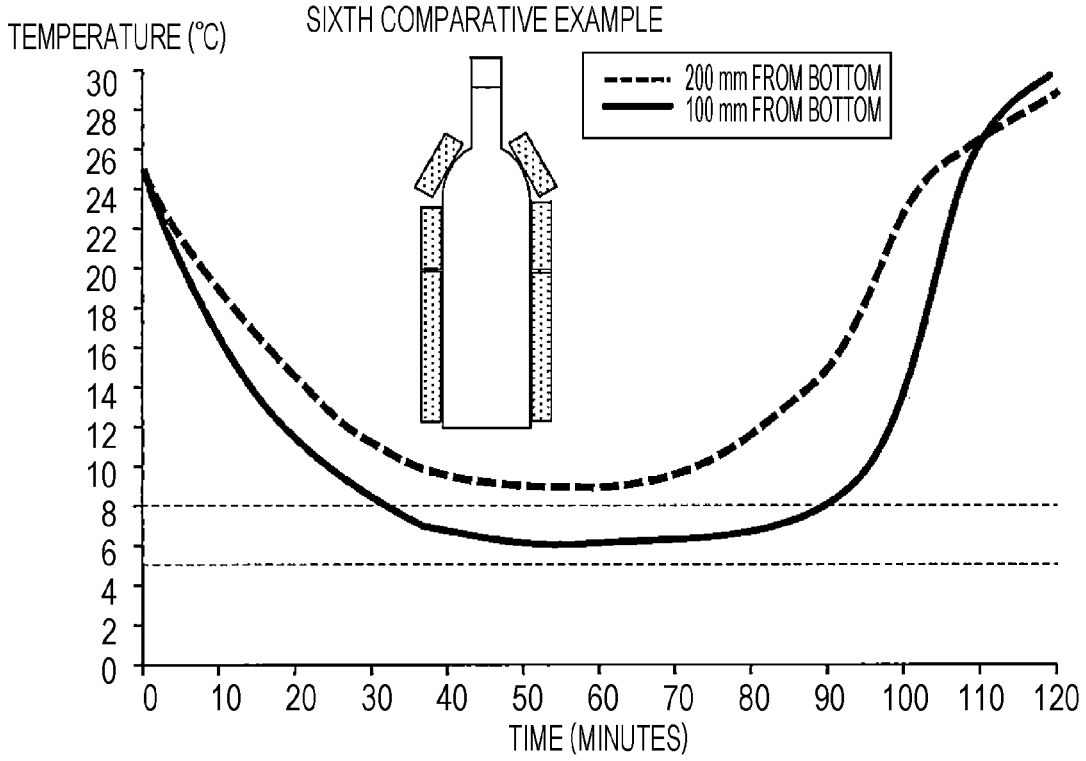
FIG. 44 is a diagram illustrating results of performing temperature measurement of liquid temperature of wine with regard to the sixth comparative example.

FIG. 44 is a diagram illustrating results of performing temperature measurement of liquid temperature of wine with regard to the sixth comparative example illustrated in FIG. 41. The wine bottle is a Bordeaux type. The sixth comparative example employs a configuration where the coolant (antifreeze, latent heat material) is divided into three in the height direction, anticipating improvement over the fifth comparative example. Results were obtained regarding the sixth comparative example that the attained temperature would be lower than that of the fifth comparative example, due to providing joint mechanisms and improving the degree of close contact at the upper tier side. However, the total contact area as to the container is smaller due to providing the joint mechanism, and there is concern that performance will deteriorate as a result.

Fourth Embodiment

Figure 45:
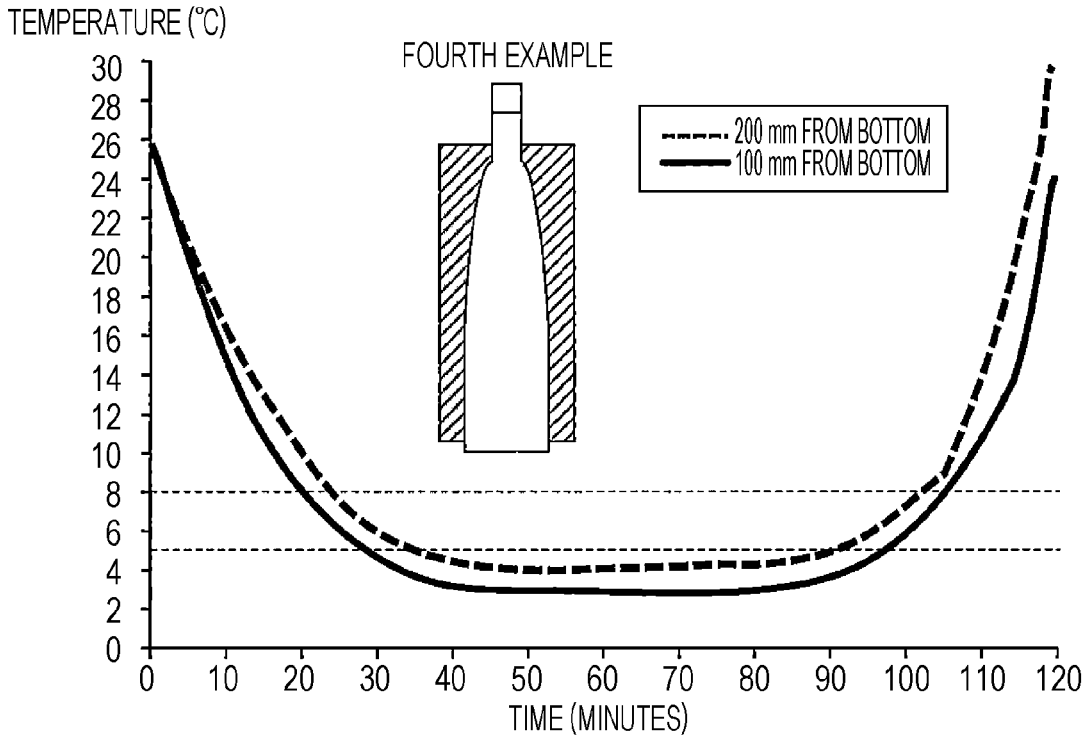
FIG. 45 is a diagram illustrating results of performing temperature measurement of liquid temperature of wine with regard to the fourth example.

FIG. 45 is a diagram illustrating results of performing temperature measurement of liquid temperature of wine with regard to the fourth example illustrated in FIG. 41. The wine bottle is a Burgundy type. According to the present invention, the thermal exchange unit was capable of close contact with the wine bottle in a uniform manner, as illustrated in FIG. 45. The rapid-cooling speed was faster than that of the fourth through sixth comparative examples, and performance capable of keeping cool at the desired temperature or lower was obtained.

Fifth Embodiment

Figure 46:
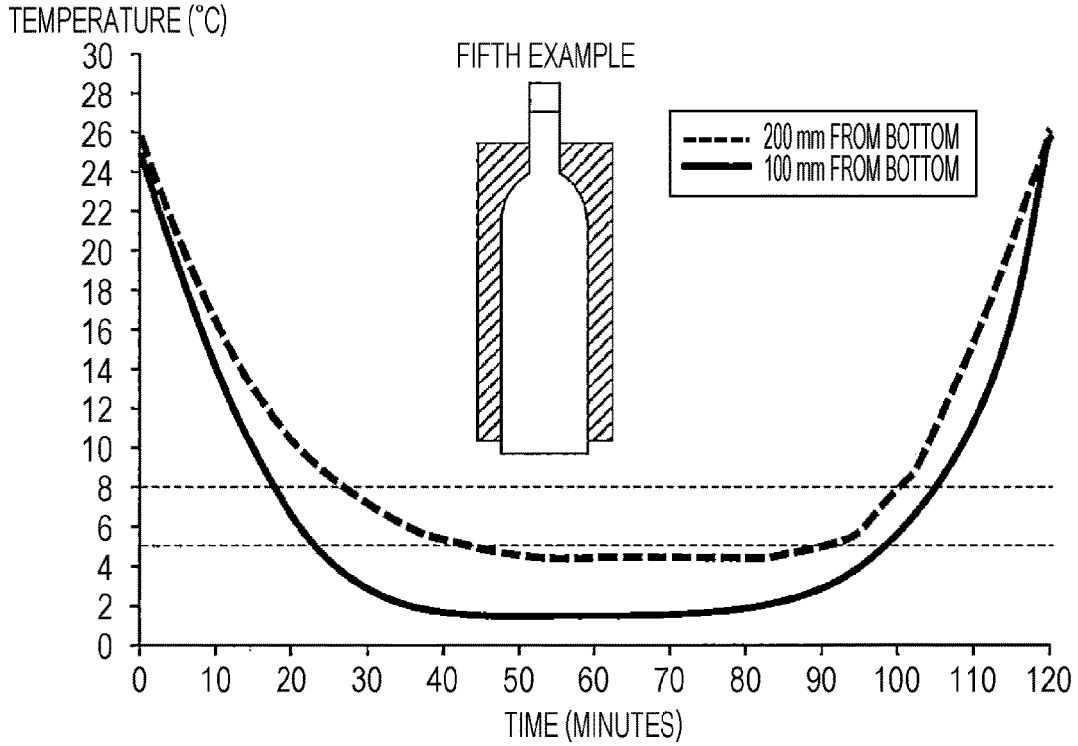
FIG. 46 is a diagram illustrating results of performing temperature measurement of liquid temperature of wine with regard to the fifth example.

FIG. 46 is a diagram illustrating results of performing temperature measurement of liquid temperature of wine with regard to the fifth example illustrated in FIG. 41. The wine bottle is a Bordeaux type. According to the configuration of the present invention, the thermal exchange unit was capable of close contact with the wine bottle in a uniform manner in the same way as in the fourth example, as illustrated in FIG. 46. The rapid-cooling speed was faster than that of the fourth and fifth comparative examples, and performance capable of keeping cool at the desired temperature or lower was obtained.

Sixth Embodiment

Figure 47:
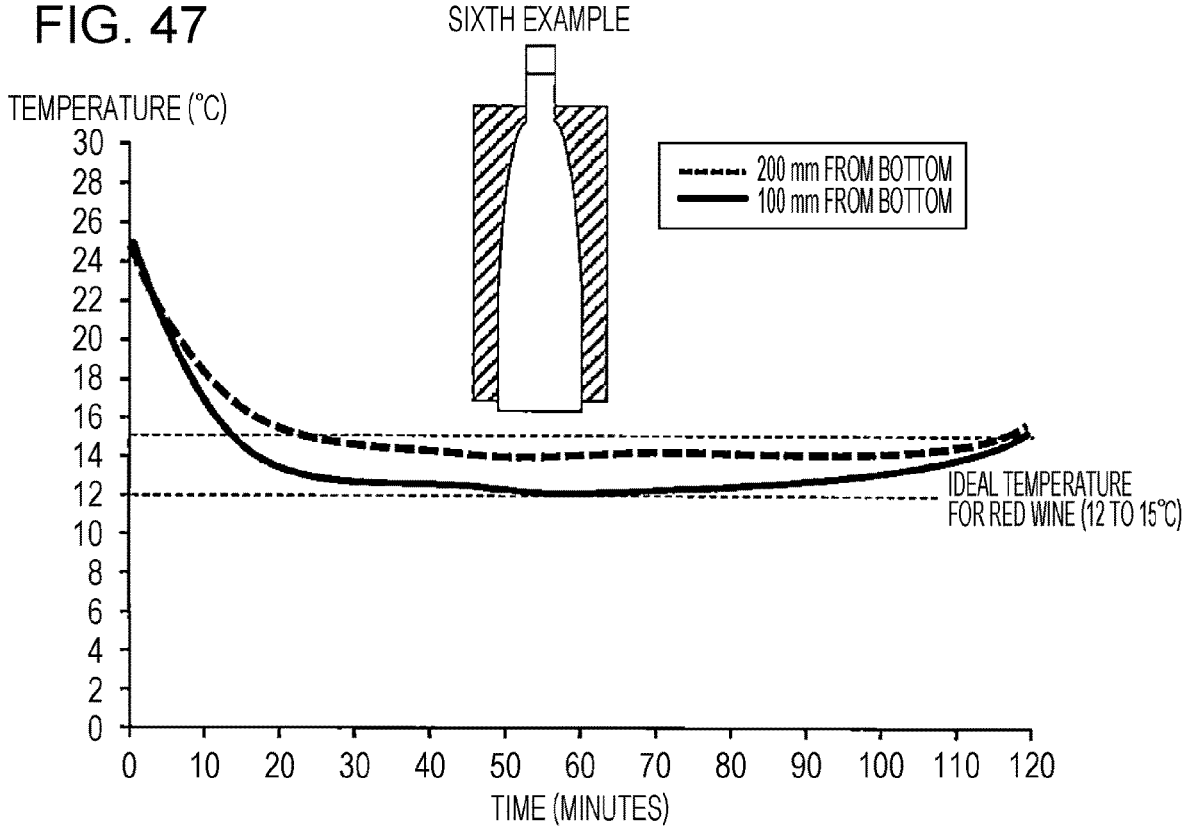
FIG. 47 is a diagram illustrating results of performing temperature measurement of liquid temperature of wine with regard to the sixth example.

FIG. 47 is a diagram illustrating results of performing temperature measurement of liquid temperature of wine with regard to the sixth example illustrated in FIG. 41. The wine bottle is a Burgundy type. The thermal exchange unit according to the sixth example was capable of close contact with the wine bottle in a uniform manner, as illustrated in FIG. 47. The serving temperature of red wine (12 to 15° C.) was quickly attained, and performance capable of keeping cool was obtained.

Seventh Embodiment

Figure 48:
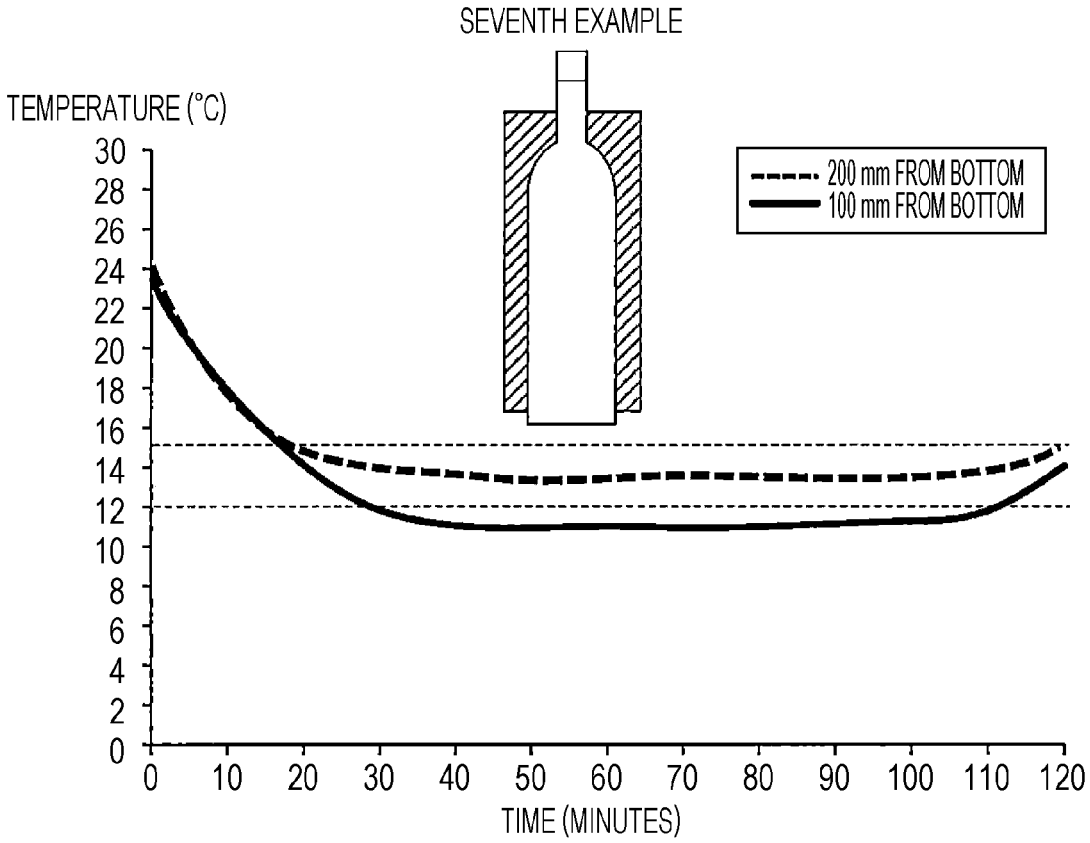
FIG. 48 is a diagram illustrating results of performing temperature measurement of liquid temperature of wine with regard to the seventh example.

FIG. 48 is a diagram illustrating results of performing temperature measurement of liquid temperature of wine with regard to the seventh example illustrated in FIG. 41. The wine bottle is a Bordeaux type. According to the configuration of the present invention, the thermal exchange unit was capable of close contact with the wine bottle in a uniform manner in the same way as in the sixth example, as illustrated in FIG. 48. The rapid-cooling speed was faster than that of the fourth and fifth comparative examples, and performance capable of keeping cool at the desired temperature or lower was obtained.

FIG. 49 is a table summarizing experiment results. In a case of application to white wine, the fourth comparative example was effective, but the fifth comparative example was not effective. Although the fourth comparative example was good, the amount of tightening by the drawstring differed each time measurement was performed, and performing measurement several times under the same conditions confirmed that variance occurs in the measurement results. The sixth comparative example can be said to be more effective than the fifth comparative example, but cannot be said to be sufficiently effective. In comparison with these fourth through sixth comparative examples, the fourth through seventh examples were effective regardless of whether the wine bottles were Burgundy type of Bordeaux type. Thus, according to the present embodiment, wine can be brought to a desired temperature regardless of the shape of the wine bottle.

[Regarding Viscosity of Thermal Energy Storage Material (Antifreeze and Latent Heat Material)]

There are two reasons to impart viscosity to the thermal energy storage material.

(1) To impart shape maintaining capabilities not affected by gravity.

The keeping state of the thermal energy storage material changes depending on how it is placed, as illustrated in FIG. 4A and FIG. 4B. In a case where the thermal energy storage material has no viscosity, propping up this unit will result in the thermal energy storage material sagging down, and creating a thermal path. In order to solve this problem, the viscosity of the thermal energy storage material is set to 1000 cP or higher, as described above.

(2) To reduce liquid spillage during conveyance.

There is a concern that the thermal energy storage material will spill out of the tray from shaking due to conveyance, at the time of conveying to the sealing step after filling the tray with the thermal energy storage material. Conveyance speed Down and takt UP are in a tradeoff relationship. In order to improve this, shaking of the liquid surface is reduced by imparting viscosity to the thermal energy storage material. The present inventors have confirmed by calculations that as a rule of thumb, approximately 100 cP or more is sufficient in a case of filling to 80% of the volume of the tray.

[Viscosity of Thermal Energy Storage Material and Shaking of Liquid Surface]

The shaking of the liquid surface of the filled material in a case where the tray is "stopped from conveyance" at the conveyance speed obtained by the above-described technique was calculated using ANSYS-CFX. As a result, the liquid surface shook greatly in a case where the viscosity was "1.0 cP", but the liquid surface did not shake in a case where the viscosity was "100 cP".

Figures 50, 51:
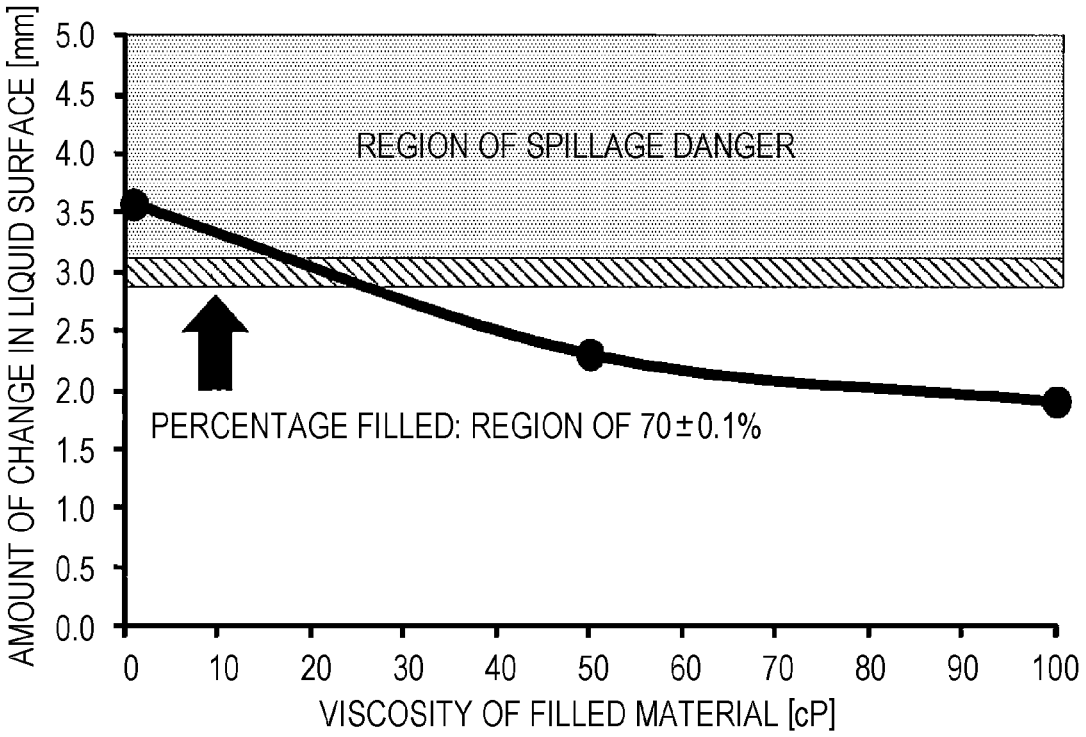
FIG. 50 is a diagram illustrating the amount of change in liquid surface as to the viscosity of the thermal energy storage material.
FIG. 51 is a table illustrating types of plastic, and thermal conductivity.

FIG. 50 is a diagram illustrating the amount of change in liquid surface as to the viscosity of the thermal energy storage material. In a state where the percentage filled is 70±0.1%, and the height of the tray is 10 mm, the height of the liquid surface is approximately 7 mm, as illustrated in FIG. 50. This means that if the amount of change in the liquid surface exceeds 3 mm, the thermal energy storage material will spill. If the amount of change in the liquid surface can be suppressed to within 2 mm, spilling of the thermal energy storage material can be suppressed. According to FIG. 49, if the viscosity of the thermal energy storage material is 100 cP, the amount of change in the liquid surface is smaller than 2 mm, and thus can be said to be worthy of practical use. Accordingly, the viscosity of the thermal energy storage material was stipulated to 100 to 200 cP, from the perspective of reducing liquid spillage during conveyance.

Third Embodiment

[Regarding Material of Second Deep-Drawn Container]

The second deep-drawn container 5 comes into direct contact with the wine bottle 10 that is the beverage, as illustrated in FIG. 1. In order to quickly bring the temperature of the object to be cooled, such as the wine bottle 10 or the like, to the desired temperature, a packing material that has a high thermal conductivity is preferably selected for the second deep-drawn container 5 that comes into direct contact with the object to be cooled. This packing material commonly is configured of plastic, the thermal conductivity thereof being as illustrated in FIG. 51. That is to say, polyethylene (low-density) is 0.33 [W/m·K], polyethylene (high-density) is 0.46 to 0.52 [W/m·K], polypropylene is 0.12 [W/m·K], polystyrene is 0.10 to 0.14 [W/m·K], polycarbonate is 0.19 [W/m·K], polyethylene terephthalate is 0.14 [W/m·K], and polyamide 6 (nylon 6) is 0.35 to 0.43 [W/m·K].

Of the packing materials shown in FIG. 51, resins to be selected preferably are high-density polyethylene (LDPE), low-density polyethylene (HDPE), or polymethylmethacrylate (PMMA). More preferably is to select a packing material made of a composite plastic in which high-thermal-conductivity particles (filler) have been dispersed. Specific examples of particles (filler) include silica, alumina, silicon nitride, silicon carbide, aluminum nitride, boron nitride, and so forth. The thermal conductivity of the fillers is as shown in FIG. 52.

Figure 52:
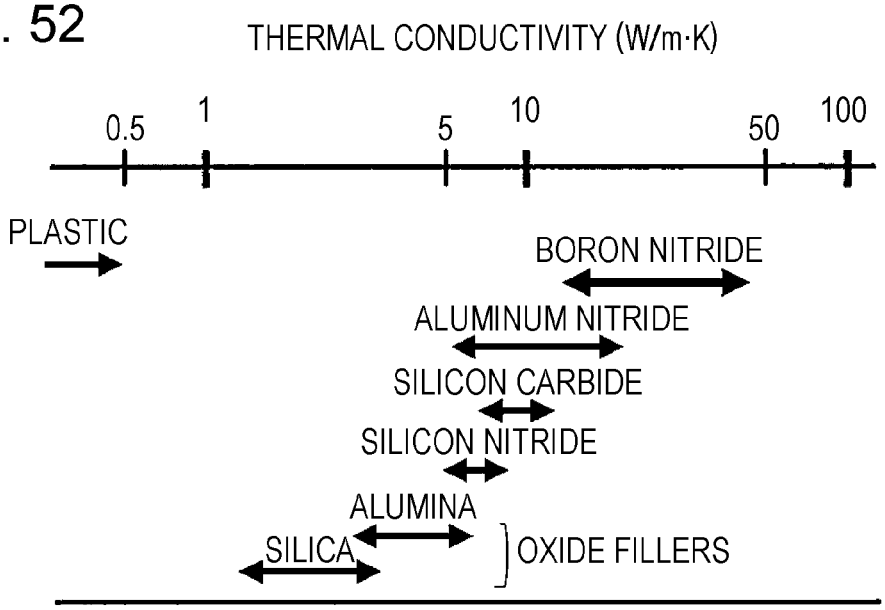
FIG. 52 is a diagram illustrating thermal conductivity of fillers.

The thermal conductivity [W/m·K] of the fillers is 2 to 4 [W/m·K] for silica as an oxide filler, 3 to 7 [W/m·K] for alumina as an oxide filler, 5 to 10 [W/m·K] for silicon nitride, 7 to 12 [W/m·K] for silicon carbide, 5 to 13 [W/m·K] for aluminum nitride, and 12 to 45 [W/m·K] for boron nitride, as shown in FIG. 52. Adding 30 vol % boron nitride filler to a polyamide film for example, causes the thermal conductivity to rise to approximately 3.0 W/m·K.

Figure 53:
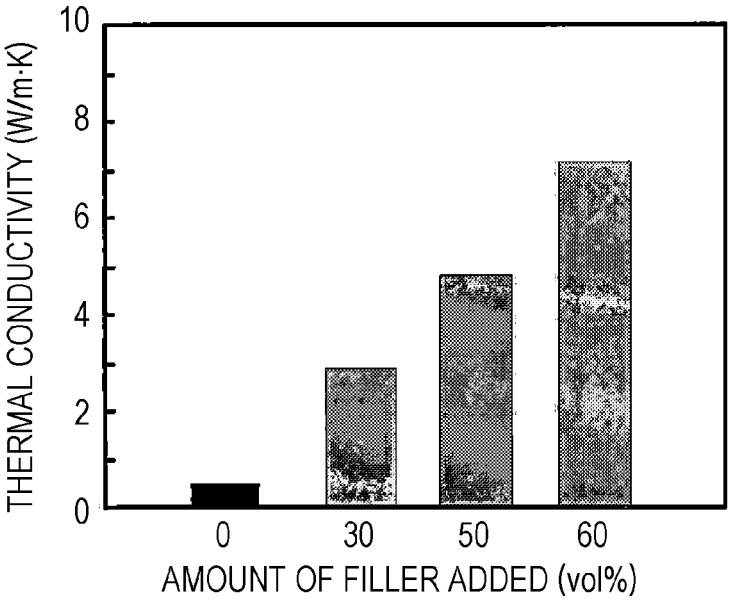
FIG. 53 is a diagram illustrating the relationship between the amount of filler added (vol %) and thermal conductivity [W/m·K].

FIG. 53 is a diagram illustrating the relationship between the amount of filler added (vol %) and thermal conductivity [W/m·K]. The terminal conductivity tends to increase as the amount of filler added increases, as illustrated in FIG. 53. That is to say, a film having thermal conductivity necessary for the usage can be selected.

[Regarding Selection of Thermal Energy Storage Material]

Figure 54:
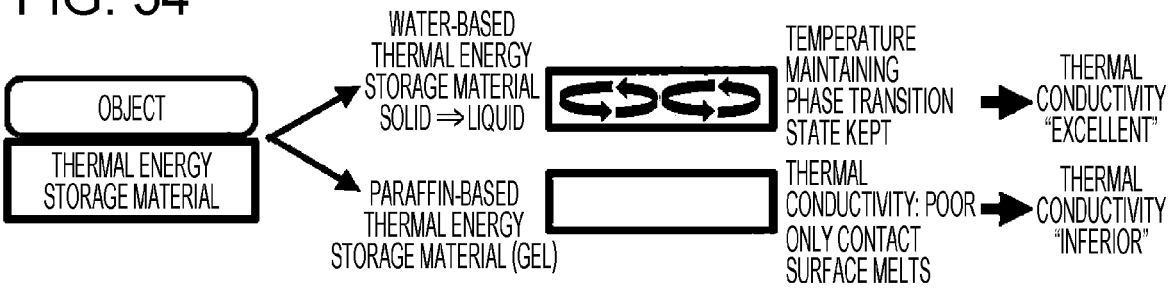
FIG. 54 is a diagram illustrating a concept of selecting a thermal energy storage material.

FIG. 54 is a diagram illustrating the concept of selecting thermal energy storage material. The thermal energy storage material preferably has physical properties with high specific heat and high thermal conductivity. That is to say, a thermal energy storage material having physical properties with high specific heat stores more heat at the same temperature than a thermal energy storage material having physical properties with low specific heat, so the object to be cooled can be cooled more quickly. For example, the greater part of the constituents of the thermal energy storage material described in the present specification is water. The specific heat of water does depend on temperature, but is very high, around 4200 J/kg·° C.

On the other hand, the specific heat of paraffin, which is a representative example of organic thermal energy storage material, is around 2180 J/kg·° C., and the specific neat of ethylene glycol commonly used as a coolant or the like is around 2400 J/kg·° C., which is around half that of water. That is to say, it can be said that water-based thermal energy storage materials having a high specific heat have superiority cooling capabilities as compared to other thermal energy storage materials.

Next, thermal conductivity will be studied. A thermal energy storage material made up of physical properties with high thermal conductivity can absorb external cold energy faster than thermal energy storage material made up of physical properties with low thermal conductivity, so in a case of freezing the thermal energy storage material in a freezer chamber, for example, the freezing can be performed more quickly. Also, the cold energy that the thermal energy storage material has stored can be thermally exchanged to the object to be cooled more quickly, so the object to be cooled can be cooled more quickly as a result.

As illustrated in FIG. 54, in a case of thermal energy storage material made up of a paraffin-based thermal energy storage material that has low thermal conductivity, thermal exchange at the interior of the thermal energy storage material is poor, with only the amount of cold energy at a region close to the object to be cooled being thermally exchanged to the object to be cooled, and the amount of cold energy at regions far from the object to be cooled is not thermally exchanged to the object to be cooled. That is to say, the total amount of cold energy that the thermal energy storage material has cannot be efficiently thermally exchanged to the object to be cooled. Further, in a case of paraffin, paraffin is combustible, so the thermal energy storage material itself often is thickened or gelled as a safety measure regarding leakage from the package or the like. In this case, convection within the thermal energy storage material is impeded, and there is a possibility that the thermal exchange will become even poorer as a result. On the other hand, in a case of a thermal energy storage material made up of water-based material that has a high thermal conductivity, the amount of cold energy that is held can be efficiently thermally exchanged to the object to be cooled. There also is no need to thicken or gel from the perspective of safety in the case of a water-based material, and accordingly it can be said that the thermal exchange capabilities are superior as compared to those of paraffin-based thermal energy storage materials.

[Verification]

Figures 55, 56:
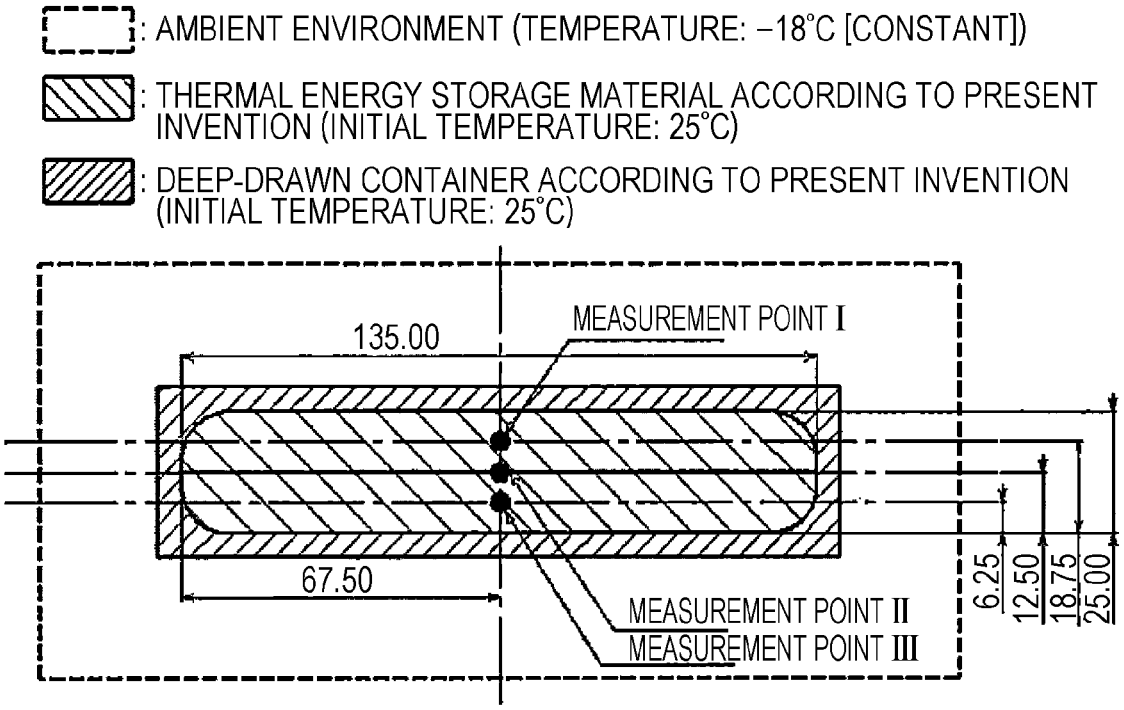
FIG. 55 is a diagram illustrating a model used in verification by simulation.
FIG. 56 is a diagram illustrating verification results by simulation.

FIG. 55 is a diagram illustrating a model used in verification by simulation. The thermal energy storage material in this model has the size of 135 mm×80 mm×t25 mm, as illustrated in FIG. 55, the ambient environment is a constant temperature of −18° C., and the thermal conductivity of the deep-drawn container is given by parameter A at an initial temperature of 25° C. The thermal conductivity of the thermal energy storage material is given by parameter B at an initial temperature of 25° C. The setting parameters are as follows.

The change in temperature of the object to be cooled overtime was calculated using this sort of a mode, regarding cases of varying the parameters A and B. The parameter A is (1) 230 W/m·K (equivalent to AL), (2) 0.33 W/m·K (equivalent to PE). The parameter B is (1) 0.57 to 0.62 W/m·K (equivalent to water), (2) 0.1 W/m·K (equivalent to paraffin). Note that water that exhibits phase change at 0° C. (334 J/g) is set for the object to be cooled. In FIG. 55, measurement point I is the center of the thermal energy storage material in the horizontal direction, at a position 18.75 mm from the bottommost portion, measurement point II is the center of the thermal energy storage material in the horizontal direction, at a position 12.5 mm from the bottommost portion, and measurement point III is the center of the thermal energy storage material in the horizontal direction, at a position 6.25 mm from the bottommost portion.

[Verification Results]

Figure 57:
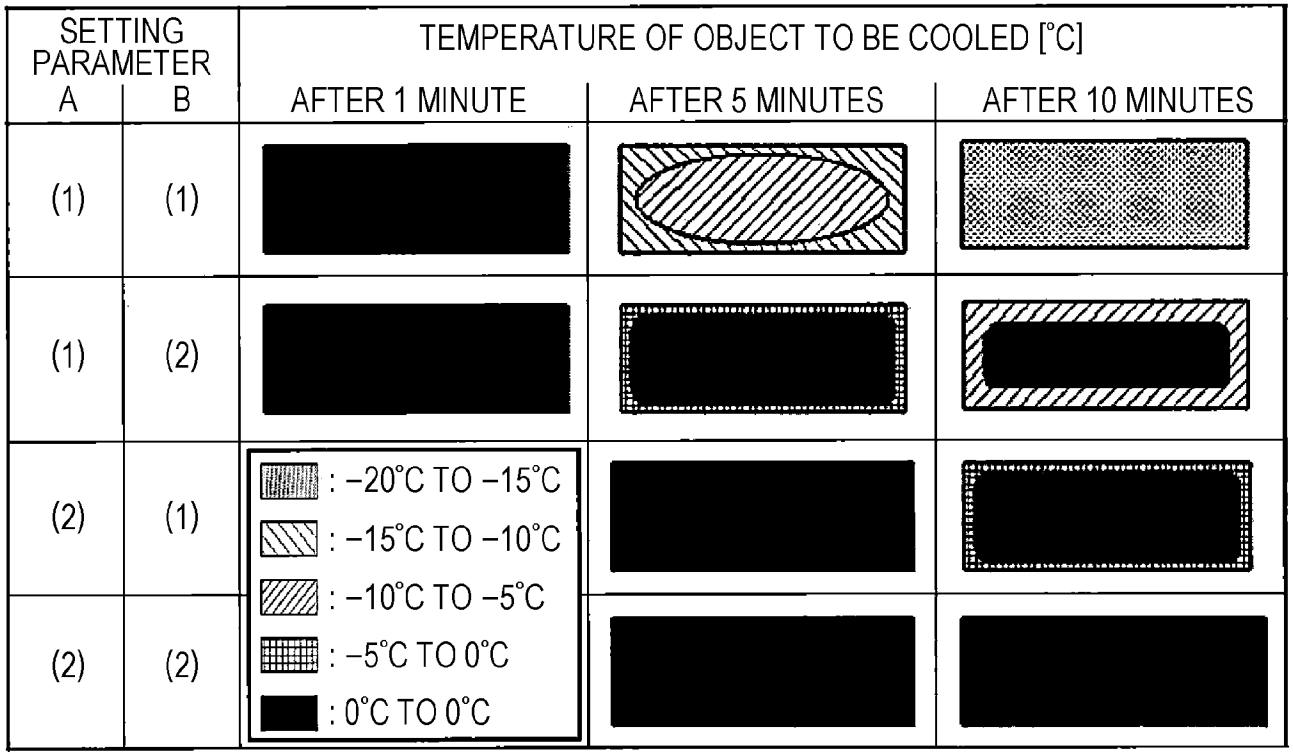
FIG. 57 is a diagram schematically representing temperature measurement results by simulation.

FIG. 56 is a diagram illustrating verification results by simulation, and FIG. 57 is a diagram schematically representing temperature measurement results by simulation. In FIG. 56 and FIG. 57, there was no change one minute after starting measurement in any of the cases, and all showed 0° C. After five minutes had elapsed, the temperature changed to −3.1° C. at measurement point I, 0° C. at measurement point II, and −3.5° C. at measurement point III, where the setting parameters were set to A(1) and B(2). In this case, there was a minus temperature region distribution at the peripheral portion of the object to be cooled, having a slight thickness, but the portion including the center was still at 0° C., as shown in FIG. 57. There was absolutely no change where the setting parameters were set to A(2) and B(1), and where the setting parameters were set to A(2) and B(2).

Conversely, in a case where the setting parameters were set to A(1) and B(1), the temperature changed to −13.5° C. at measurement point I, −9.8° C. at measurement point II, and −14.1° C. at measurement point III, which is a marked change as compared to the other cases. Also, it can be seen from FIG. 57 that when the setting parameters were set to A(1) and B(1), the low temperature range is distributed over a broader area as compared to other cases.

After ten minutes had elapsed, the temperature changed to −6.7° C. at measurement point I, 0° C. at measurement point II, and −8.3° C. at measurement point III, where the setting parameters were set to A(1) and B(2). In this case, there was a minus temperature region distribution at the peripheral portion of the object to be cooled, having a certain thickness, but the portion including the center was still at 0° C., as shown in FIG. 57.

Where the setting parameters were set to A(2) and B(1), the temperature changed to −2.2° C. at measurement point I, 0° C. at measurement point II, and −3.7° C. at measurement point III. In this case, there was a minus temperature region distribution at the peripheral portion of the object to be cooled, having a slight thickness, but the portion including the center was still at 0° C. There was absolutely no change where the setting parameters were set to A(2) and B(2).

Conversely, in a case where the setting parameters were set to A(1) and B(1), the temperature changed to −18.0° C. at measurement point I, −17.6° C. at measurement point II, and −18.0° C. at measurement point III, which is a marked change as compared to the other cases. Also, it can be seen from FIG. 57 that when the setting parameters were set to A(1) and B(1), the temperature of the object to be cooled was −18.0° C. at all portions, which is approximately the same as the ambient temperature.

From the above verification results, it can be said that the higher the thermal conductivity is, the more superior both the thermal energy storage material and the deep-drawn container in which the thermal energy storage material is packed are, from the perspective of freezing the thermal energy storage material more quickly. On the other hand, a tendency was observed where the lower portion of the model has lower temperature than the upper portion, and it is assumed that this is due to temperature dependency of density, exhibiting properties where the cold region moves to the lower portion and the warm region moves to the upper portion.

Thus, it has been found from the verification results of this simulation that the freezing time of the thermal energy storage material can be reduced by a configuration where the thermal conductivity of the thermal energy storage material is high and the specific heat is high. On the other hand, these results also suggest that in order to effectively and quickly perform thermal exchange of the cold energy that the frozen thermal energy storage material holds to the object to be cooled, the thermal energy storage material preferably has a configuration where the thermal conductivity of the thermal energy storage material is high and the specific heat is high.

As described above, according to the present embodiment, the object to be cooled can be quickly brought to a suitable temperature by using a packing material having high thermal conductivity, and a thermal energy storage material having high specific heat and high thermal conductivity.

The present invention can be configured as follows. That is to say, (1) the thermal energy storage pack according to the present invention is a thermal energy storage pack that performs temperature management of food and/or beverage, and includes a first accommodation portion filled with a first thermal energy storage material that exhibits phase change at a predetermined temperature, a second accommodation portion that is overlaid by the first accommodation portion and that is filled with a second thermal energy storage material that maintains a liquid phase state at the phase change temperature of the first thermal energy storage material, and a cover material that closes off the first accommodation portion, wherein the second accommodation portion comes into contact with the food and/or beverage.

(2) Also, in the thermal energy storage pack according to the present invention, the first accommodation portion is formed of a first plastic film, while the second accommodation portion is formed of a second plastic film, and the second plastic film is more flexible than the first plastic film.

(3) Also, in the thermal energy storage pack according to the present invention, the first accommodation portion and the second accommodation portion are deep-drawn containers, wherein flanges of the first accommodation portion and the second accommodation portion are joined, as well as the flange portion of the first accommodation portion and the cover material are joined.

(4) Also, in the thermal energy storage pack according to the present invention, a through hole is provided at an optional part of the flange portion of the first accommodation portion, with the flange portion of the second accommodation portion directly joining to the cover material at the through hole.

(5) Also, in the thermal energy storage pack according to the present invention, the first thermal energy storage material and second thermal energy storage material have sufficient viscosity to maintain a shape under own weight.

(6) Also, in the thermal energy storage pack according to the present invention, viscosity of the first thermal energy storage material and second thermal energy storage material is 1000 cP or higher.

(7) Also, in the thermal energy storage pack according to the present invention, a gap layer is provided between the first thermal energy storage material with which the first thermal energy storage material is filled, and the cover material.

(8) Also, in the thermal energy storage pack according to the present invention, the first accommodation portion further has an insulating material at a side opposite to the second accommodation portion.

(9) Also, in the thermal energy storage pack according to the present invention, the first thermal energy storage material is made up of water, a hydrocarbon compound that forms a clathrate hydrate with part of the water at temperatures of 0° C. or higher, and an inorganic compound that hardens the phase change temperature of another part of water to 0° C. or lower.

(10) Also, in the thermal energy storage pack according to the present invention, viscosity of the first thermal energy storage material and second thermal energy storage material is 100 to 200 cP.

(11) Also, in the thermal energy storage pack according to the present invention, a volume of the second accommodation portion is larger than a volume of the first accommodation portion.

(12) Also, in the thermal energy storage pack according to the present invention, the cover material is formed of an insulating material.

(13) Also, in the thermal energy storage pack according to the present invention, the Young's modulus of the first plastic film is 3000 MPa or higher, and the Young's modulus of the second plastic film is lower than 3000 MPa.

(14) Also, in the thermal energy storage pack according to the present invention, a face of the second accommodation portion that comes into contact with the food and/or beverage has a friction coefficient that is relatively smaller than that of other faces.

(15) Also, the thermal exchange unit according to the present invention has a plurality of the thermal energy storage pack according to any one of the above (1) through (14) that are connected, having joint mechanisms between adjacent thermal energy storage packs.

(16) Also, in the thermal exchange unit according to the present invention, the thermal energy storage packs are connected so as to be arrayed on concentric circles, and wherein the joint mechanisms have elasticity.

(17) Also, the thermal exchange unit according to the present invention includes an upper tier portion where a plurality of thermal energy storage packs having second accommodation portions that are relatively large are connected so as to be arrayed on a concentric circle, and a lower tier portion where a plurality of thermal energy storage packs having second accommodation portions that are relatively small are connected so as to be arrayed on a concentric circle, wherein the second accommodation portions come into contact with the food and/or beverage, by the upper tier being positioned above in the vertical direction and the lower tier being positioned below in the vertical direction when in use.

(18) Also, the thermal exchange unit according to the present invention further includes a pressing portion where the thermal energy storage packs are pressed in the center direction of the concentric circles.

(19) Also, in the thermal exchange unit according to the present invention, the pressing force of the pressing portion is 25 N or greater.

(20) Also, the manufacturing method of the thermal energy storage pack according to the present invention is a manufacturing method of a thermal energy storage pack that performs temperature management of food and/or beverage, including at least a step of molding a first accommodation portion having a recessed shape, using a first mold, a step of molding a second accommodation portion having a recessed shape that is at least larger than the recessed shape of the first accommodation portion, using a second mold, a step of filling the first accommodation portion with a first thermal energy storage material that exhibits phase change at a predetermined temperature, a step of filling the second accommodation portion with a second thermal energy storage material that maintains a liquid phase state at the phase change temperature of the first thermal energy storage material, and a step of overlaying the first accommodation portion filled with the first thermal energy storage material upon the second accommodation portion filled with the second thermal energy storage material, and joining a cover material, a flange portion of the first accommodation portion, and a flange portion of the second accommodation portion.

(21) Also, the manufacturing method of the thermal energy storage pack according to the present invention is a manufacturing method of a thermal energy storage pack that performs temperature management of food and/or beverage, including at least a step of molding a first accommodation portion having a recessed shape, using a first mold, a step of molding a second accommodation portion having a recessed shape that is at least larger than the recessed shape of the first accommodation portion, using a second mold, a step of filling the second accommodation portion with a second thermal energy storage material that maintains a liquid phase state at a phase change temperature of a first thermal energy storage material, a step of overlaying the first accommodation portion upon the second accommodation portion that has been filled with the second thermal energy storage material, a step of filling the first accommodation portion with the first thermal energy storage material that exhibits phase change at a predetermined temperature, and a step of joining a cover material, a flange portion of the first accommodation portion, and a flange portion of the second accommodation port ion.

(22) Also, the manufacturing method of the thermal energy storage pack according to the present invention further includes a step of providing a through hole at an optional part of the flange portion of the first accommodation portion, with the flange portion of the second accommodation portion and the cover material being directly joined at the through hole.

As described above, according to the present embodiment, the second thermal energy storage material 5*a* maintains a liquid phase state at the phase change temperature of the first thermal energy storage material 3*a*, and the second deep-drawn container 5 comes into contact with the food and/or beverage serving as a heat sink, so the second deep-drawn container 5 can be brought into close contact with the food and/or beverage at a desired temperature. Accordingly, the second thermal energy storage material 5*a* can transmit the sensible heat that the second thermal energy storage material 5*a* stores to the food and/or beverage in a sure manner, quickly bringing the food and/or beverage to the desired temperature. Further, the sensible heat and latent heat that the first thermal energy storage material 3*a* stores is transmitted to the food and/or beverage in a sure manner via the second thermal energy storage material 5*a*, thereby assisting in quickly bringing the food and/or beverage to the desired temperature, and transmitting the latent heat that the first thermal energy storage material 3*a* stores to the food and/or beverage in a sure manner, thereby enabling the food and/or beverage to be maintained at the desired temperature for a long time.

It is a feature of the thermal exchange unit according to the present embodiment in that a configuration has been made to mount by covering the wine bottle from above. Conventionally, there has been proposed a beverage cooler having a so-called drawstring mechanism, where there was a need to tighten the tip portion of the wine bottle after mounting on the wine bottle, but in the case of such a configuration, there is concern that variance in tightening force of the drawstring portion may cause great difference in rapid-cooling performance. Conversely, the present invention has no task of "tightening after mounting", and is advantageous in that occurrence of the above concern is extremely rare.

This application claims the benefit of Japanese Patent Application No. 2015-109143 filed May 28, 2015, Japanese Patent Application No. 2015-211316 filed Oct. 27, 2015, and Japanese Patent Application No. 2016-020573 filed Feb. 5, 2016, with Japanese Patent Application No. 2015-109143, Japanese Patent Application No. 2015-211316, and Japanese Patent Application No. 2016-020573 being hereby incorporated by reference herein in their entirety.

REFERENCE SIGNS LIST

1 thermal energy storage pack
3 first deep-drawn container
3*a* first thermal energy storage material
3*b* flange portion
5 second deep-drawn container
5*a* second thermal energy storage material

5*b* flange portion
7 cover material
8 through holes
9 adhesion portion
10 wine bottle
20 heat exchange unit
30 cooling ice mask
31L left eye cooling portion
31R right eye cooling portion
32 connecting portion
34L rubber band
34R rubber band
60 vacuum forming mold
61 rigid film
70 vacuum forming mold
71 flexible film
100 inner tray
102 first inner tray
104 second inner tray
106 bottom portion
108 latent heat material
110 outer tray
112 first outer tray
114 second outer tray
116 bottom portion
118 antifreeze
120 cover material (insulating material)
122 elastic connecting rubber
200 thermal energy storage pack
202 thermal exchange unit
240 icing pack
241 pack main unit
241*a* peripheral portion
241*b* accommodation portion
242R band portion
243L loop portion
243R hook portion
260 ice pillow
261 first accommodation portion
262 second accommodation portion
280 cold-storage mat
282 aluminum dish

The invention claimed is:

1. A thermal energy storage pack that performs temperature management of food and/or beverage, the thermal energy storage pack comprising:

a first accommodation portion filled with a first thermal energy storage material that exhibits phase change at a predetermined temperature;

a second accommodation portion that is overlaid by the first accommodation portion and that is filled with a second thermal energy storage material that maintains a liquid phase state at the phase change temperature of the first thermal energy storage material; and a cover material that closes off the first accommodation portion, wherein the second accommodation portion comes into contact with the food and/or beverage, wherein the first accommodation portion is formed of a first plastic film, while the second accommodation portion is formed of a second plastic film, and wherein the second plastic film is more flexible than the first plastic film.

2. The thermal energy storage pack according to claim 1, wherein the first accommodation portion and the second accommodation portion are deep-drawn containers, and wherein flanges of the first accommodation portion and the second accommodation portion are joined, as well as the flange portion of the first accommodation portion and the cover material are joined.

3. The thermal energy storage pack according to claim 2, wherein a through hole is provided at an optional part of the flange portion of the first accommodation portion, with the flange portion of the second accommodation portion directly joining to the cover material at the through hole.

4. The thermal energy storage pack according to claim 1, wherein the first thermal energy storage material and second thermal energy storage material have sufficient viscosity to maintain a shape under own weight.

5. The thermal energy storage pack according to claim 4, wherein viscosity of the first thermal energy storage material and second thermal energy storage material is 1000 cP or higher.

6. The thermal energy storage pack according to claim 5, wherein a gap layer is provided between the first thermal energy storage material with which the first thermal energy storage material is filled, and the cover material.

7. The thermal energy storage pack according to claim 1, wherein the first accommodation portion further has an insulating material at a side opposite to the second accommodation portion.

8. The thermal energy storage pack according to claim 1, wherein viscosity of the first thermal energy storage material and second thermal energy storage material is 100 to 200 cP.

9. The thermal energy storage pack according to claim 1, wherein a volume of the second accommodation portion is larger than a volume of the first accommodation portion.

10. The thermal energy storage pack according to claim 1, wherein the cover material is formed of an insulating material.

11. The thermal energy storage pack according to claim 1, wherein the Young's modulus of the first plastic film is 3000 MPa or higher, and wherein the Young's modulus of the second plastic film is lower than 3000 MPa.

12. The thermal energy storage pack according to claim 1, wherein a face of the second accommodation portion that comes into contact with the food and/or beverage has a friction coefficient that is relatively smaller than that of other faces.

13. A thermal exchange unit where a plurality of thermal energy storage packs, each of which is the thermal energy storage pack according to claim 1 are connected, having joint mechanisms between adjacent thermal energy storage packs.

14. The Thermal exchange unit according to claim 13, wherein the plurality of thermal energy storage packs are connected so as to be arrayed on concentric circles, and wherein the joint mechanisms have elasticity.

15. A thermal energy storage pack that performs temperature management of food and/or beverage, the thermal energy storage pack comprising:

a first accommodation portion filled with a first thermal energy storage material that exhibits phase change at a predetermined temperature;

a second accommodation portion that is overlaid by the first accommodation portion and that is filled with a second thermal energy storage material that maintains a liquid phase state at the phase change temperature of the first thermal energy storage material; and a cover material that closes off the first accommodation portion, wherein the second accommodation portion comes into contact with the food and/or beverage, wherein the first thermal energy storage material is made up of water, a hydrocarbon compound that forms a clathrate hydrate with part of the water at temperatures of 0° C. or higher, and an inorganic compound that hardens the phase change temperature of another part of water to 0° C. or lower.

16. A thermal exchange unit where a plurality of thermal energy storage packs, each being a thermal energy storage pack, wherein the thermal energy storage pack that performs temperature management of food and/or beverage, the thermal energy storage pack comprising:

a first accommodation portion filled with a first thermal energy storage material that exhibits phase change at a predetermined temperature;

a second accommodation portion that is overlaid by the first accommodation portion and that is filled with a second thermal energy storage material that maintains a liquid phase state at the phase change temperature of the first thermal energy storage material; and a cover material that closes off the first accommodation portion, wherein the second accommodation portion comes into contact with the food and/or beverage, wherein the plurality of thermal energy storage packs are connected, having joint mechanisms between adjacent thermal energy storage packs, wherein the thermal exchange unit comprises:

an upper tier portion where the plurality of thermal energy storage packs having second accommodation portions that are relatively large are connected so as to be arrayed on a concentric circle; and a lower tier portion where the plurality of thermal energy storage packs having second accommodation portions that are relatively small are connected so as to be arrayed on a concentric circle, and wherein the second accommodation portions come into contact with the food and/or beverage, by the upper tier being positioned above in a vertical direction and the lower tier being positioned below in the vertical direction when in use.

17. The thermal exchange unit according to claim 16, further comprising:

a pressing portion where the thermal energy storage packs are pressed in a center direction of the concentric circles.

18. The thermal exchange unit according to claim 17, wherein pressing force of the pressing portion is 25 N or greater.

19. The thermal exchange unit according to claim 16, wherein the thermal energy storage packs are connected so as to be arrayed on concentric circles, and wherein the joint mechanisms have elasticity.

* * * * *